US011255633B2

(12) United States Patent
Alber et al.

(10) Patent No.: US 11,255,633 B2
(45) Date of Patent: Feb. 22, 2022

(54) FIREARM

(71) Applicants: Wilfried Alber, Volkach (DE); Georg Holthaus, Kitzingen (DE)

(72) Inventors: Wilfried Alber, Volkach (DE); Georg Holthaus, Kitzingen (DE)

( * ) Notice: Subject to any disclaimer, the term of this patent is extended or adjusted under 35 U.S.C. 154(b) by 0 days.

(21) Appl. No.: 16/747,351

(22) Filed: Jan. 20, 2020

(65) Prior Publication Data

US 2021/0080221 A1 Mar. 18, 2021

(30) Foreign Application Priority Data

Sep. 12, 2019 (DE) ..... 10 2019 124 569.9
Dec. 3, 2019 (DE) ..... 10 2019 132 880.2
Dec. 30, 2019 (DE) ..... 10 2019 135 856.6

(51) Int. Cl.

| | |
|---|---|
| ***F41C 7/00*** | (2006.01) |
| ***F41A 3/66*** | (2006.01) |
| ***F41A 5/18*** | (2006.01) |
| ***F41A 17/36*** | (2006.01) |
| ***F41A 19/09*** | (2006.01) |
| ***F41A 19/12*** | (2006.01) |

(52) U.S. Cl.

CPC ..... *F41C 7/00* (2013.01); *F41A 3/66* (2013.01); *F41A 5/18* (2013.01); *F41A 17/36* (2013.01); *F41A 19/09* (2013.01); *F41A 19/12* (2013.01)

(58) Field of Classification Search

CPC ..... F41C 7/00; F41A 3/66; F41A 5/18; F41A 17/36; F41A 19/09; F41A 19/12
USPC ..... 42/69.01
See application file for complete search history.

(56) References Cited

U.S. PATENT DOCUMENTS

| | | | | |
|---|---|---|---|---|
| 2,509,640 | A | 5/1950 | Higson | |
| 3,412,641 | A * | 11/1968 | Biehl | F41F 3/045 89/1.812 |
| 6,651,371 | B2 | 11/2003 | Fitzpatrick et al. | |
| 7,131,228 | B2 * | 11/2006 | Hochstrate | F41C 23/16 42/75.01 |
| 7,810,271 | B2 * | 10/2010 | Patel | F41A 11/02 42/75.03 |
| 8,028,458 | B2 * | 10/2011 | Rohrauer | F41C 23/20 42/75.01 |
| 8,127,480 | B1 * | 3/2012 | McManus | F41A 9/82 42/49.02 |
| 8,393,107 | B2 * | 3/2013 | Brown | F41C 23/12 42/105 |
| 9,612,072 | B2 * | 4/2017 | Hochstrate | F41A 21/482 |
| 9,766,029 | B2 * | 9/2017 | Dextraze | F41A 29/00 |
| 9,797,666 | B2 * | 10/2017 | Schuetz | F41A 11/02 |
| 10,012,457 | B2 * | 7/2018 | Jones | F41C 23/00 |

(Continued)

FOREIGN PATENT DOCUMENTS

| | | |
|---|---|---|
| DE | 30 04 055 A1 | 8/1981 |
| GB | 191506875 A | 8/1916 |
| WO | WO-2013/132291 A1 | 9/2013 |

*Primary Examiner* — John Cooper
(74) *Attorney, Agent, or Firm* — Saliwanchik, Lloyd & Eisenschenk

(57) ABSTRACT

The invention relates to a firearm, in particular for shooting cartridge ammunition, having at least one weapon chassis 3, a weapon system support 4, and a weapon system apparatus 5; at least the weapon chassis 3 and the weapon system support 4 have corresponding engagement means 10 provided in spacing patterns via which they can be axially positioned differently relative to each other.

40 Claims, 45 Drawing Sheets

(56) References Cited

U.S. PATENT DOCUMENTS

| | | | | |
|---|---|---|---|---|
| 10,215,517 | B2 * | 2/2019 | McCallum | F41A 11/02 |
| 10,401,103 | B2 * | 9/2019 | Konev | F41A 17/38 |
| 10,837,721 | B2 * | 11/2020 | Ives | F41A 11/02 |
| 2006/0026883 | A1 * | 2/2006 | Hochstrate | F41C 23/16 42/75.01 |
| 2006/0283067 | A1 * | 12/2006 | Herring | F41A 3/66 42/75.01 |
| 2009/0288324 | A1 * | 11/2009 | Peterson | F41A 11/02 42/75.03 |
| 2010/0162608 | A1 * | 7/2010 | McCann | F41C 23/16 42/71.01 |
| 2012/0167433 | A1 * | 7/2012 | Robbins | F41A 3/66 42/75.02 |
| 2012/0297656 | A1 * | 11/2012 | Langevin | F41A 3/66 42/16 |
| 2016/0153744 | A1 * | 6/2016 | Teetzel | F41A 19/10 42/105 |
| 2019/0113297 | A1 * | 4/2019 | Turlakov | F41A 21/487 |
| 2019/0212082 | A1 * | 7/2019 | Masters | F41A 3/66 |

* cited by examiner

FIREARM

CROSS-REFERENCE TO RELATED APPLICATIONS

This application claims priority to German Application Nos. 10 2019 124 569.9, filed Sep. 12, 2019; 10 2019 132 880.2, filed Dec. 3, 2019; and 10 2019 135 856.6, filed Dec. 30, 2019, the disclosures of each of which are incorporated herein by reference in their entirety.

The invention relates to a firearm according to the preamble to claim 1.

Firearms are subdivided into the categories of long guns and handguns.

In particular, long guns usually come in the form of rifles while handguns are pistols and revolvers.

A gun is generally defined as a device in which bullets are driven through a barrel whereas firearms are guns in which a bullet is driven through one or more barrels by means of hot gases. In weapons of this kind, there is a distinction between automatic weapons, i.e. guns, which, after a shot is discharged in particular by means of combustion, are automatically ready to fire again; semiautomatic weapons, which, after a shot is discharged, are indeed automatically ready to fire again, but require a trigger to be pulled in order to fire a new shot, bolt-action weapons; and single-shot weapons.

Firearms have been known for a long time. The explanations below relate to so-called long guns, i.e. weapons in which the bolt and barrel in the closed state have a length of 30 cm or more and which are 60 cm or longer overall.

Such firearms include, for example hunting rifles, but also weapons for use by the military, government agencies, and police departments. Usually, weapons have at least one barrel and one bolt, the barrel having a cartridge chamber for containing a cartridge and an actual barrel profile, which is used for guiding the bullet when the latter has exited the case of the cartridge due to the ignition of the propellant. In order to stabilize the bullet during its flight to a point of impact, it is customary to provide the bullet with a rapid spin around the longitudinal axis, in order to be able to achieve a gyroscopic stabilization in its flight phase. In conventional firearms, this happens in that the barrel has a so-called land/groove profile (rifled barrel) or a polygonal profile.

The purpose of the breech of a firearm is to support the cartridge at the back so that the cartridge remains in the cartridge chamber during firing and simultaneously executes a sealing in opposition to the gas pressure. Usually, the actual ignition device for the primer of the cartridge, namely the firing pin or striker is located in the breech.

Depending on the design of the firearm, it may also have a permanently installed magazine or a magazine well for accommodating a magazine, the magazine being able to accommodate a plurality of cartridges, which are fed from the magazine by the forward and backward movement of the bolt by a front end of the bolt and are slid into the cartridge chamber.

Depending on the design of the firearm, the bolt ensures that during firing, the bolt is immobilized in the axial direction in order to support the cartridge. The immobilization of the bolt is carried out in that the bolt engages behind a counter-support at the barrel end or a counter-support in a device that connects the barrel to the case.

Firearms that guide cartridges from a magazine into the cartridge chamber usually have a so-called rotating bolt action, which is first pulled back and with a forward motion in the direction toward the cartridge chamber, carries the cartridge along with it and guides it into the cartridge chamber and then, through a rotating motion, brings about the above-mentioned engagement from behind. For this purpose in conventional bolt-action weapons, the shooter uses a so-called bolt handle to actively rotate the bolt or in straight-pull bolt-action rifles, the rotation of the bolt head is produced by a control cam. An example of a bolt action is the Mauser system, an example of a straight-pull bolt-action is the Schweizer K31 system. An example of a straight-pull bolt-action without rotation is the Blaser R93/R8 system.

From back to front, the basic design of firearms with a rotating bolt or a rotatable bolt head provides a stock or butt, which is adjoined by a receiver. Usually, the receiver has a trigger device at its stock end, which is used to trigger the shot, followed by a magazine well or permanently installed magazine and further toward the front, a locking device for the bolt or in firearms in which the bolt is locked directly in the barrel, the barrel beginning with the cartridge chamber. Frequently, a front grip handle is installed on or around the barrel and can be used to grip the weapon with one hand while the other hand can be positioned in the usual way in the region of the stock so that a finger can actuate the trigger.

With regard to the position of the firearm in the firing state, the receiver has a receiver top and a receiver bottom, a receiver bridge at the back, and a receiver head at the front. The receiver bottom has the trigger device or accommodates it and usually has the permanently installed magazine or a magazine well for a magazine that is to be pivoted or inserted into place. On top, mounting devices can be mounted or permanently affixed, which can be used for mounting an aiming device, in particular a rifle scope. Between the top and bottom, the receiver is usually provided with an ejection window for fired cartridges.

The bolt is supported inside the receiver, in particular supported so that it is able to move axially, and in conventional bolt-action weapons, can be moved rearward out of the receiver head of the receiver in the direction toward the stock in order to retract the bolt head far enough that the bolt head sweeps past a cartridge in the magazine during the rearward motion and during the forward motion, with the bolt head, i.e. the front end of the bolt, slides a cartridge out of the magazine in the direction of the cartridge chamber.

In automatic or fully automatic firearms in which the bolt is unlocked and moved backward by the action of the recoil or by the combined action of hot powder gases and the recoil and is moved back into the firing position by a recuperator spring, the receiver is usually embodied as much longer, depending on the design, and is not open toward the rear.

When firing, the shooter actuates the trigger device, releasing a hammer, which usually at a rear end of the bolt strikes the firing pin and moves it forward so that it actuates the primer or the actuation of the trigger releases the spring-loaded firing pin so that it is moved toward the primer by the force of the spring.

In both cases, the shot is discharged and the bullet is driven through the barrel by the hot gases of the combusting propellant.

In conventional bolt-action weapons, the bolt head or the entire bolt is then rotated and thus unlocked, the rear end of the fired case is grasped by a cartridge ejector in the bolt head and is removed from the cartridge chamber. A cartridge ejector that is usually present in the breech or in the receiver ejects the case from the receiver at the moment in which the cartridge is even with the ejection window and can be catapulted outward. From this position, the bolt is usually pulled slightly rearward until a full cartridge, through the action of a magazine spring, is pushed in the usual way into the movement path of the bolt.

In this connection, it should be noted that usually, the cartridges in the magazine are held down by the bolt itself until the bolt uncovers the magazine well and the cartridge can therefore be pushed upward. Then the cartridge is fed into the cartridge chamber by the forward movement of the bolt and is immobilized there or directly in the barrel by the bolt and in particular the engagement of the bolt behind the bolt counter-support.

As explained above, the movement of the bolt by means of a so-called bolt handle or in fully automatic or semiautomatic weapons, by means of a control cam, which performs its function between the bolt and bolt head.

An example of semiautomatic systems is the Browning BAR system in which the unlocking of the bolt is carried out by the hot powder gases and the rearward motion of the bolt is carried out by the existing recoil momentum. The forward motion of the bolt is then carried out by means of bolt springs located under the barrel.

The overall length of a firearm is usually determined by the sequence of the trigger device or at least the release device on the one hand, followed by the magazine well and followed by the locking region, particularly also based on the cartridge length and thus the magazine length of the cartridges that are to be shot.

The object of the invention is to create a high-precision firearm with a large degree of variability, short overall length, and high degree of safety.

The object is attained with a firearm having the features of claim 1.

Other advantageous modifications are disclosed in the sub-claims that are dependent thereon.

Whenever the "front" is spoken of below in connection with a firearm, this specifically means forward in the direction of fire, i.e. closer when viewed from the muzzle.

Whenever the "rear" or "rearward" is spoken of in the following, this means in the direction away from the direction of fire or farther away from the muzzle.

Whenever "above" or "upper" are spoken of in the following, this means the side of the weapon that is oriented upward in the conventional shooting stance. This is normally the side of a weapon, which, in the conventional shooting stance, has aiming aids such as a rifle scope or sights, or the notch and bead, i.e. the sight line.

Whenever "below" or "lower" are spoken of in the following, in relation to the weapon, this describes the side, which, in the conventional shooting stance, points downward and usually has the pistol grip, the trigger, and the magazine well.

Whenever "lateral" or "side" are spoken of in the following, in relation to the weapon, this means laterally or to the side in the conventional shooting stance, for example like the ejection window for cartridges.

It is clear to the person skilled in the art that this frame of reference also applies when the weapon is held differently, is set down, or is in some other way placed in a different spatial orientation.

The firearm according to the invention is embodied in a way that departs from conventional designs; from the back to the front, the firearm has a stock, a magazine well, and a triggering and safety device as well as the barrel and a hand grip. In a departure from conventional designs, the lock and the safety device are mounted not on the underside of the receiver, but rather on the top of the receiver, in particular opposite from the magazine well, which significantly reduces the overall length. Both the safety and the trigger are usually are actuated in the usual way on the underside of the receiver, but with a separate grip or pistol grip, as is already conventional in so-called "bullpup" weapons. According to the invention, however, the movement of a safety slider and/or the actual trigger can be transmitted to the top of the receiver.

The firearm according to the invention also has a straight-pull bolt-action with a bolt body and a bolt head, the bolt head being force-controlled by means of a control cam and is rotated relative to the bolt body.

In this case, the bolt can be manually actuated as a straight-pull bolt-action or as a gas-operated or recoil-operated weapon.

It is also possible according to the invention to provide the ejection window on both sides of the receiver; according to the invention, the ejector device on the bolt head can be adjusted by means of two laterally positioned ejector devices, which can be alternatively activated.

According to the invention, the barrel is screwed into a barrel receptacle or fastened therein in some other way, with the barrel receptacle also constituting the locking counterpart for the bolt head and being itself positioned in a receptacle by means of a quick release.

This placement yields an increased precision during firing; the type of locking of the bolt in the barrel receptacle is designed so that the locking becomes stronger when subjected to pressure.

Preferably, the receiver is designed so that the stock is an integral component; the stock and the cushion at the end can be pivoted so that both the bolt and the barrel and barrel receptacle can be removed rearward from the receiver.

In addition, the receiver and the entire weapon chassis are embodied to be adjustable in length with simple tools, particularly in the region of the magazine well. According to the invention, on a rear boundary wall, the magazine well has a guide for this purpose and possibly also a lock for the magazine so that magazines of different lengths, for example from a .223 caliber Remington to a .50 caliber BMG can be accommodated after completion of the length change.

For this purpose, at the respectively divided components that can be pulled apart from each other, the receiver and the entire weapon chassis have a corresponding wavy engagement profile, which correspondingly permits a uniformly patterned length adjustment, which also has the necessary stability in order to also be able to safely accommodate heavy calibers and their recoil.

The invention therefore relates to a firearm, particularly for firing cartridge ammunition, having at least a weapon chassis, a weapon system support, and a weapon system apparatus; at least the weapon chassis and the weapon system support have corresponding engagement means provided in spacing patterns by means of which they can be axially positioned differently relative to each other.

Advantageously, the corresponding contours can be secured relative to each other by engagement means and can be connected with screw connections.

Advantageously, the lock for releasing the lock and the safety for securing the lock are positioned above the bolt travel path relative to the magazine well 8 in the weapon system support 4.

To permit easy assembly of the firearm and easy maintenance of the firearm, it is advantageous if the weapon chassis and/or the weapon system support and/or the weapon system apparatus are embodied as longitudinally divided and screw-connectable.

It is also advantageous that the magazine well on the weapon chassis is embodied in such a way that at a rear transverse edge of the magazine well, a magazine mount for detachably mounting a magazine is provided and at the front, the magazine well is delimited by a base plate, which can be positioned on the weapon chassis by means of a spacing pattern using corresponding contours; to change the length of the magazine well in order to adapt to different cartridge lengths, a shoulder support device, which is vertically movable and detachable, is axially affixed to a receptacle on the weapon chassis at one end and, by means of corresponding contours, can be moved axially relative to the weapon system support.

Advantageously, the weapon chassis 3, the weapon system support 4, and the weapon system apparatus 5 are positioned one after the other from bottom to top; the shoulder support device 2 constitutes the end of the firearm 1 at the rear and at the top rear, above a bolt travel path; the weapon chassis, the weapon system support, a pistol grip assembly, and the shoulder support device each have the engagement contour 10; and the spacing patterns correspond to one another.

Also advantageously, on at least one of the above-mentioned components, a plurality of engagement contour elements are provided, which extend transversely relative to the longitudinal direction and are arranged in a spacing pattern, and on at least one other component, a correspondingly shaped contour is provided, which is arranged in a corresponding spacing pattern.

It is advantageous if the contour has wavy projections (12) or wavy double projections (12), both on top and on the bottom, which are also offset from each other by a half a space of the pattern; these projections (12) are embodied as wavy or tooth-shaped.

In an advantageous embodiment, on the weapon chassis 3, the engagement contour 10 is embodied as doubled, one pointing toward the top and one pointing toward the bottom, in the form of wave formations that extend transversely to the longitudinal direction and are offset relative to each other; both on the bottom and on the top, respective wave crests and wave troughs are arranged in alternation; the wave troughs and wave crests on the top and the wave troughs and wave crests on the bottom are particularly offset from each other by half a wave length so that transversely to the longitudinal axis, a wave crest on the bottom is aligned with a wave trough on the top; and between the wave troughs of the top and bottom, which are offset relative to one another, there is a connecting piece.

It is also advantageous if the contour 10 is integrally embodied of the material of the respective component of the firearm or is embodied as being placed on rails and protrudes inward or outward by a desired amount, in particular by 2 mm; in particular, the distance between equivalent flanks of the wave crests is 10 mm.

It is also advantageous if from an outside of the contour, the wave crests and wave troughs are inclined toward a wall of the respective component so that in particular, a 75° angle is formed so that the contour widens out in the direction away from the wall, particularly in the region of the wave tips, and toward the inside, i.e. in the direction away from the wall at the bottom of the wave troughs, so that the inclination of the contour is the same in the region of wave tips and the wave troughs, while in the region between the wave troughs and the wave tips, the contour is flat, thus ensuring that a correspondingly shaped counterpart contour fits or can be fitted in a form-fitting way and also ensuring that with a form-fitting engagement between a counterpart contour and a double-rowed contour, the form-fitting engagement and engagement from behind also reliably inhibit a pulling-apart in the transverse direction.

In an advantageous embodiment, the widths of the respective components are adapted to one another so that they can be inserted into one another in such a way that the corresponding contours can be brought into a form-fitting engagement.

In an advantageous way in order to secure an arrangement of contours which are brought into form-fitting engagement with one another, to inhibit them from yielding upward and/or downward, a plurality of through bores are provided in the respective components from bottom to top, i.e. transversely to the longitudinal direction of the firearm, which are spaced apart axially by a distance that corresponds to the spacing pattern of the contour or to a multiple thereof so that the respective parts having a contour can be screw-connected to each other by means of bolts extending through the bores.

It is also advantageous if the respective parts are provided with fit bolts, which are likewise positioned at distances corresponding to the spacing pattern of the contour, but preferably a multiple thereof, in order to ensure a defined seating before the screw connection is produced; the fit bolts are positioned on the components in the region of one or more bores, replacing them, and engage in a bore of the respective corresponding component.

The firearm lock system according to the invention is designed so that the components actually required for the firing such as the hammer, mainspring, sear bar, etc. are positioned above a bolt travel path, in particular relative to the magazine well. The bolt travel path in this case is the travel path on which the bolt travels when it is moved rearward out of the position in which it seals the cartridge chamber and then is moved forward again in order to supply a cartridge from a magazine, which has been inserted into the magazine well, to then insert the cartridge into the cartridge chamber and, behind the cartridge chamber, to seal the barrel toward the rear.

According to the invention, the safety mechanism is therefore also relocated from the bottom to the top; both the action of the trigger and the action of a safety slider are mechanically transmitted from the bottom to the top around the bolt, the barrel, and/or a barrel receptacle.

The transmission to the top respectively takes place with a lever that is routed in an arc-shape, in a circular fashion, or in some other way between the top and bottom and is supported in pivoting fashion at the bottom or top.

According to the invention, the hammer unit of the lock, i.e. the hammer or a lever arm functioning as the hammer and lever elements connected thereto, is embodied in the form of a toggle lever. If the hammer or the lever is moved into the cocked position and thus cocks the mainspring, a sear bar cooperates in a latching fashion with the hammer or this lever, the sear bar being pressed into the latch by the pressure of a spring.

The invention takes advantage of the fact that a toggle lever has a dead point in the fully extended state. If it is pivoted in the one or the other direction, it assumes a mechanically more stable state from which it can only be brought back through the dead point by an external influence. The toggle lever is the essential feature of the invention.

According to the invention, the safety in this case functions so that the toggle lever mechanism of the hammer and the mechanical parts operatively connected to it are pushed upward opposite from the hammer direction, which is a downward-pivoting motion, and are held there. In other words, the toggle lever is moved upward opposite from the hammer direction through the dead point and remains there in a mechanically stable position. By means of this, not only does the safety rod make sure that the hammer cannot be moved in the direction toward the firing pin because the movement is blocked, but also the special feature of the toggle lever makes sure that whatever force acts on the hammer, it does so in exactly the opposite direction, i.e. away from the firing pin.

Consequently, according to the invention, a particularly reliable safety is achieved, which is far superior to known safety systems and manual cocking systems. The invention achieves the advantage that a simply embodied, rugged lock for a firearm, in particular a bolt-action firearm is achieved, which has a particularly reliable safety and is also very ruggedly built due to the design.

The invention therefore relates to a lock system for a firearm having an arrangement composed of at least two lever arms; the lever arms are connected to a rotation axle or shaft in articulating fashion similar to a toggle lever, the resulting toggle lever being pivotable to both sides of a dead point in which the arrangement is maximally extended and one of the lever arms being embodied as a hammer for a firing pin.

In this connection, it is advantageous if a pivoting direction to a side of the dead point closer to the firing pin defines a released position and a pivot to the other side of the dead point defines a safety position.

It is also preferable if the at least one lever arm acts on the rotation axle under the pressure of a spring so that the dead point must be overcome in opposition to the pressure of the spring.

It is also advantageous if in the released position, a lever with a latch is embodied so that it cooperates in a detachable way with a latch counterpart or surface of a sear bar.

In an advantageous embodiment, the system including the lever arms is positioned on the top of a weapon above a bolt travel path.

Advantageously, in order to transmit a trigger movement of a trigger tongue to a sear bar positioned above the bolt path, a trigger transmission lever is provided, which transmits the movement of a trigger slide, which is positioned on the underside of the weapon, to the top of the weapon; the trigger transmission lever is positioned at a free end diametrically opposite from a free end of the sear bar and is supported there in articulating fashion and toward the underside of the weapon, the trigger transmission lever is likewise supported in articulating fashion in the trigger slide; the trigger transmission lever is guided around the components situated between the top of the weapon and the underside of the weapon and/or around a bolt travel path so that movement of the trigger slide in one axial direction is converted into a movement of the sear bar in the opposite axial direction.

In an advantageous way, in a cocked, unreleased position of the lock, the sear bar, with the underside of a free end, engages in a latch or latch recess in the cylindrical region of the one lever; the underside of one end of the sear bar serves as latch counterpart element for a flat latch surface formed by the recess, which extends transversely, i.e. axially relative to the hammer rotation axle, so that the lock holds the lever arrangement—in opposition to the pressure of a spring—against a hammer bar, which is connected in articulating fashion to the other lever arm and is held by the sear bar when the surface of the sear bar is resting against or on the surface of the lever.

It is also advantageously possible that the sear bar is positioned so that it can move axially into and out of the latched engagement between the surfaces; the sear bar is spring-loaded in the direction toward the engagement so that the release of the latched connection must take place in opposition to the pressure of a spring.

Advantageously, in addition, a safety is provided; the safety comprises a safety rod; and the safety rod has means, which are embodied to cooperate with counterpart means of one of the levers in such a way that to activate the safety, the means pivot a toggle lever arrangement of the hammer arrangement out of the released position through the dead point into the safety position and to deactivate the safety, pivot of the safety position through the dead point into the released position.

In one embodiment of the invention, the lock has a hammer arrangement, which has a hammer and at least one hammer actuating lever arm; the hammer is pivotable around a rotation axle toward and away from a firing pin and at least one hammer actuating lever arm is linked to the hammer by means of a rotation axle; the rotation axle is positioned remote from the rotation axle on the hammer; and the hammer and hammer actuating lever arm form a toggle lever, which can be pivoted around the rotation axle to both sides of a dead point.

In another embodiment of the invention, the safety has two oblique surfaces, which have an inclination oriented in the same direction, and the means on the hammer arrangement is a laterally protruding pin so that by means of the pin sliding along an oblique surface, the hammer arrangement moves through the dead point into the safety position and when the safety rod is moved into the firing position, the oblique surface moves the pin and thus the hammer arrangement out of the safety position, through the dead point, and into the firing position or released position.

It is advantageously also possible that in the safety position, after being pivoted through the dead point, the pin rests against the flute bottom of a flute in the safety rod, which blocks the movement of the pin and thus of the hammer arrangement into the released position.

In one modification, a safety arrangement has a rotation inhibition means for a bolt of the firearm; the bolt has a locking pin and the safety rod has a catch, lug, or pocket, which, when the safety is activated, is placed around the safety pin or, in order to block a movement in a rotation direction, rests against the safety pin.

It is also advantageously possible that on the safety rod there is a safety transmission lever in order to transmit the movement of a safety slider, which is positioned on the underside of the weapon, to the safety rod on the top of the weapon; the safety transmission lever is positioned at a free end of the safety rod and on the underside of the weapon, is supported in articulating fashion on the safety slider; and the safety transmission lever is routed around the bolt and/or a cartridge chamber and/or other components or around the bolt travel path and is supported in articulating fashion on the safety slider.

Advantageously, the trigger transmission lever and the safety transmission lever can be embodied as C-shaped, ring-shaped, bracket-shaped, or question mark-shaped.

In one embodiment, the toggle lever arrangement is embodied by means of a hammer lever arm and a guide lever arm; the hammer lever arm is an elongated component, one end of which is connected to a hammer bar, and at its end the hammer lever arm is able to swivel around a rotation axle; the rotation axle cooperates with two cheeks, which are positioned at one end of the hammer bar and embrace the end between themselves, and passes through the end so that the hammer lever arm is able to rotate around the axle.

Advantageously, at a diametrically opposite end of the hammer lever arm, there is an angled hammer surface; spaced apart from the end and from the hammer surface toward the end, there is a guiding rotation shaft, which passes through the hammer lever arm so that the free end of the hammer lever arm, which protrudes beyond the shaft and has the hammer surface, forms the hammer.

It is also advantageous if the hammer lever arm with the guiding rotation shaft is supported in rotating fashion on the guide lever arm; the guide lever arm is a plate-like element with two side surfaces, a top, a bottom, a front end region, and a rear end region; and an accommodating slot for accommodating the hammer lever arm extends from the rear end region to the front end region over a partial length of the guide lever arm.

It is also advantageous if the hammer lever arm and the guide lever arm compose the toggle lever arrangement; the guide lever arm can be pivoted around laterally protruding shaft stubs and the hammer lever arm can be pivoted upward and downward around the shaft and the two are connected to each other by means of the shaft; the toggle lever arrangement composed of the hammer lever arm and the guide lever arm is acted on with spring force by means of the hammer bar and a mainspring positioned around it; and the guide lever arm is affixed to the chassis of a firearm by means of shaft stubs when the hammer lever arm and hammer bar, by means of a pivoting of the toggle lever arrangement, are able to move to a limited degree in a direction opposite from a direction of fire.

It is also advantageous if a recess is provided in the underside of the guide lever arm, extending from the front side; the recess is embodied so that it extends into the guide lever arm; the recess has a recess roof at the top; the recess roof has a front region and a rear region; and the front region and rear region are embodied so that the recess roof has a front recess roof region and a rear recess roof region, which are embodied as inclined relative to each other at an angle, in particular at an angle of 25° to 50°.

In one embodiment, it is advantageous if a safety rod is provided for pivoting the guide lever arm and for activating and deactivating the safety; at one end, the safety rod has a control bead; and the bead is embodied so that it cooperates with the recess and the recess roof in a corresponding fashion.

It can also be advantageous if the toggle lever arrangement composed of the hammer lever arms and guide lever arms is in an activated-safety position when the shaft is positioned above the shaft stubs and is in a deactivated-safety, ready-to-fire position when the shaft or its rotation axis is positioned below the shaft stubs or their rotation axis, and is in a fired position when the rotation shaft or guiding rotation shaft is positioned partially below or entirely below the shaft stubs as a result of which, the hammer bar is positioned the farthest forward in the direction of fire.

According to the invention, the firearm also has a bolt that is embodied as a rotating bolt head action and corresponding engagement means are provided between a bolt head and a bolt head recess, which can for example be a barrel extension or the barrel just in front of the cartridge chamber.

As the corresponding engagement means, threaded sections are provided, which have a pitch or no pitch and are positioned one after another in comb-like fashion.

According to the invention, the bolt thread is embodied as a so-called buttress thread. In conventional buttress threads one flank of the thread is embodied as cross-sectionally inclined while the second flank of the same thread is cross-sectionally oriented radially.

By contrast with the conventional embodiment of a buttress thread, the bolt thread according to the invention is embodied as a buttress thread in which both flanks of the thread are cross-sectionally inclined in the same direction, but in a sharp thread, one of the thread flanks is more steeply inclined than the other.

Particularly in a sharp thread, the front flank relative to the direction of fire is more steeply inclined than the rear flank relative to the direction of fire.

Because of the inclination of the rear flank, with a commensurate embodiment of the corresponding internal thread of the barrel or of the barrel extension in the locked state, when a force is introduced axially onto the bolt in a direction opposite from the direction of fire, the thread or the two thread segments is pulled into each other by the cooperation and thus reinforces the blocking action.

According to the invention, the buttress thread or buttress thread segments of the breech in this case can be embodied as a sharp thread or trapezoidal thread.

The bolt head on the one hand and the barrel or barrel extension serving as a bolt receiver on the other can be embodied with two, three, or more thread segments and a corresponding number of smooth regions or recessed regions.

According to the invention, the part, which through an axial motion causes a rotation of the bolt head exerts a spring force relative to a part, which does not execute any axial motion relative to the bolt head, in such a way that the bolt head is held by the spring force in the locked state and the bolt head rotation into a bolt head recess is carried out with spring assistance.

In this connection, it is advantageous that a particularly easy, gentle repeating process can be carried out.

For example, the invention contemplates developing a breech for a firearm and among other things, to combine a threaded breech with the features of a conventional rotating bolt action or rotating bolt head action so that a simple loading, firing, and unloading of the gun or firearm is possible with a maximized safety of this breech system. Basically, the invention enables an operative connection between the breech and the barrel directly or between the breech and a barrel extension containing the barrel and thus with the barrel indirectly.

The provision of a bolt carrier and a bolt body, which is supported in a sliding and axially spring-loaded fashion thereon, as well as locking mechanisms between the bolt body and bolt head and bolt head shaft makes it possible to ensure a particularly reliable function.

According to the invention, in order to increase the variability of a firearm when it comes to the choice of caliber, both for the buyer and also in terms of the manufacture, a barrel extension is used in which the barrel is screwed into the essentially cylindrical barrel extension in a direction opposite from the direction of fire, with an axial immobilization being possible by means of an axial end of the receiving thread after which the inner diameter of the barrel extension is preferably smaller so that the threaded end uniquely defines the position of the barrel in the barrel extension.

In addition, as a bolt receiver in a cylindrical region between the inner barrel receptacle and the receptacle for the bolt action that is oriented away from it in the direction of fire, the barrel extension preferably has at least one radial projection serving as a radial bolt tongue, more preferably two or more bolt tongues arranged axially in series, for example with an arc length of 180° relative to the circumference of the barrel extension, with which the barrel and barrel extension can be inserted in the direction of fire into a recess or into a corresponding groove or grooves of a firearm and can be immobilized there through rotation. To accomplish this, when the barrel and barrel extension are inserted into the recess from the rear, after reaching the stop, the barrel extension is rotated by 180° into the corresponding bolt grooves in the recess.

As is customary with rotating bolts, with the bolt according to the invention, in order for the bolt to be inserted until reaching a position in which it can be rotated and thus locked, it is also necessary for there to be engaging elements that alternate with regions in which there are no engaging elements.

Since according to the invention, it is a threaded breech, it is thus necessary for there to be threaded regions that alternate with unthreaded regions. For example, there can be two diametrically opposed threaded regions and correspondingly, two smooth regions 90° offset from them. This means that in the regions in which no thread is present, i.e. the smooth regions, the bolt head there does not protrude beyond the minimum diameter of the thread at the tooth base.

When there are three or more locking regions, i.e. threaded regions, with a symmetrical arrangement, the angular offset between the threaded regions and the smooth regions is likewise always the same; thus an angle of 60° or correspondingly smaller is always maintained between the threaded regions and the smooth regions.

This then also constitutes the so-called opening angle of the breech since a rotation of the bolt by 60° in the screw-in direction of the thread until the stop is reached results in a locking and the corresponding rotation counter to the screw-in direction results in an unlocking.

In the unlocked range, the smooth regions of the bolt head are positioned between two respective adjacent threaded regions in the region of the corresponding thread of the bolt receiver and in this region, can be moved axially back and forth without coming into engagement. The threaded regions of the bolt head in this case are positioned in the smooth regions of the bolt receiver so that here, too, an axial motion is permitted.

If the bolt head is in in the position in which it is slid the farthest forward, then by means of a clockwise rotation of the bolt head, the threads of both the bolt head and the bolt receiver, which correspond to each other, can be brought into engagement until the threads of the bolt head and the bolt receiver and thus the teeth of the threads have been screwed all the way into each other.

Preferably, at least one stop surface is respectively embodied in the bolt receiver on the one hand and on the rotating bolt head on the other and these surfaces form a stop when the threads have been screwed all the way into each other, thus blocking an overtightening and thus an unscrewing of the thread in the clockwise direction.

The above-mentioned embodiments naturally also apply analogously to other possible engagement means.

Consequently, the invention relates to a firearm with a breech system, having a bolt receiver and a bolt, the bolt receiver being in the form of a hollow cylinder with at least one first engagement means protruding radially inward and at least one slot, the slot being positioned axially adjacent to the first engagement means and to a bolt head, and the bolt head having at least one protruding second engagement means and an adjacent axial flute; the first engagement means of the bolt receiver and the second engagement means of the bolt head are correspondingly embodied as being able to engage with each other; the corresponding first and second engagement means are embodied as receiving and bolt thread segments, respectively, with or without a pitch, the respective thread segments each having at least one thread comb; and a rear flank of the at least one thread comb of the bolt head is inclined away from the direction of fire and a corresponding rear flank of the at least one thread comb of the bolt receiver is inclined in the direction of fire.

Advantageously, the thread combs are embodied as sharp thread combs or trapezoidal thread combs with inclined front flanks and inclined rear flanks.

In one embodiment, the front flanks and rear flanks can have different inclinations.

In addition, the thread segments can have a pitch and a pitch of each thread comb is the same as the pitch of each respective thread segment.

It is also advantageous if the bolt head is supported in rotary fashion on a bolt carrier and there is also a bolt body, which is able to slide on a bolt head shaft of the bolt head, and between the bolt body and the bolt carrier, there is at least one compression spring, which tends to move the bolt body in the direction toward the bolt head; on the bolt head shaft and on the bolt body, there are means that produce a rotation of the bolt head when the bolt body is slid on the bolt head shaft.

In another advantageous embodiment, the bolt receiver has a plurality of cylinder segments, each with a respective receiver thread segment having at least one thread comb and between the cylinder segments, there are slots; and the slots are positioned in a circumferential wall of the bolt receiver from a radial inside to a radial outside and extend into the circumferential wall at least to a bottom of each thread comb or extend all the way through the cylindrical circumference wall.

It can also be advantageous if a plurality of thread segments with respective thread combs are embodied on the bolt head; and adjacent to the bolt thread segments, there are flutes, which at least reach the depth of bottoms of the thread combs so that the flutes interrupt a thread helix of the thread combs.

It can also be advantageous if a radial width of the slots corresponds to a radial width of the thread segments and a radial width of the flutes of the bolt head corresponds to a radial width of the cylinder segments.

In the breech system according to the invention, the bolt can also have the bolt head, a bolt head shaft adjoining the bolt head and extending axially in a direction away from a direction of fire, and a bolt body positioned around the bolt head shaft, the bolt body being supported in a rotationally fixed way so that it is able to slide axially in a firearm and located, between the bolt body and bolt head shaft, a control slide comprising a control recess and a control pin is provided, which supports the bolt head shaft so that it is able to rotate to a limited degree in the bolt body.

It is also advantageous if the bolt head has at least one thread comb, which is embodied so that it extends from a bolt thread segment into the flute and spans the flute and has an axial free end that forms a stop surface for a corresponding stop surface of a cylinder segment so that when the thread comb fully engages in the thread comb, a further screwing of the thread comb into the thread comb and a further screwing of the bolt thread segment into the receiver thread segment or cylinder segment is blocked.

With the invention, the bolt receiver is advantageously embodied in a barrel extension; the barrel extension is embodied to receive the barrel of a firearm; in addition to a bolt-locking region for receiving the bolt and the bolt head of the bolt, the barrel extension has a locking region; and in the locking region, there is at least one ring segment-like protrusion, which is embodied to cooperate with a corresponding groove in a sleeve or chassis of a firearm.

According to the invention, the bolt head shaft and the bolt body are advantageously supported on the bolt carrier; the bolt head shaft being supported on the bolt carrier in a rotatable, but axially fixed way, while the bolt body is supported on the bolt carrier in an axially sliding, but rotationally fixed way.

In one embodiment, the bolt carrier is a bolt carrier plate and protruding from it in a same direction, first and second bolt carrier longitudinal arms and, protruding from the first and second carrier arms, respective first and second ejector arms; wherein the bolt carrier plate is a flat, plate-like component, which, in relation to a longitudinal span of the bolt head shaft and a direction of fire, is embodied standing upright and has a generally rectangular cross-section; and between narrow side edges of a lower edge of the bolt carrier plate, there is a support opening for the bolt head shaft so that by means of a groove and tongue engagement, the bolt head shaft is supported on the bolt carrier plate in a rotatable but axially fixed way.

In one embodiment, the bolt body is a component with a generally T-shaped cross-section, with a first component region extending transversely and a second component region extending essentially upright; the first component region is embodied as plate-like, with a rear end wall, two longitudinal first side walls, and a front end wall; between the front and rear end walls and the first longitudinal side walls, there is a lower wall; the second component region extends downward from the middle of a lower wall with two second side walls that extend parallel to the first side walls; the second side walls are spaced apart from the first side walls in an essentially symmetrical fashion; between the second side walls, there is a bottom wall of the second component region; and in a longitudinal middle of the bottom wall is an aperture, which is embodied in a cylindrical bore extending coaxially around a longitudinal axis of the bolt body and the bolt head shaft.

In an advantageous modification, when the bolt body is inserted in the bolt carrier, a gap remains between the walls of the first and second bolt carrier longitudinal arms and the lower wall of the first component region of the bolt body; the bottom wall widens outward beyond the respective second side walls with tongue elements and corresponding grooves present in the bolt carrier plate and bolt carrier longitudinal arms; the projection of the tongue elements beyond the second side walls corresponds to a depth of the grooves so that the tongue elements are correspondingly embodied to be received in the grooves and form a tongue-and-groove system with which the bolt body is positioned in the bolt carrier in a longitudinally sliding fashion.

It is also advantageous if a breech system according to one of the preceding claims is characterized in that a locking lever is supported in an upper top surface of the bolt carrier; the locking lever is positioned so that it is tilted around a rotation axis into a slit in such a way that a catch projection, which is embodied at one end of the locking lever, reaches into a region of a bore for supporting the bolt head shaft and in this region of the bore, is able to pivot into and out of the bore; and the locking lever has an actuating lever, which is spring-loaded by the pressure of a spring in such a way that the catch projection is pivoted through the slit into the bore by means of spring pressure.

In this connection, it is also advantageous if first and second locking slits are provided in the bolt head shaft; the first and second locking slits are axial slits positioned in the surface of the bolt head shaft; the first and second locking slits are embodied so that they can correspond to the catch of the locking lever; the first and second locking slits are embodied as axially offset from each other and radially offset from each other; the second slit is farther away from the bolt head than the first slit is, but is positioned before the first slit in the rotation direction of the bolt; and the axial spacing of the slits corresponds to a depth to which the bolt threads are screwed into each other, while the radial spacing corresponds to an arc length that the bolt travels in a screwing-in direction through a complete screwing-in motion.

In an advantageous modification, the rotation of the bolt head is produced by means of an advancing motion of the bolt body; wherein the bolt body slides onto the bolt head shaft and a control pin, which rests in a control pin bore, slides along a control surface and forces the bolt head into a rotary motion, wherein in an initial position, the control pin rests in an axial recess in the control surface and with a forward motion, forces the rotation of the bolt head; and an inclined surface of the control surface is configured so that an angular offset between axial end regions of the control surface corresponds to an angular offset by which the bolt head (25) travels when it is completely screwed in.

With the invention, it is an advantage that through the cooperation of all of the components of the firearm, a firearm is achieved, which on the one hand, is particularly short and compact and on the other hand, is particularly safe, particularly precise, and has a bolt, which can withstand even very high gas pressures so that this modular firearm concept according to the invention makes it possible to embody this firearm in a flexible way from low calibers, through medium calibers, to very high calibers, even up to super-heavy calibers such as .50 BMG.

The invention will be explained by way of example based on the drawings.

In the drawings:

FIG. 1: shows a side view of a firearm according to the invention;

Figure 6:
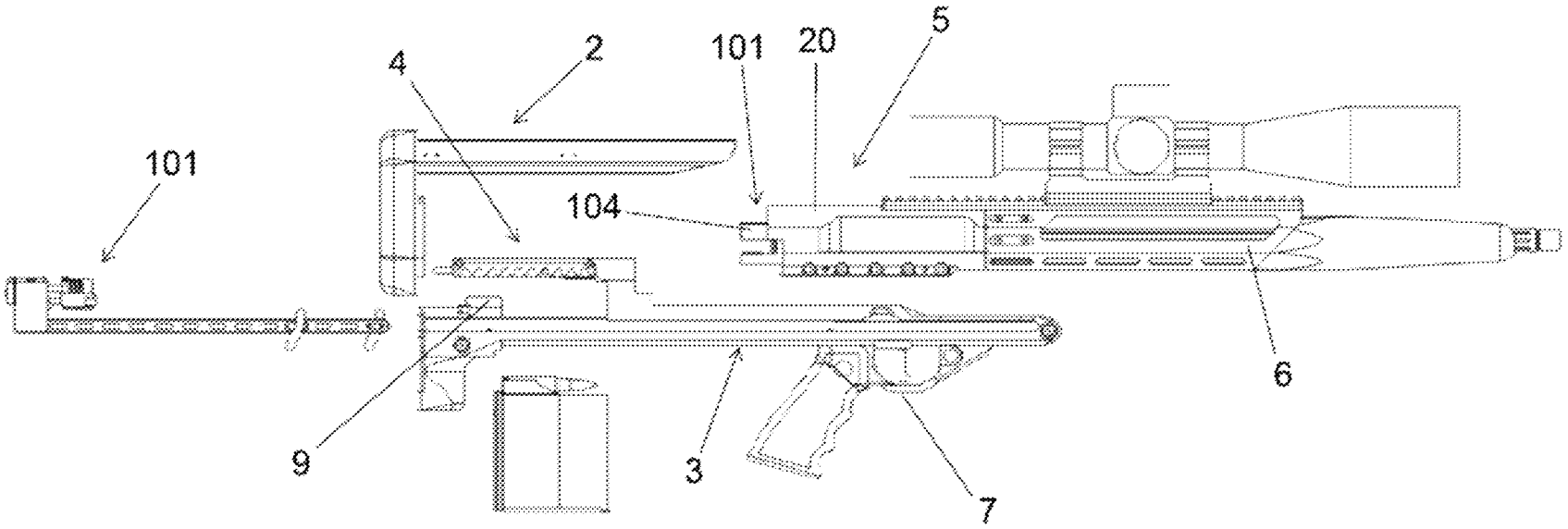
FIG. 6 shows the firearm according to FIG. 1 in a partially disassembled view.
Figure 7:
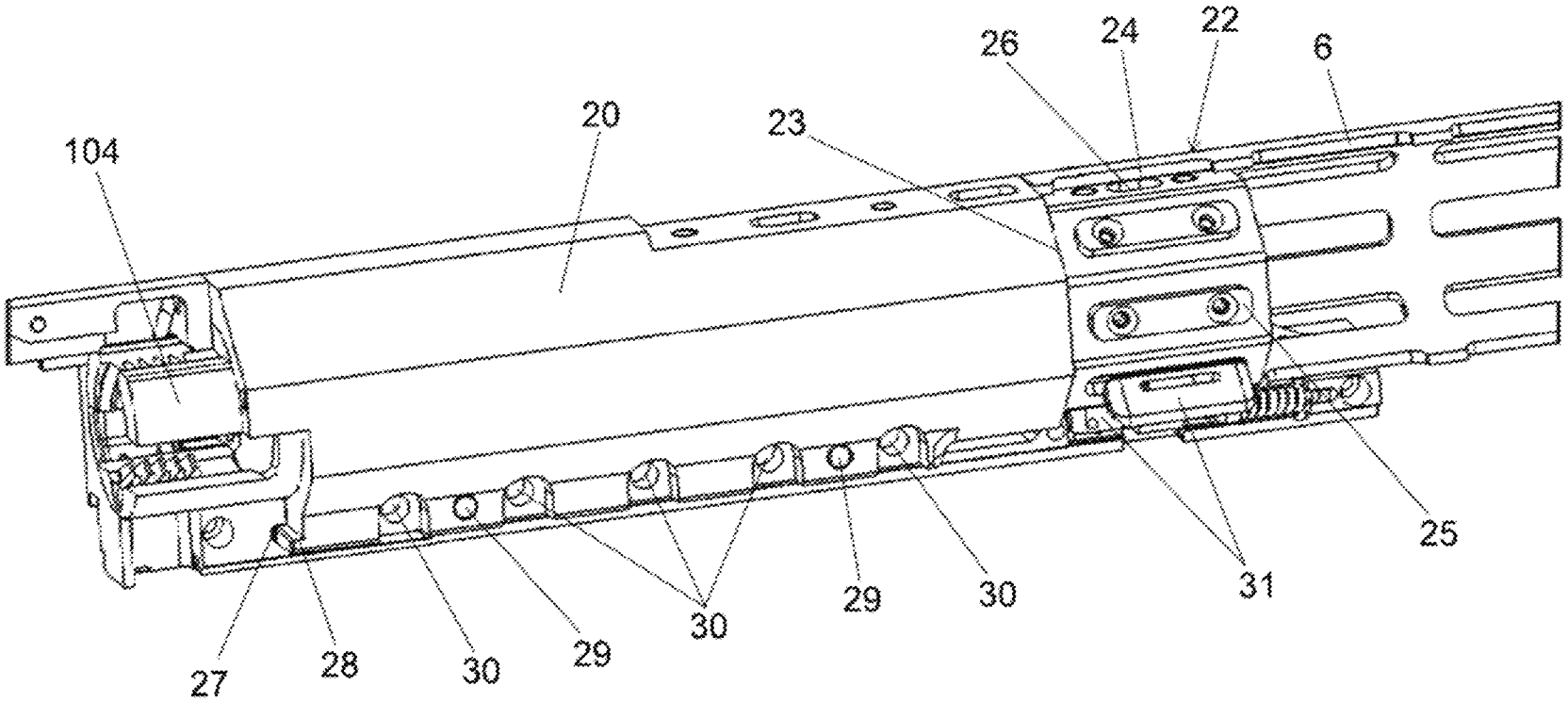
FIG. 7 shows a perspective view of a receiving sleeve of the firearm.
Figure 9:
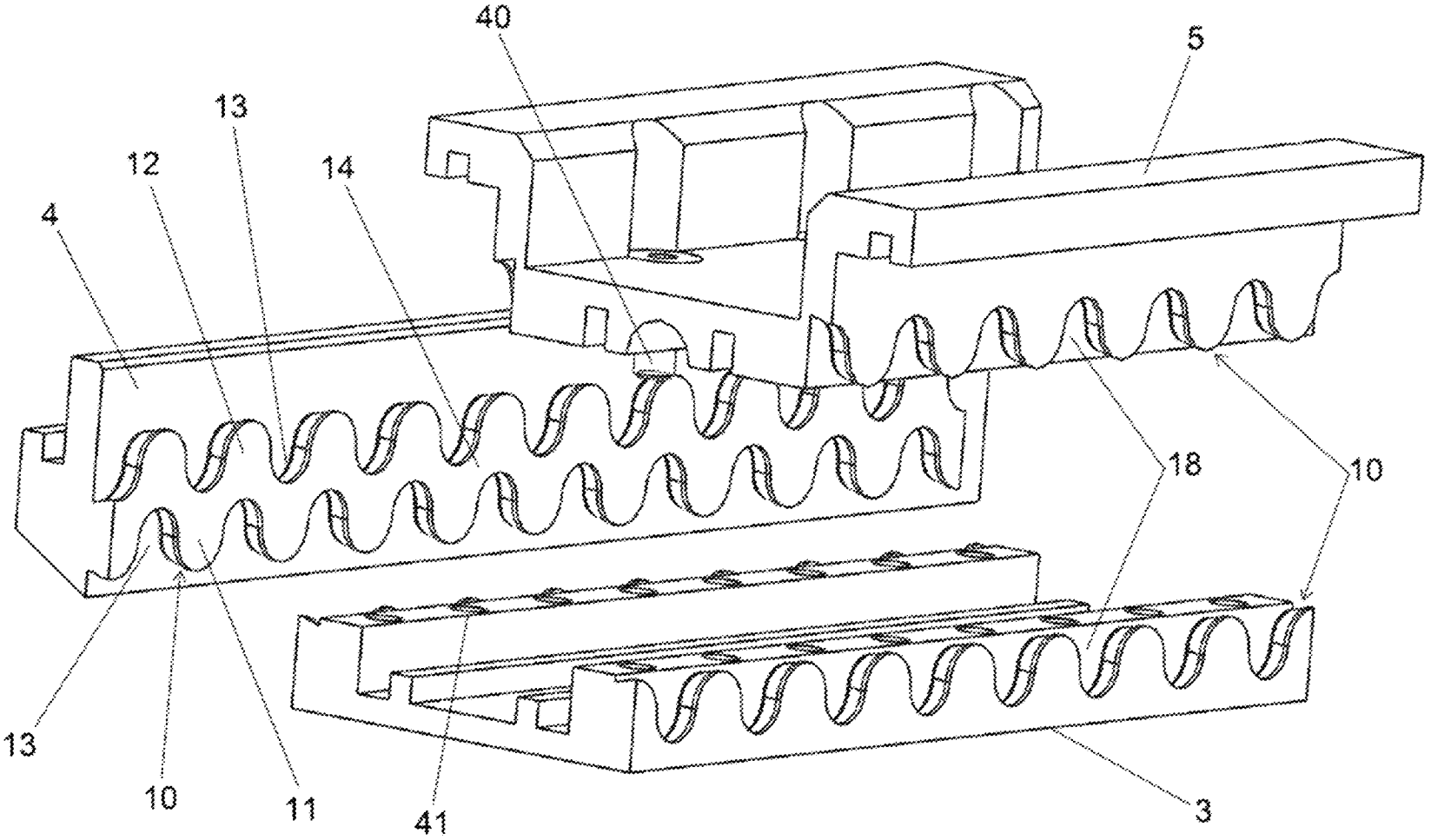
FIG. 9 shows a very schematic perspective view of the length adjustment of the firearm according to the invention.
Figure 10:
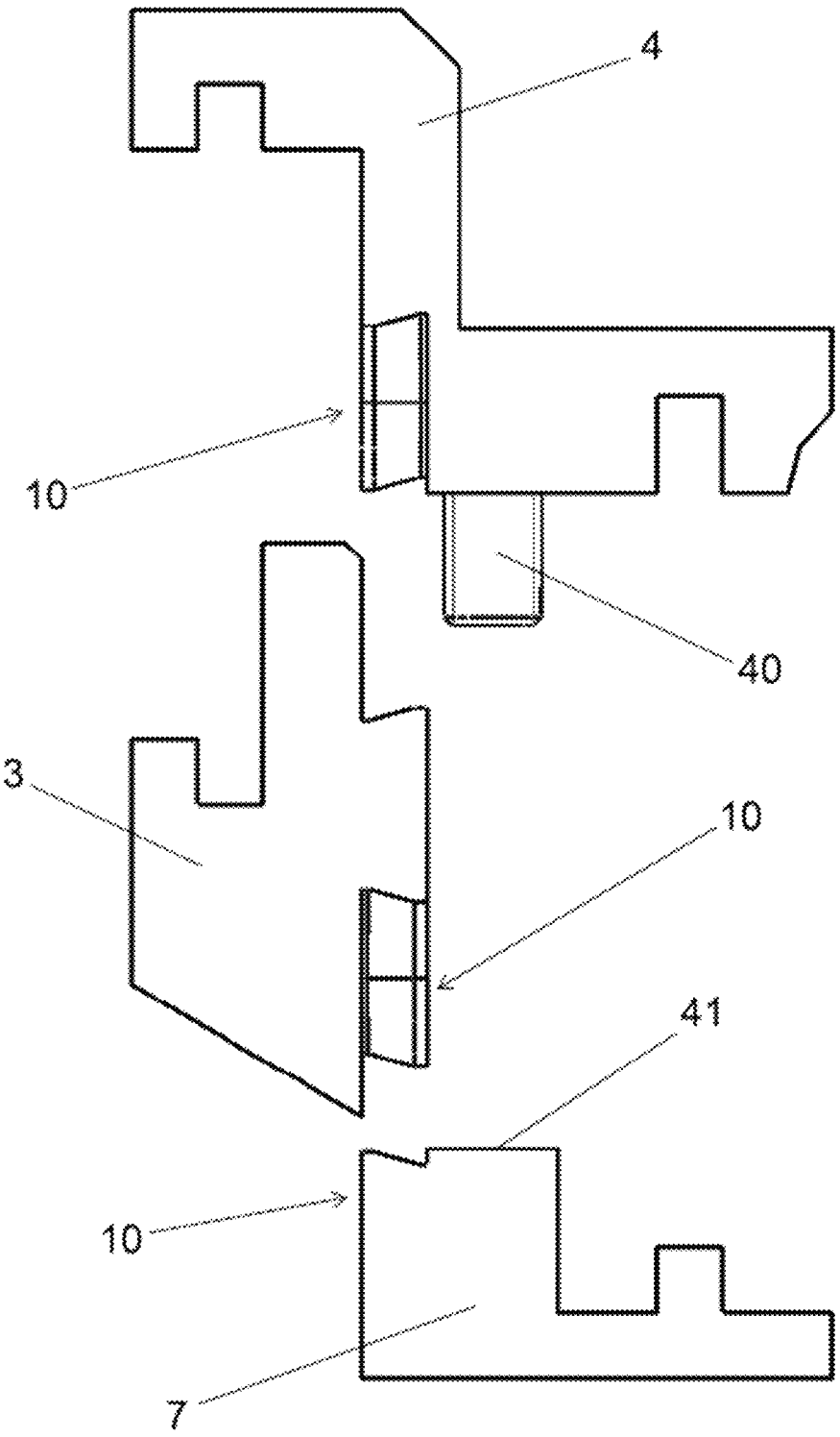
FIG. 10 shows a cross-sectional view of the length adjustment according to FIG. 9.
Figure 13:
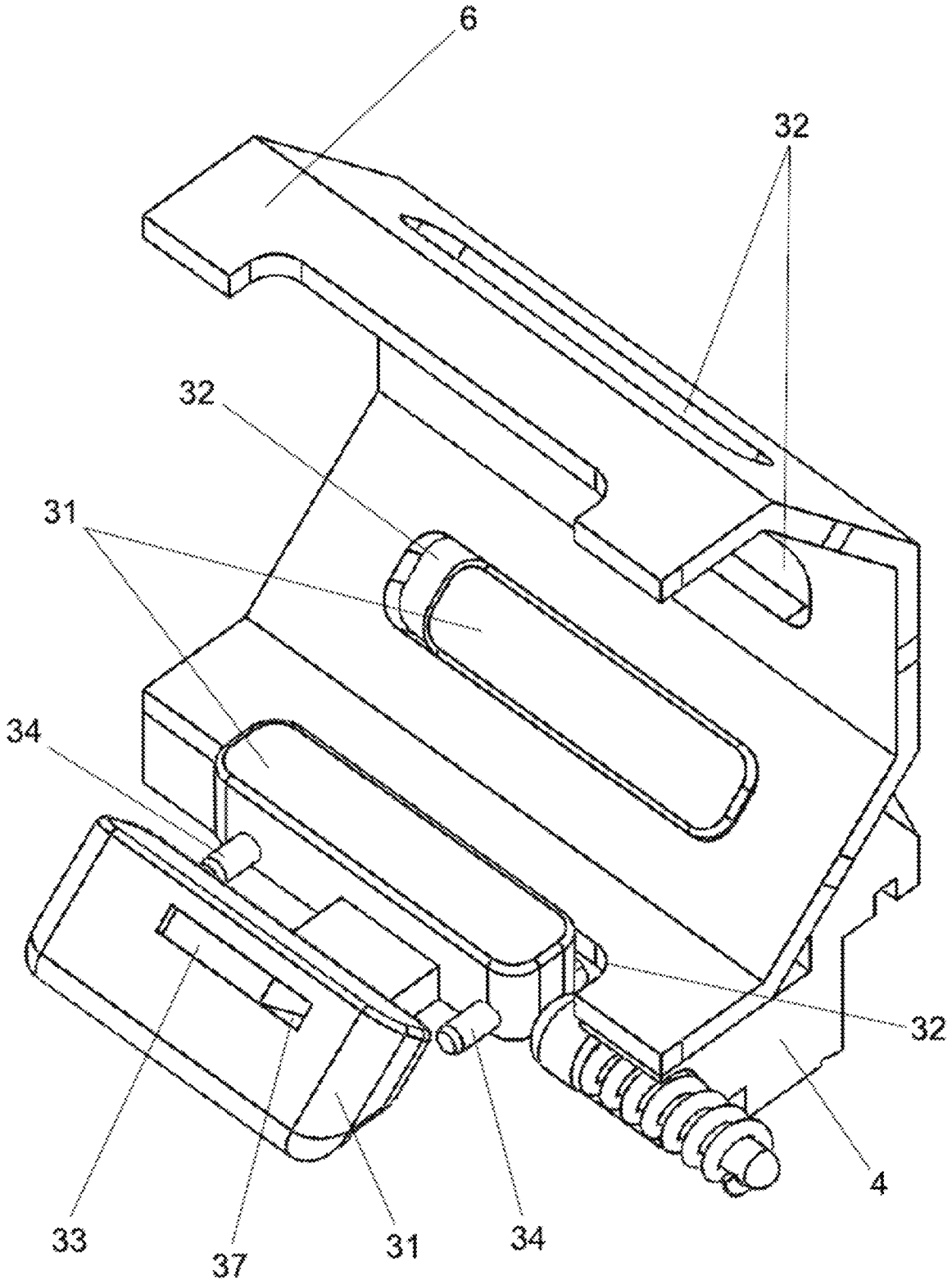
FIG. 13 shows a perspective, partially sectional view of a detachable fastening device for the hand guard and mounting device and the receiving sleeve.
Figure 14:
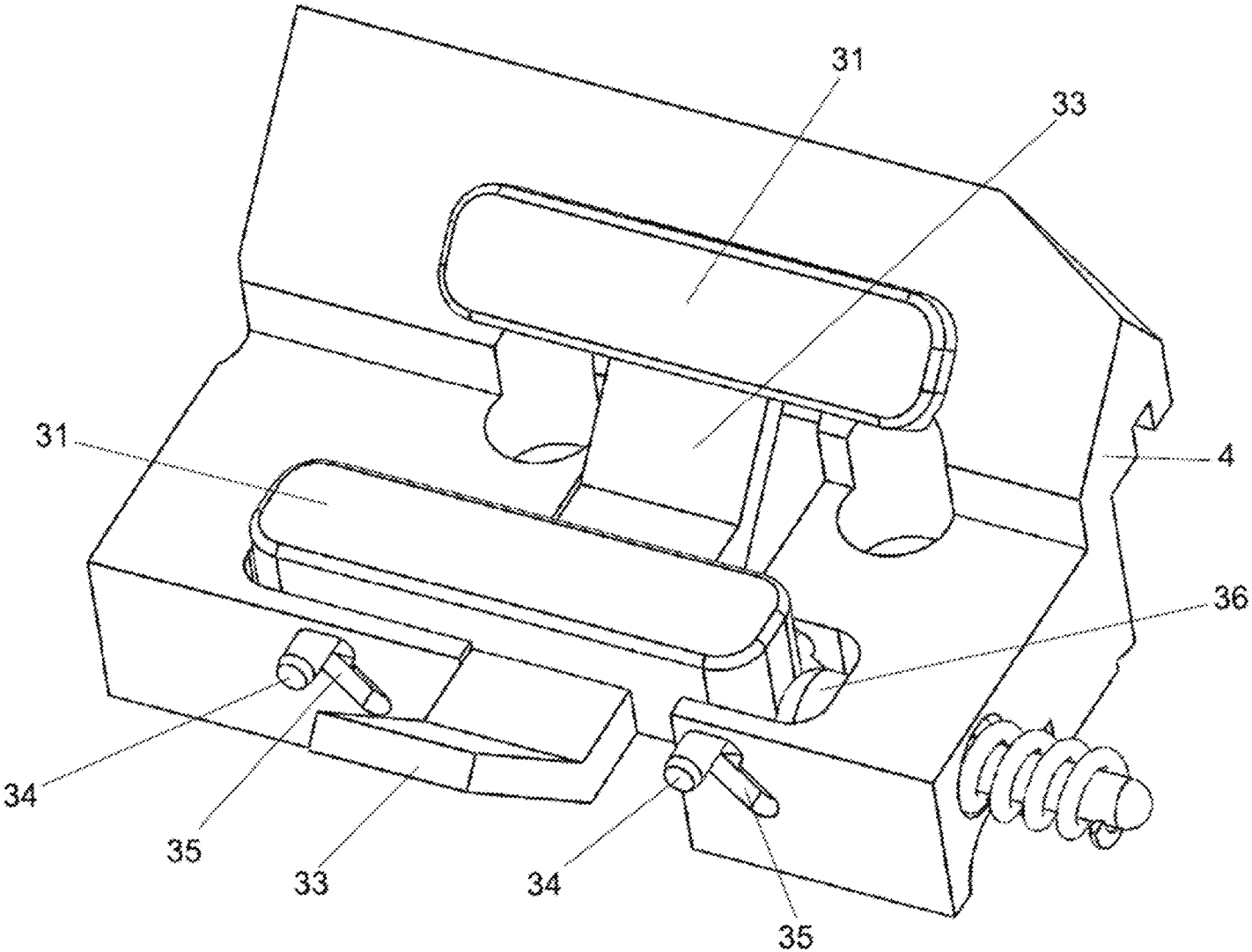
FIG. 14 shows another perspective view of the device according to FIG. 13.
Figure 16:
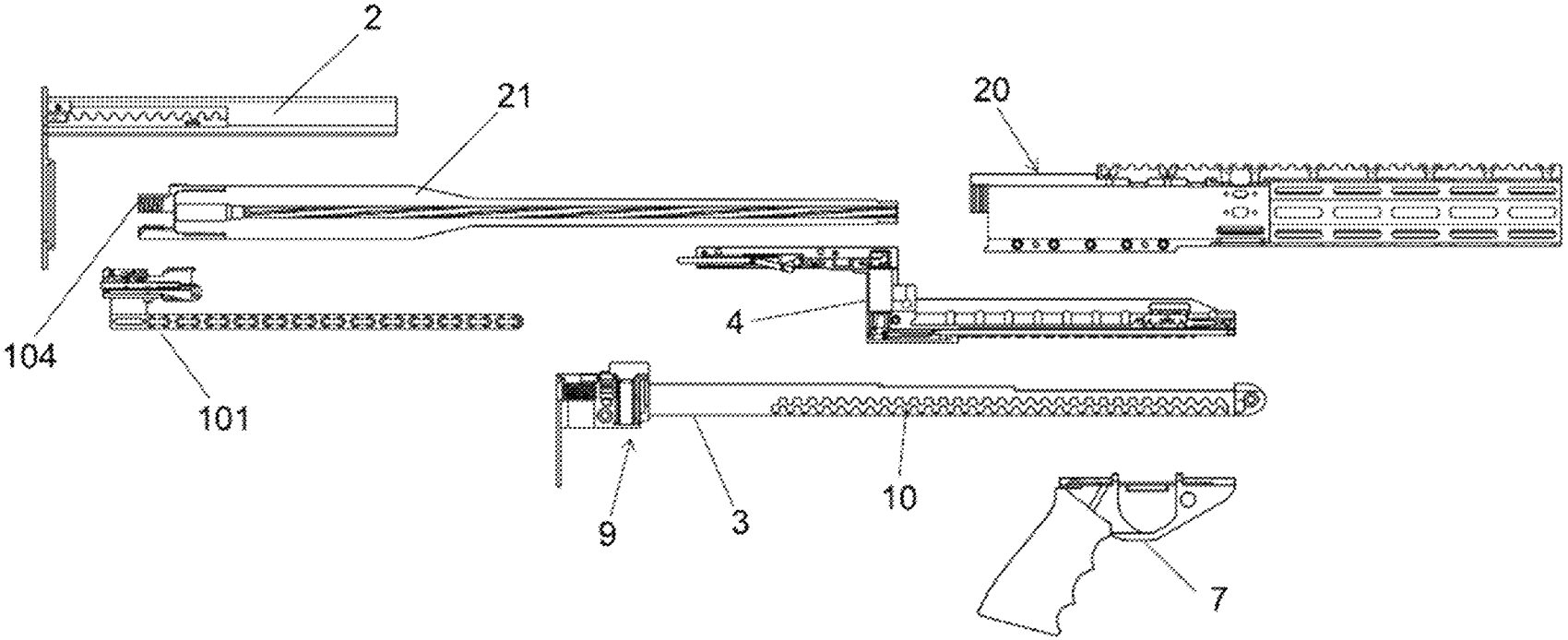
FIG. 16 shows a partially sectional view according to FIG. 15.
Figure 17:
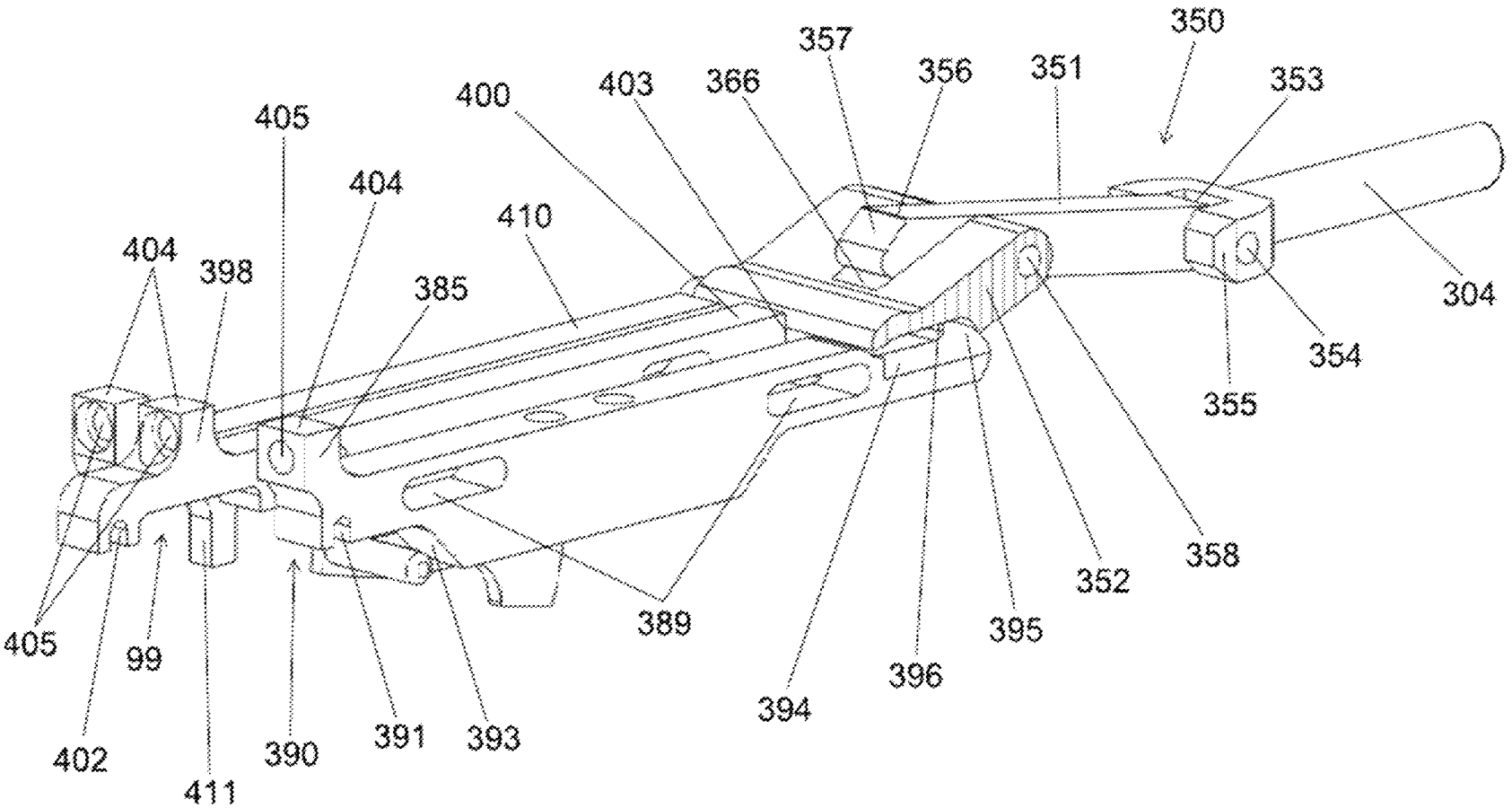
FIG. 17 shows the embodiment according to FIG. 5 in an activated-safety position.
Figure 18:
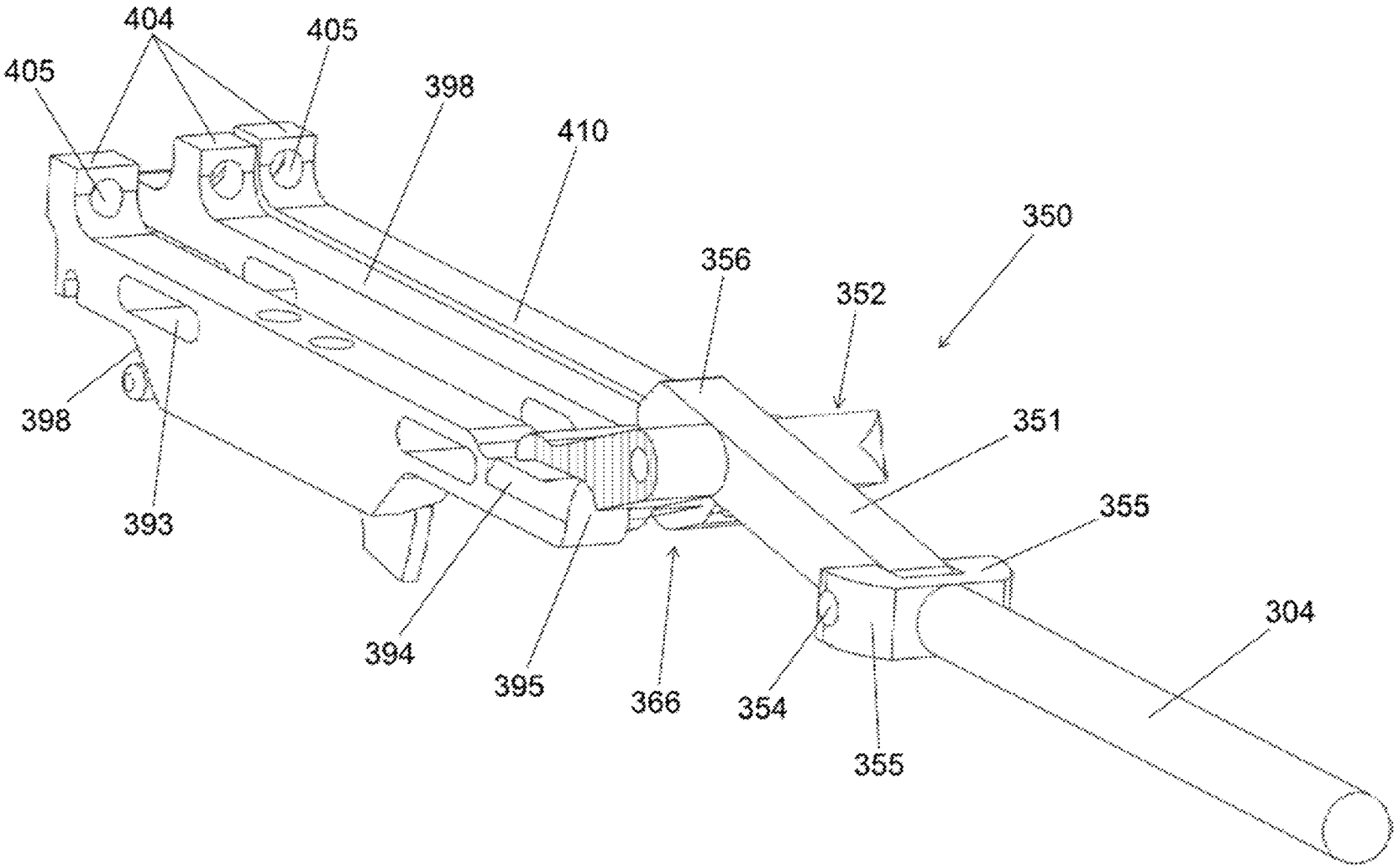
FIG. 18 shows the embodiment according to FIG. 6 in a perspective view.
Figure 19:
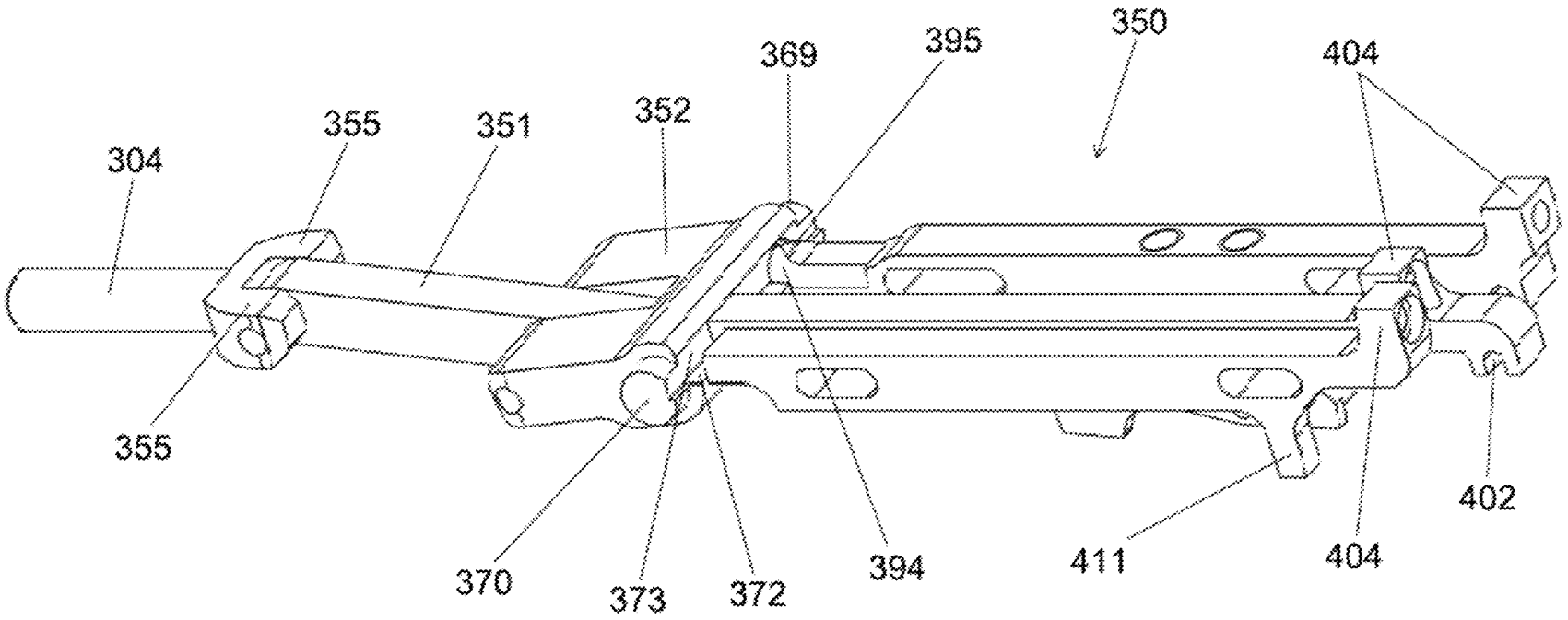
FIG. 19 shows the embodiment according to FIG. 8 in a perspective view from the diagonally opposite direction.
Figure 21:
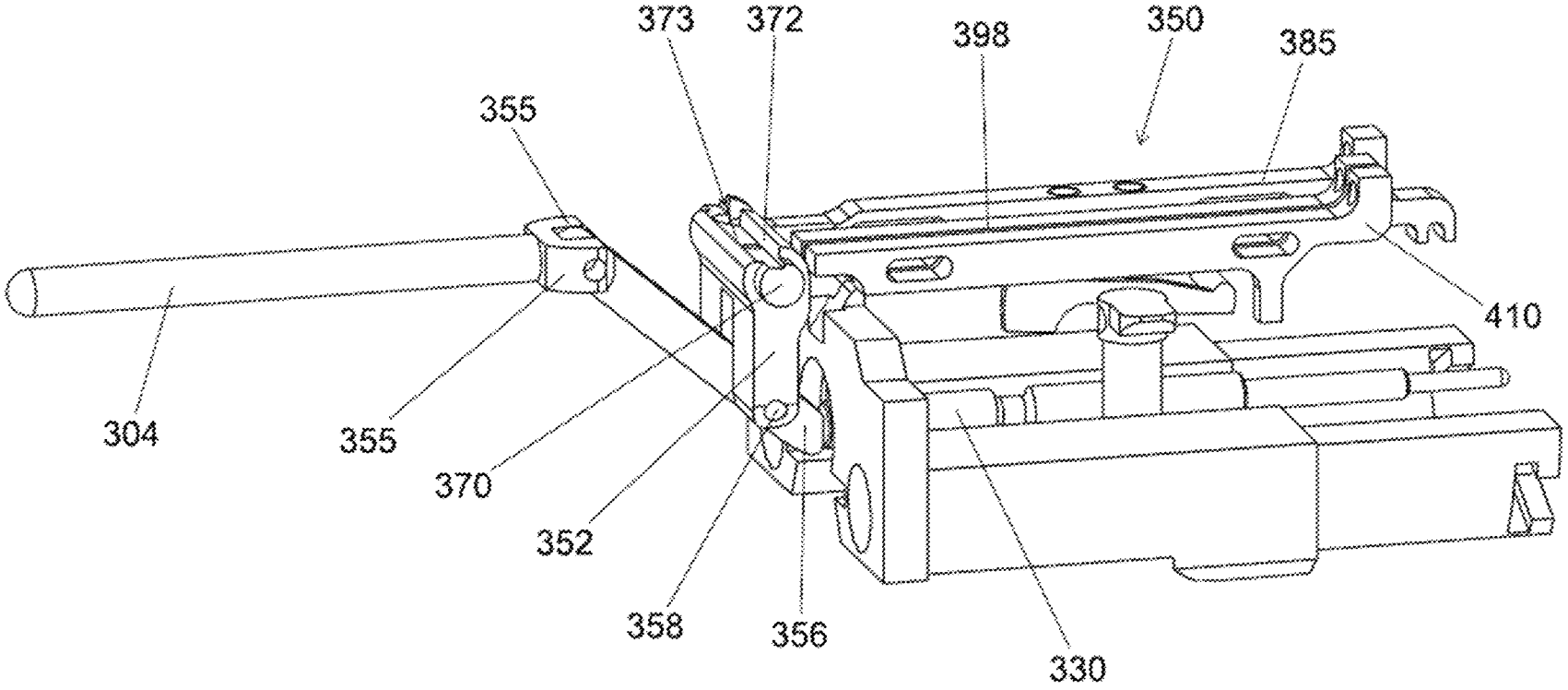
FIG. 21 shows the embodiment according to FIG. 12 in a view showing additional parts of the bolt in which the firing pin is supported.
Figure 22:
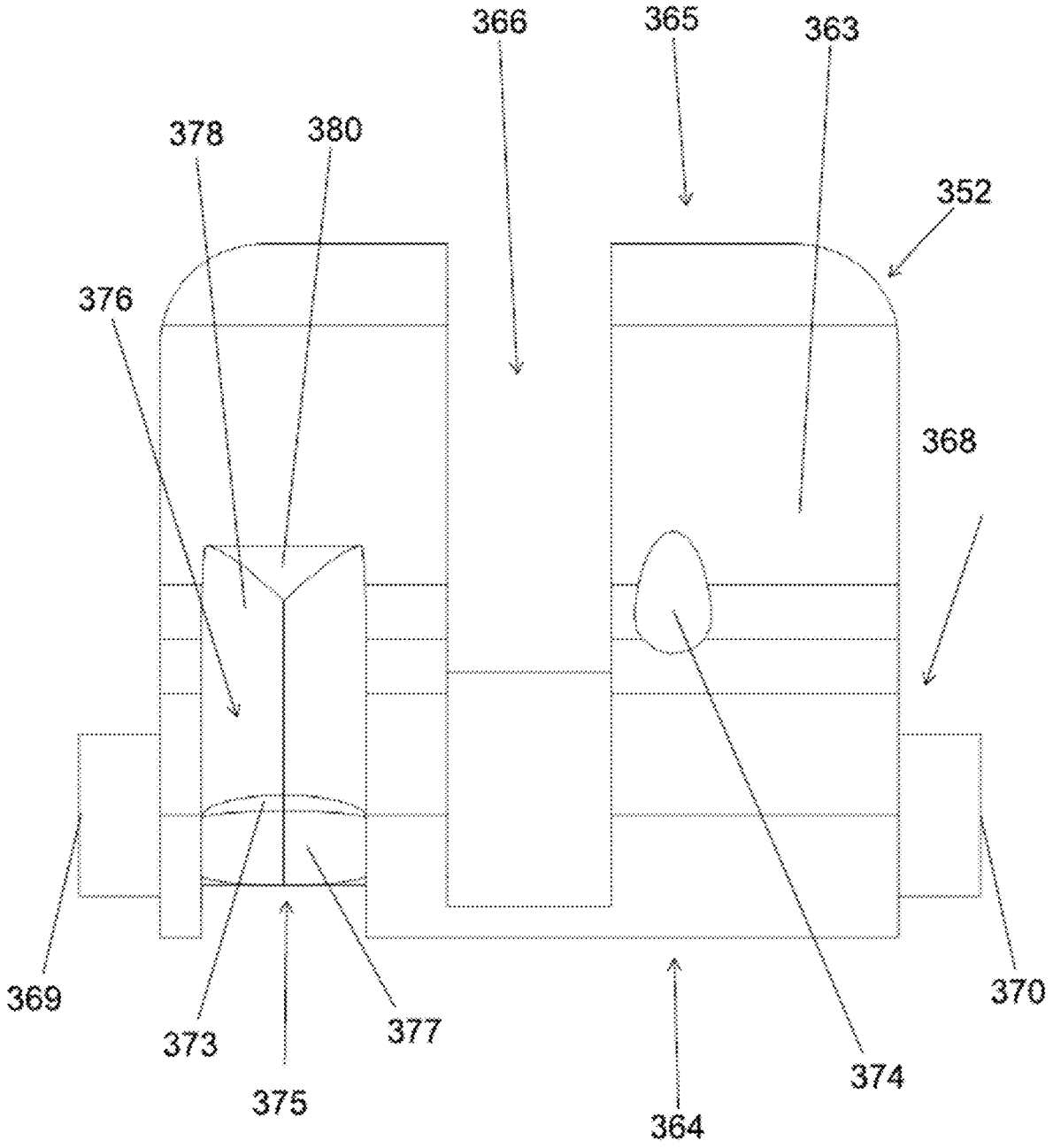
FIG. 22 shows the safety/guide lever of the embodiment according to FIG. 5 in a view from beneath.
Figure 23:
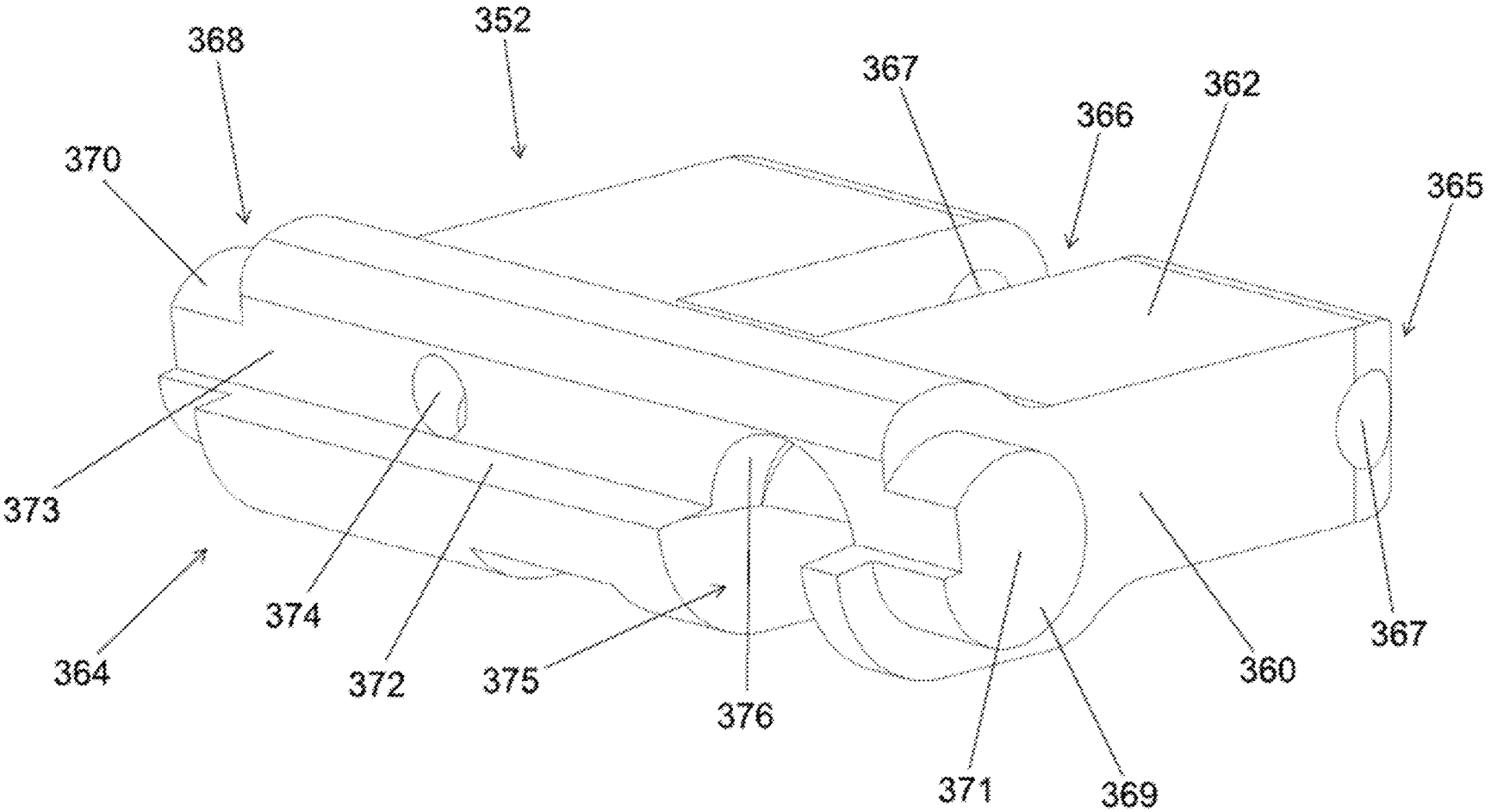
FIG. 23 shows the safety/guide lever of the embodiment according to FIG. 5 in a perspective view.
Figure 24:
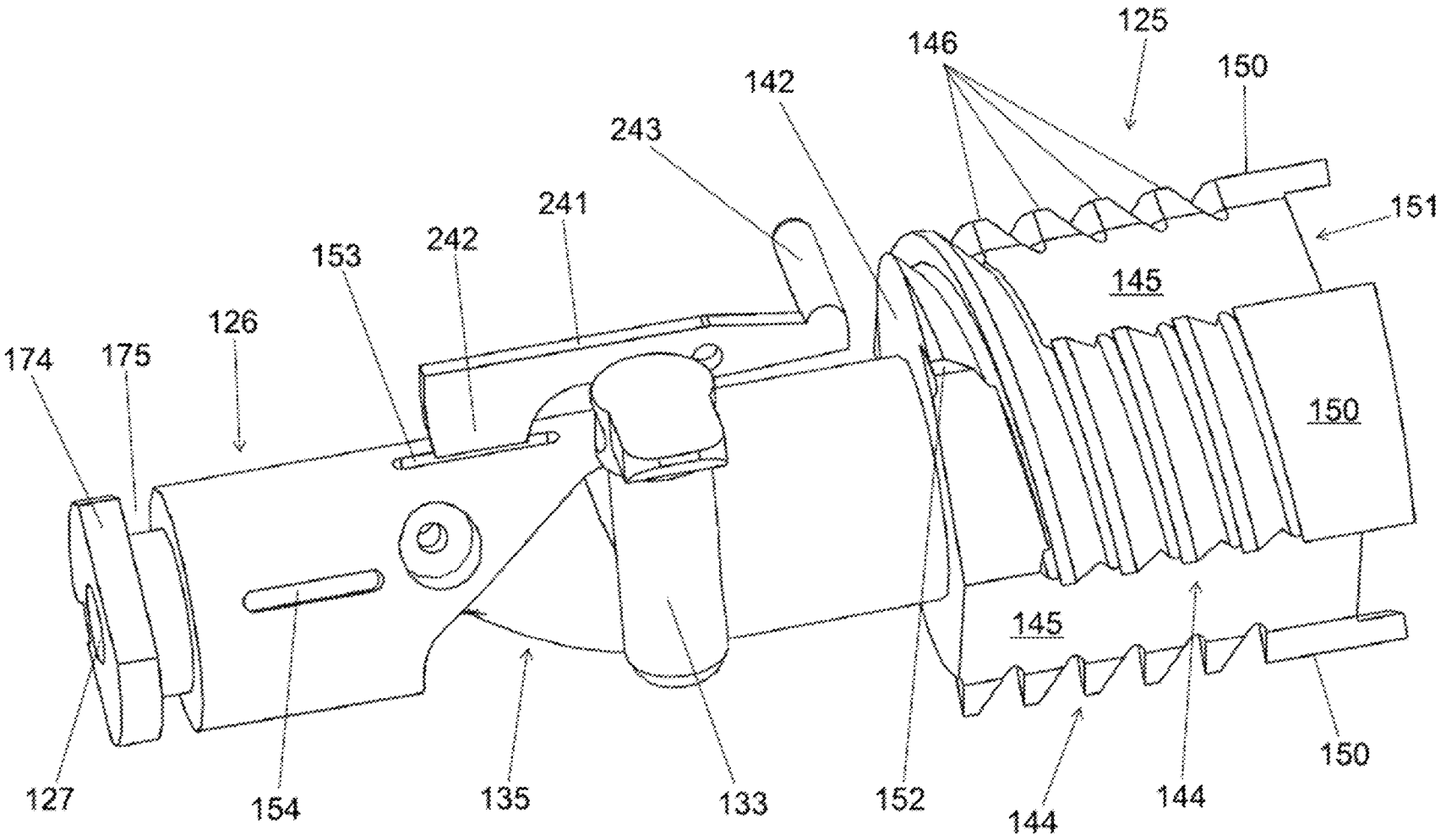
Figure 25:
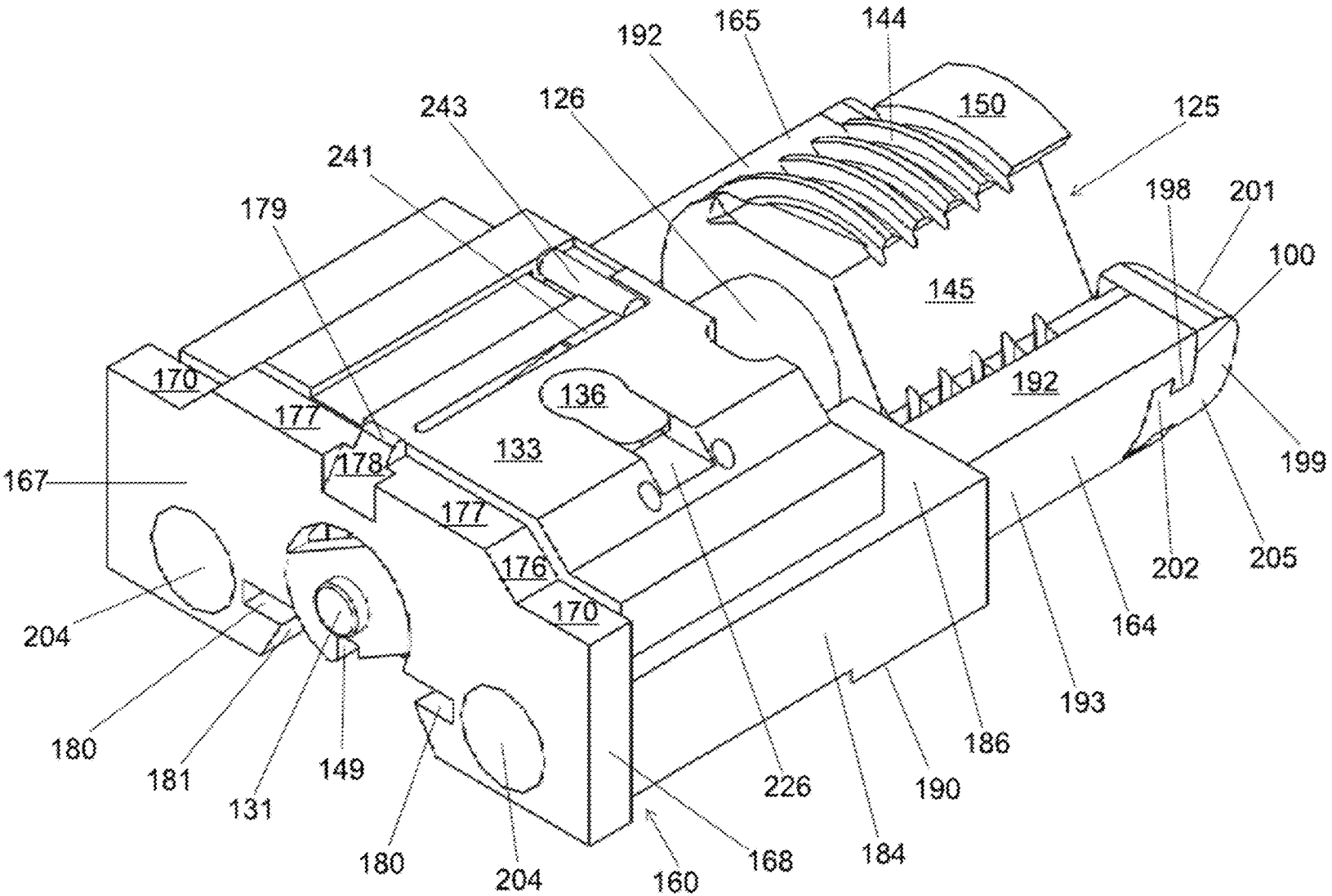
Figure 26:
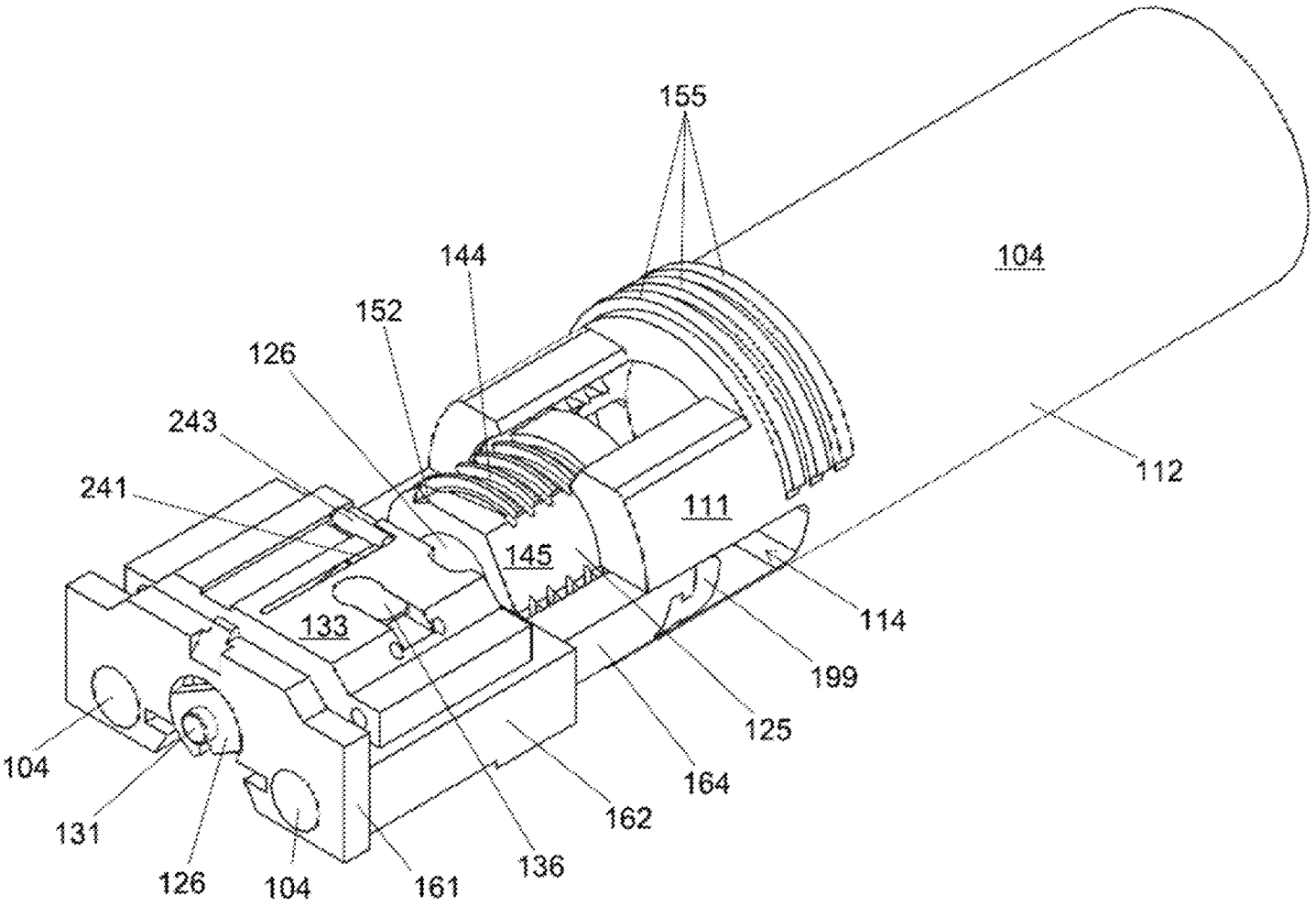
Figure 27:
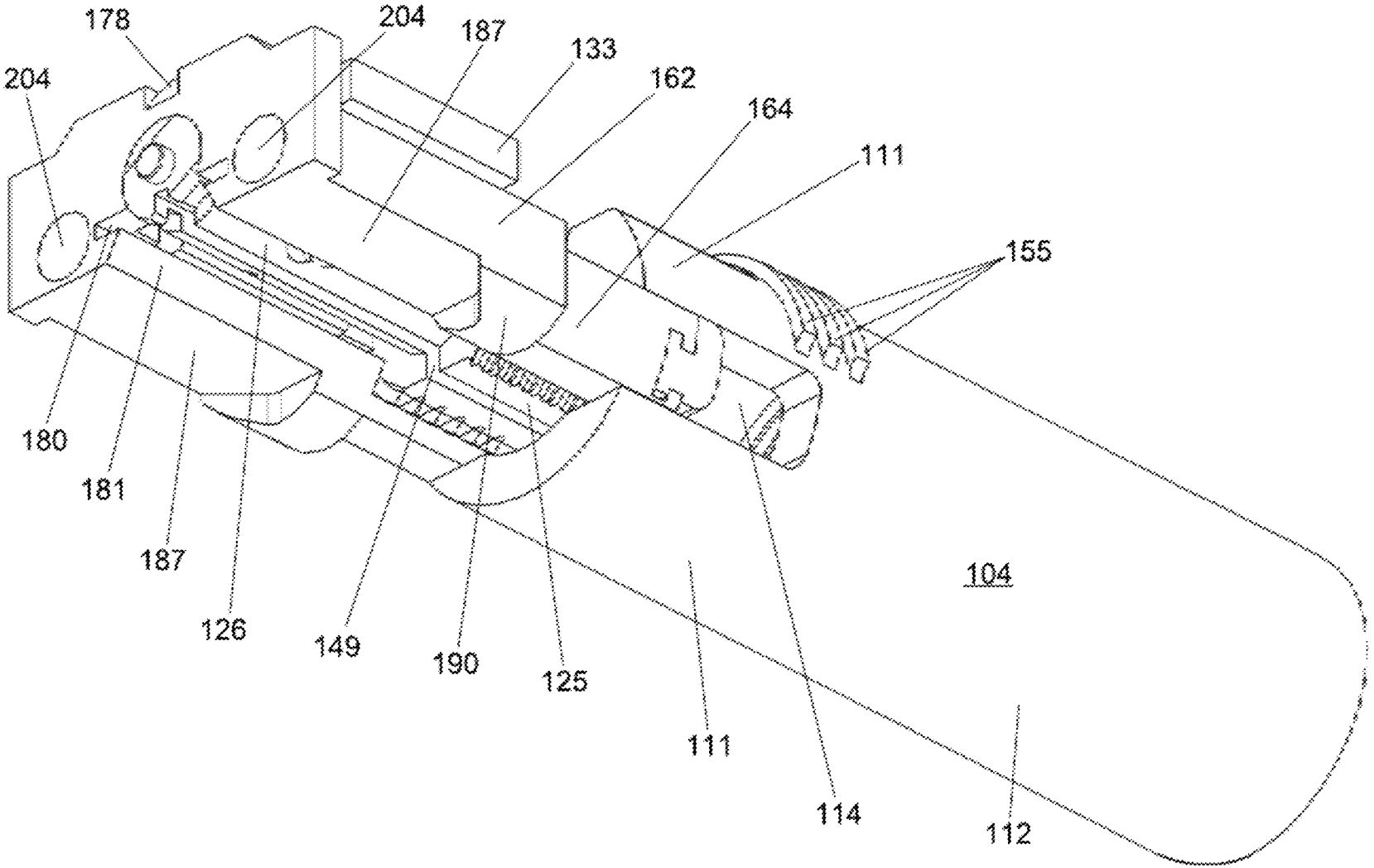
Figure 28:
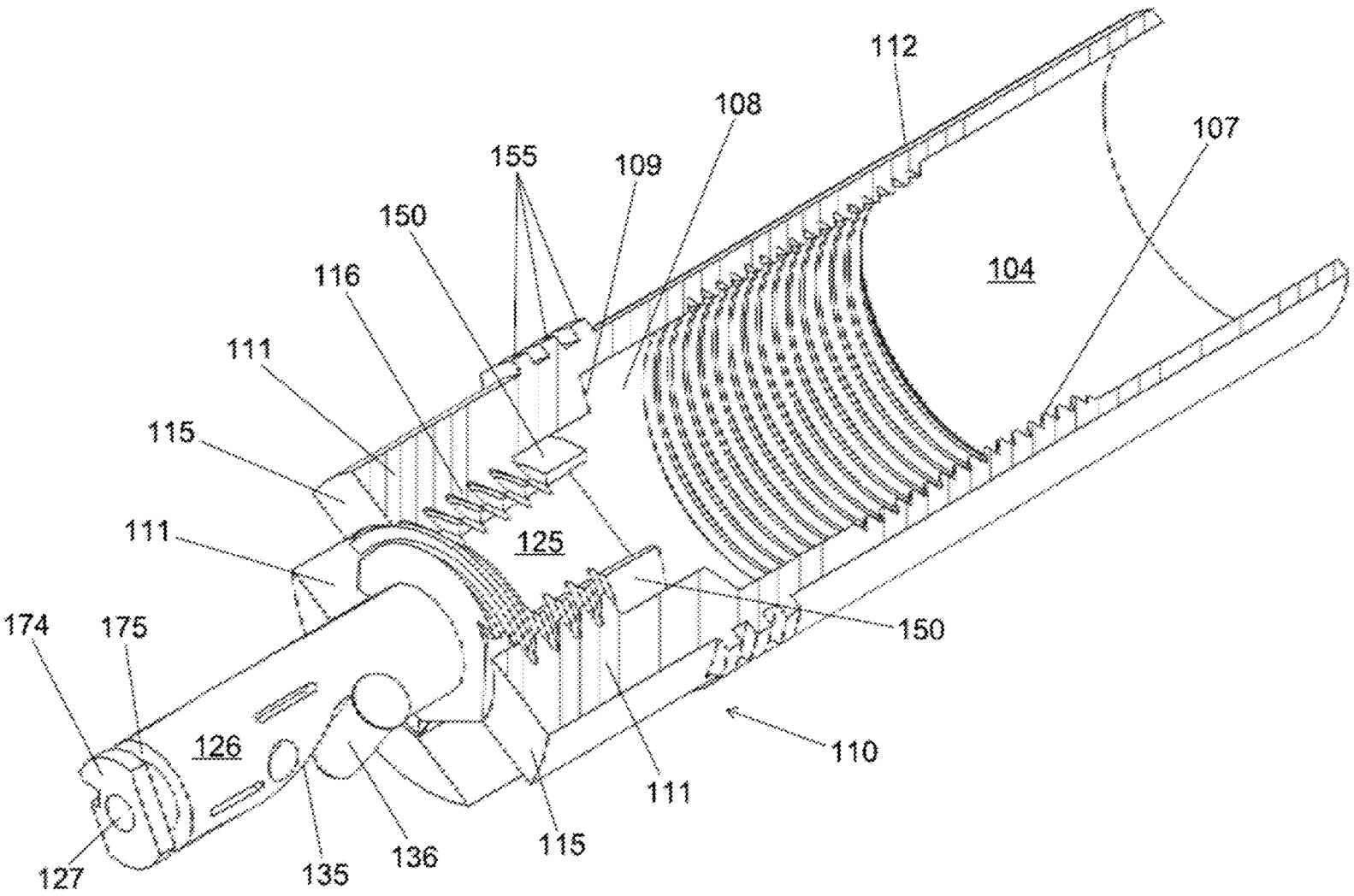
Figure 29:
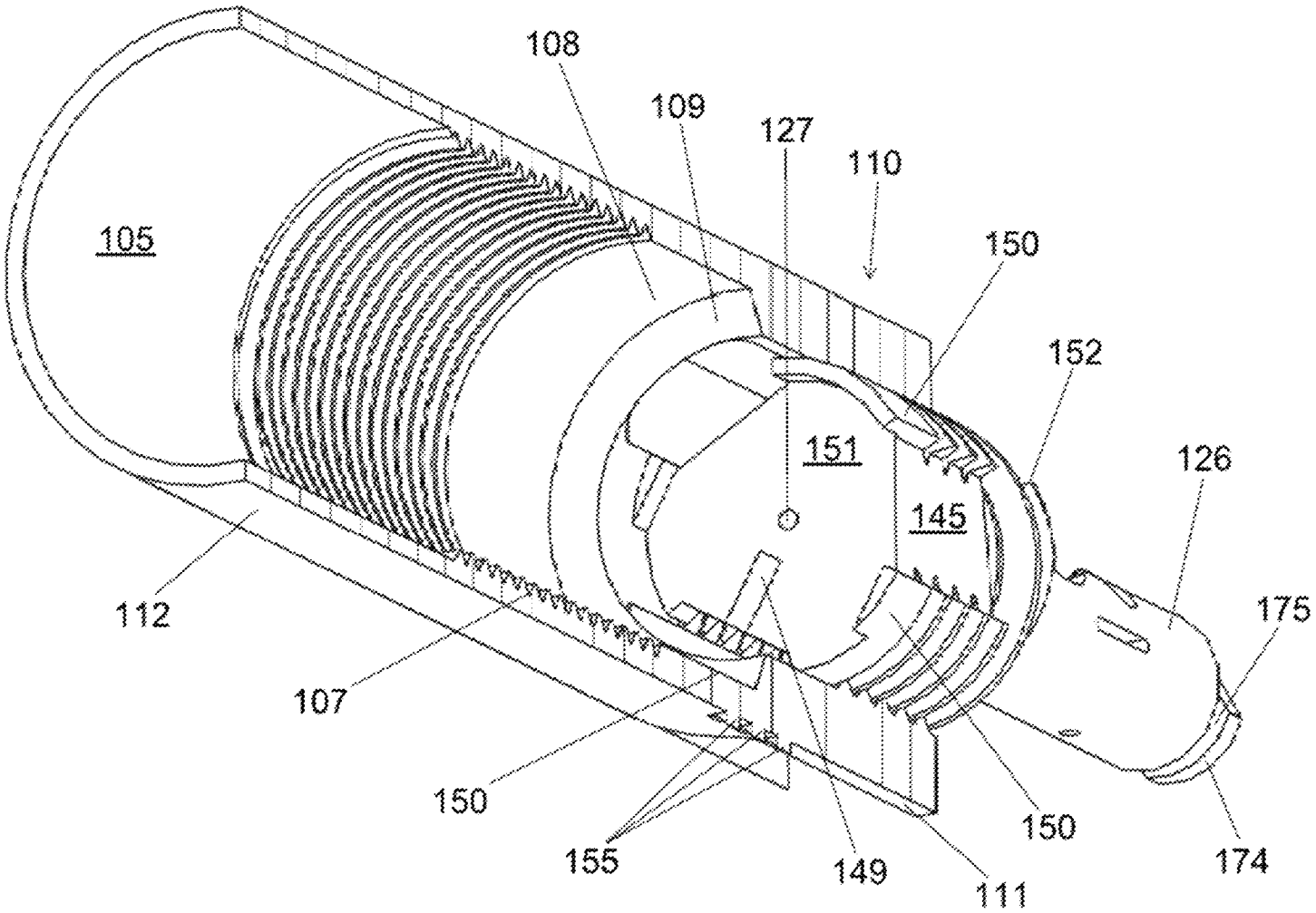
Figure 30:
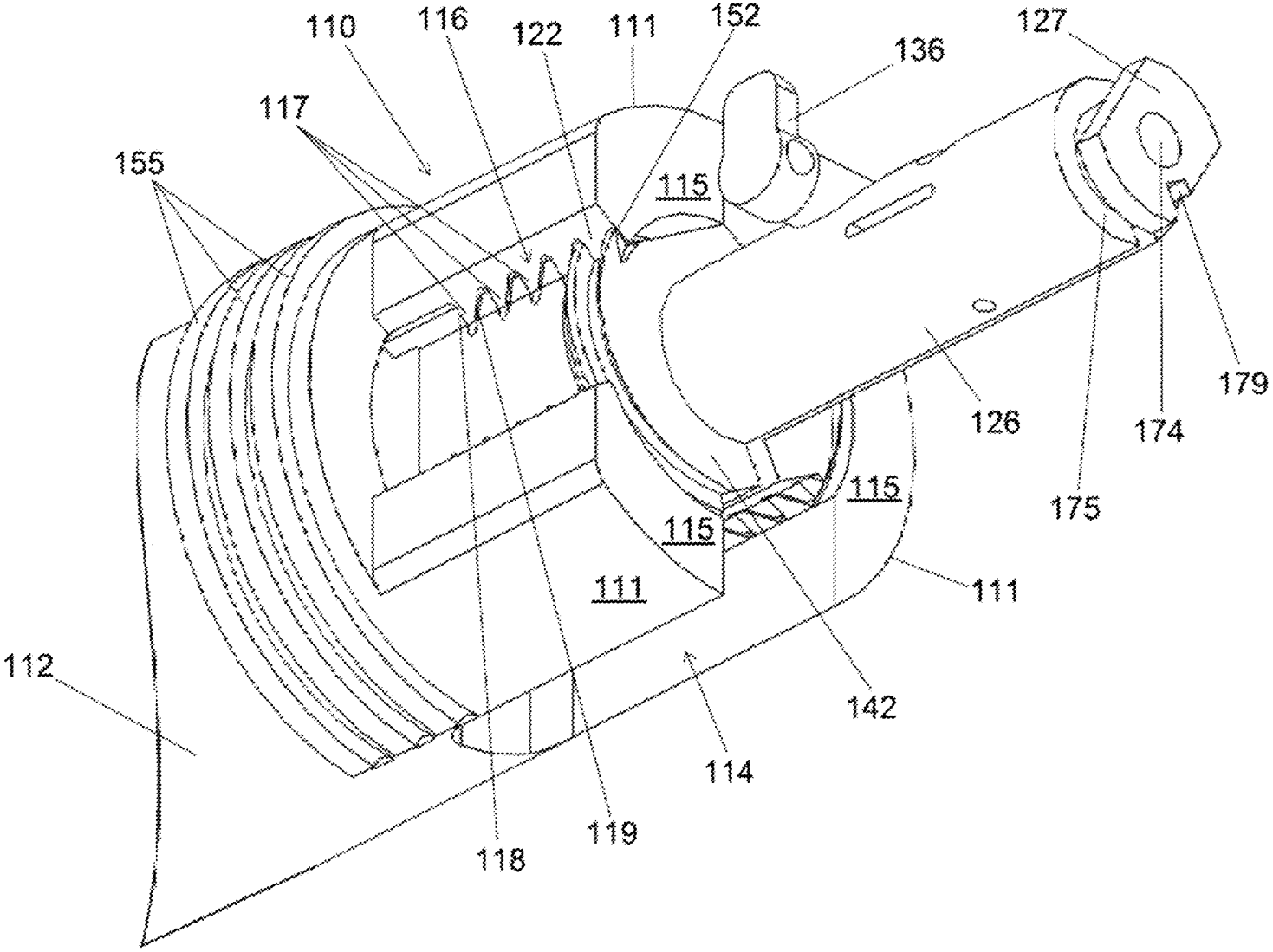
Figure 31:
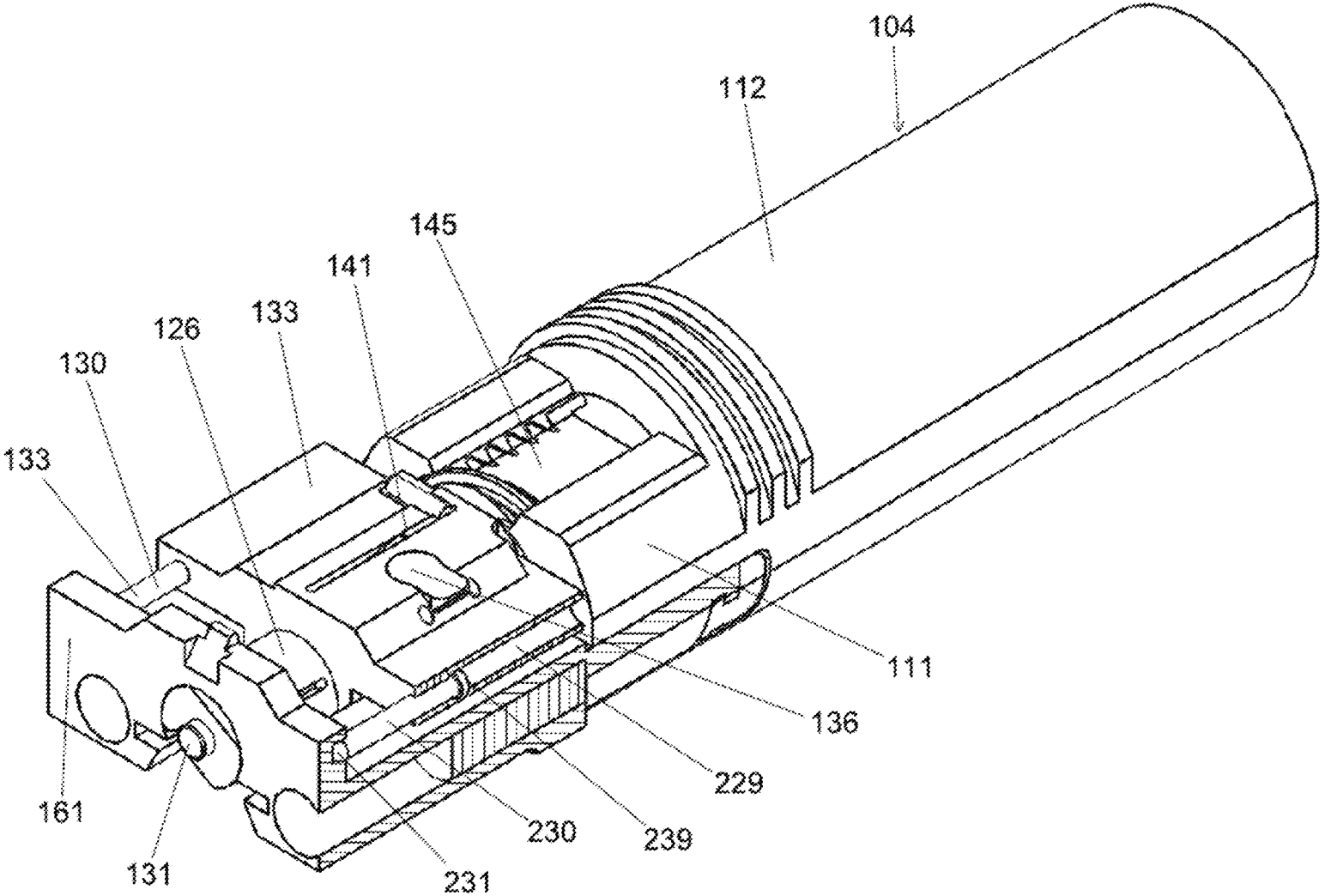
Figure 32:
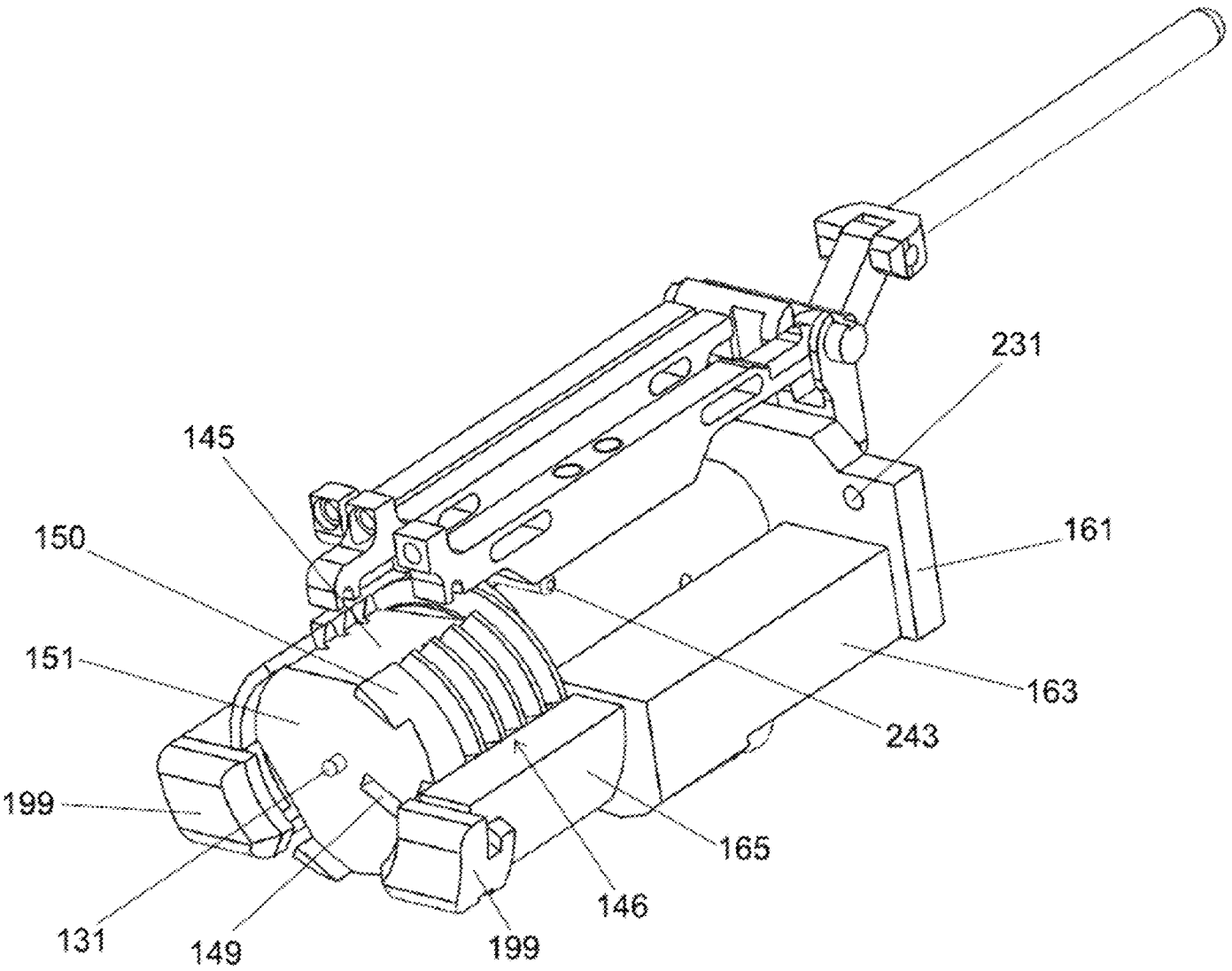
Figure 33:
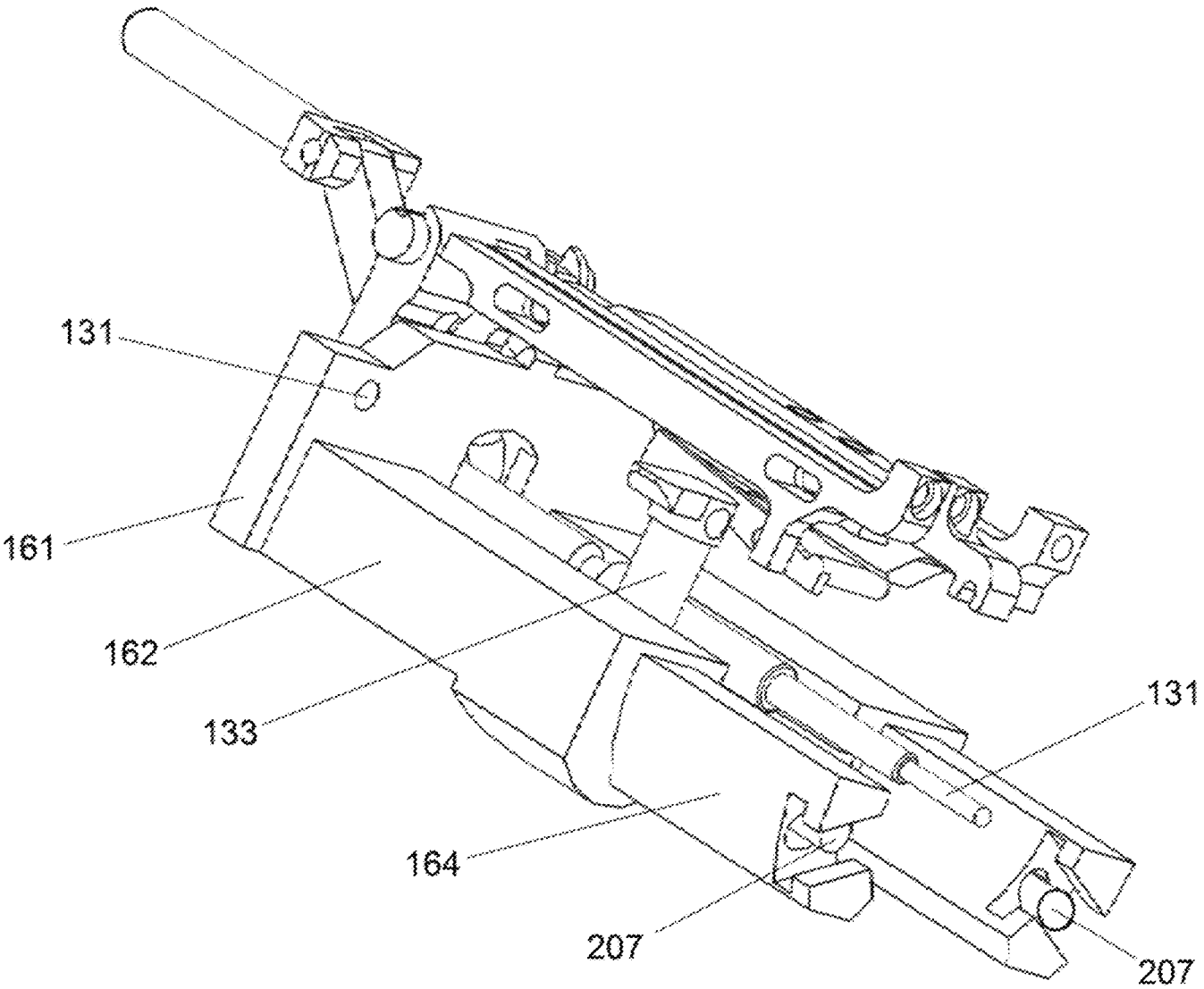
Figure 34:
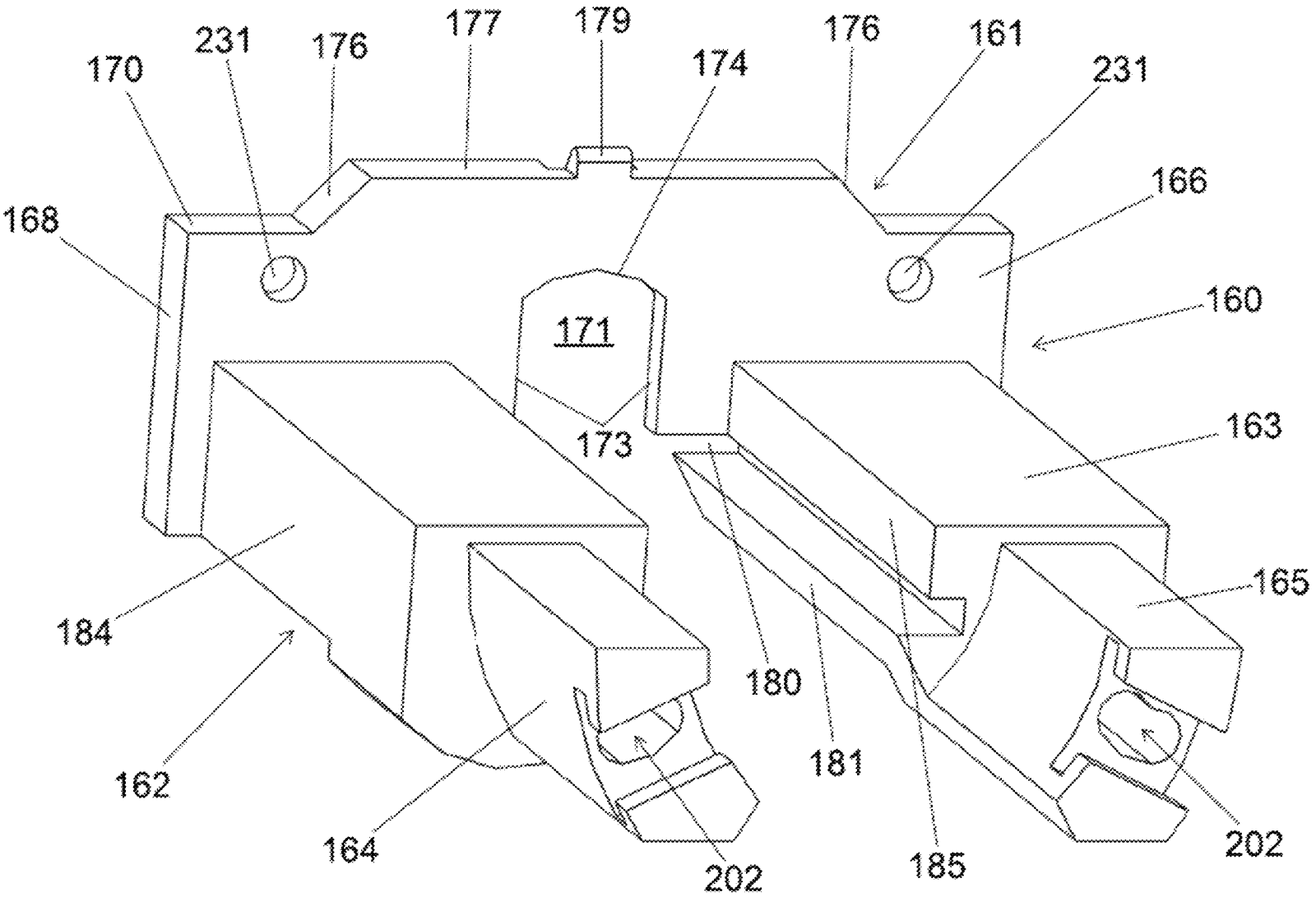
Figure 35:
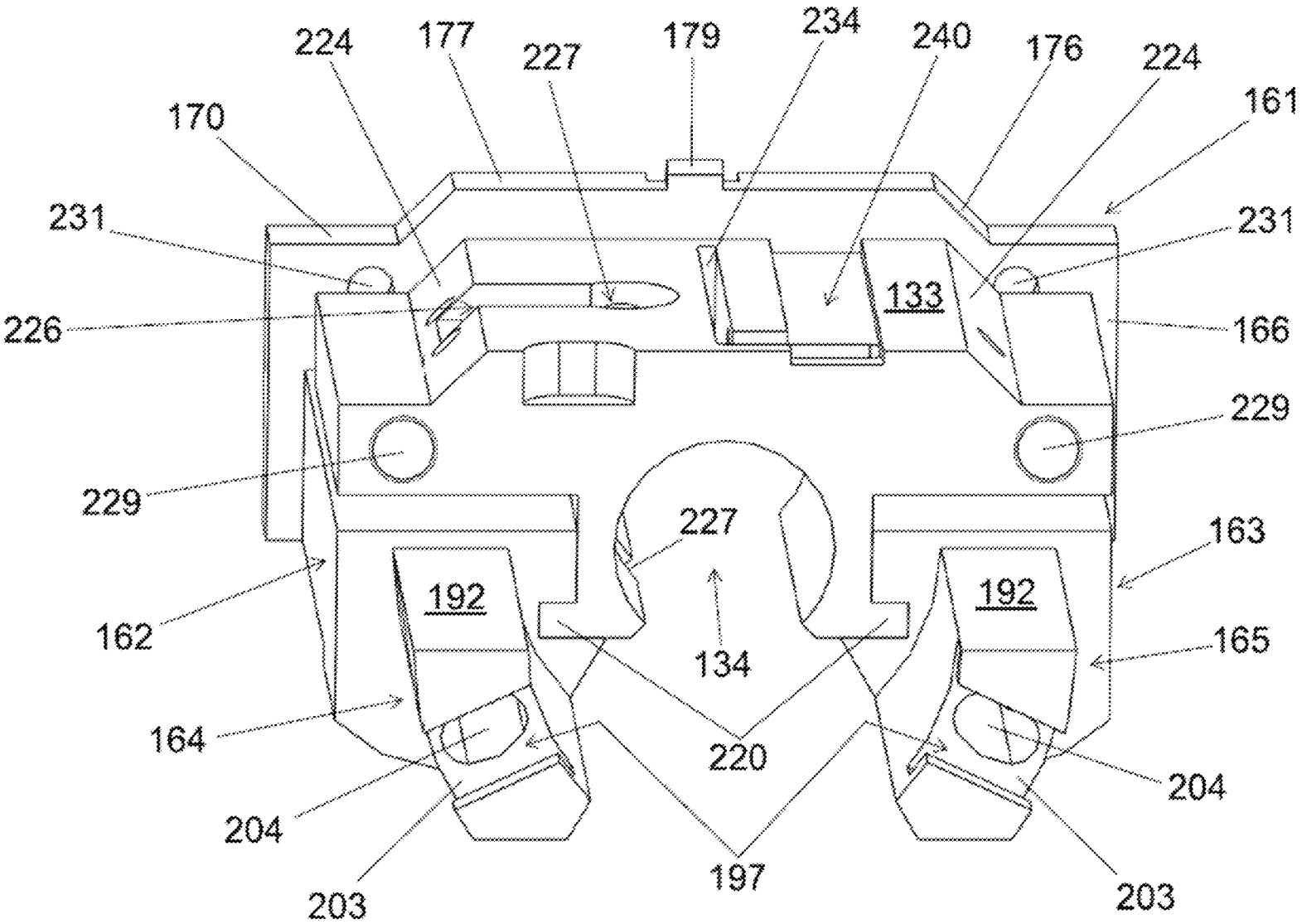
Figure 36:
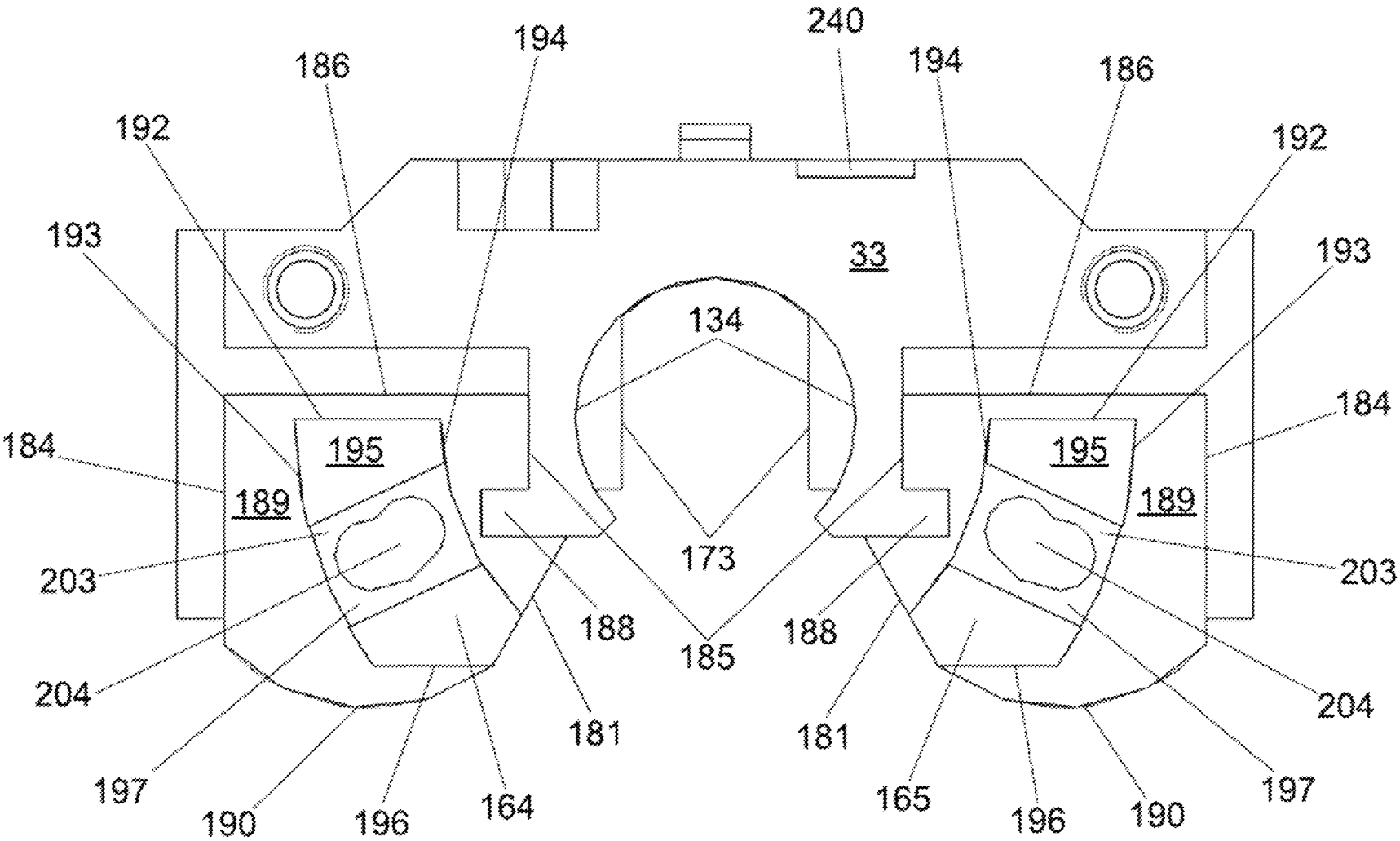
Figure 37:
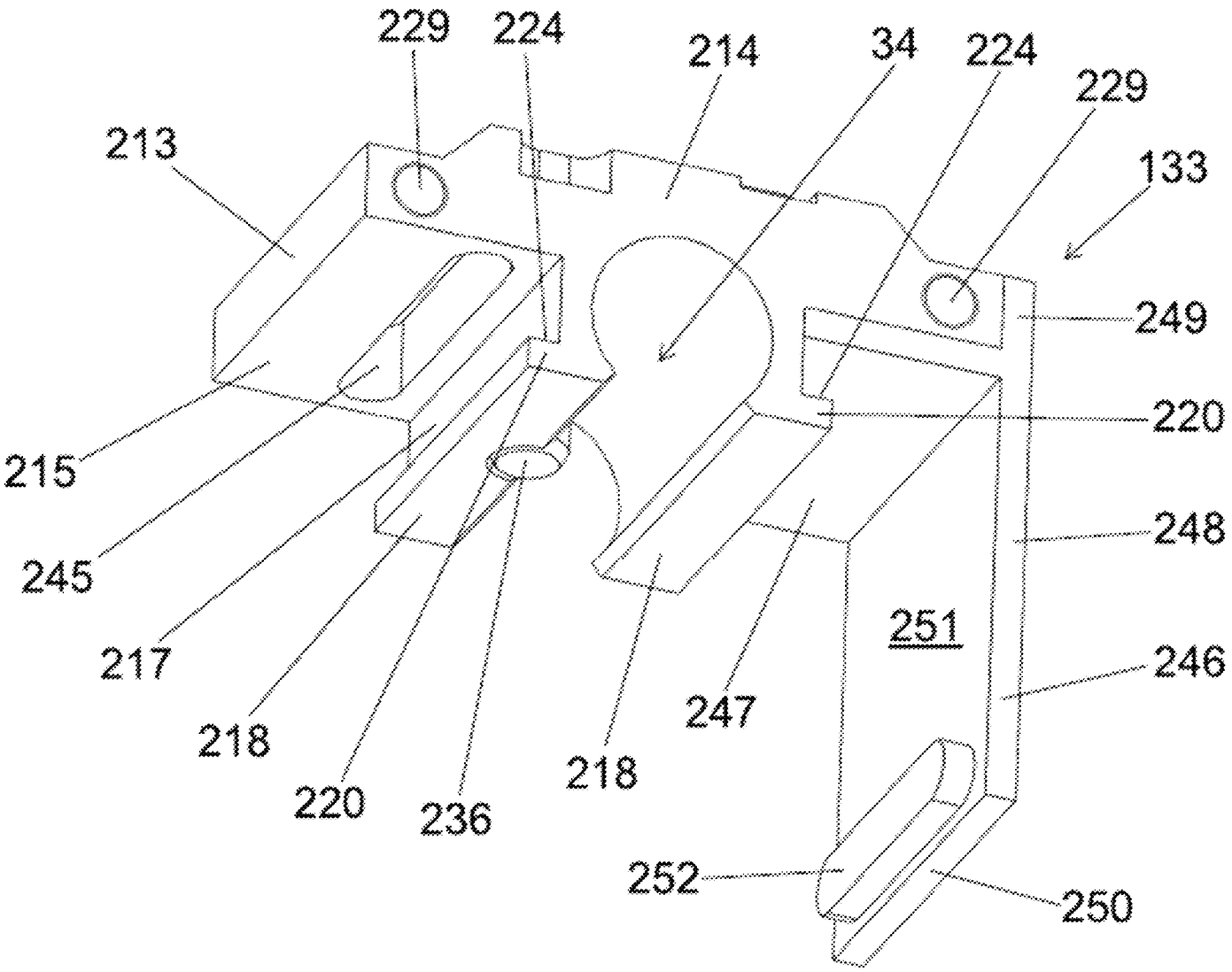
Figure 38:
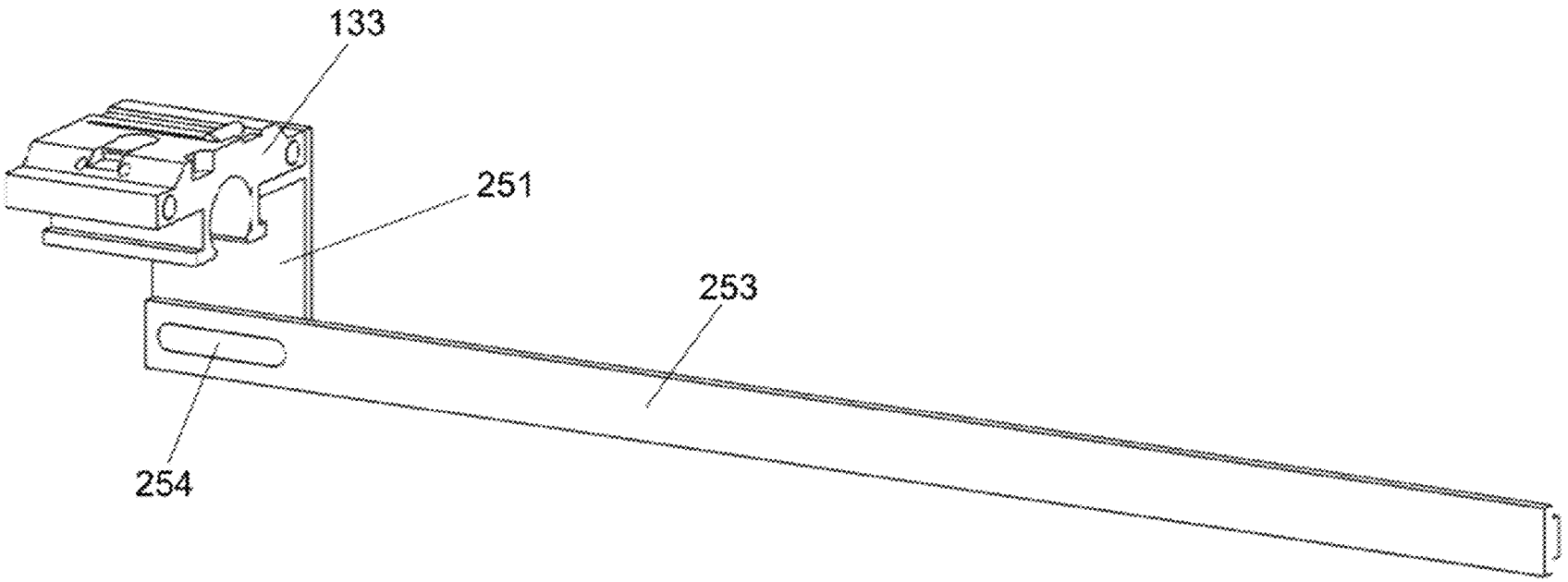
Figure 39:
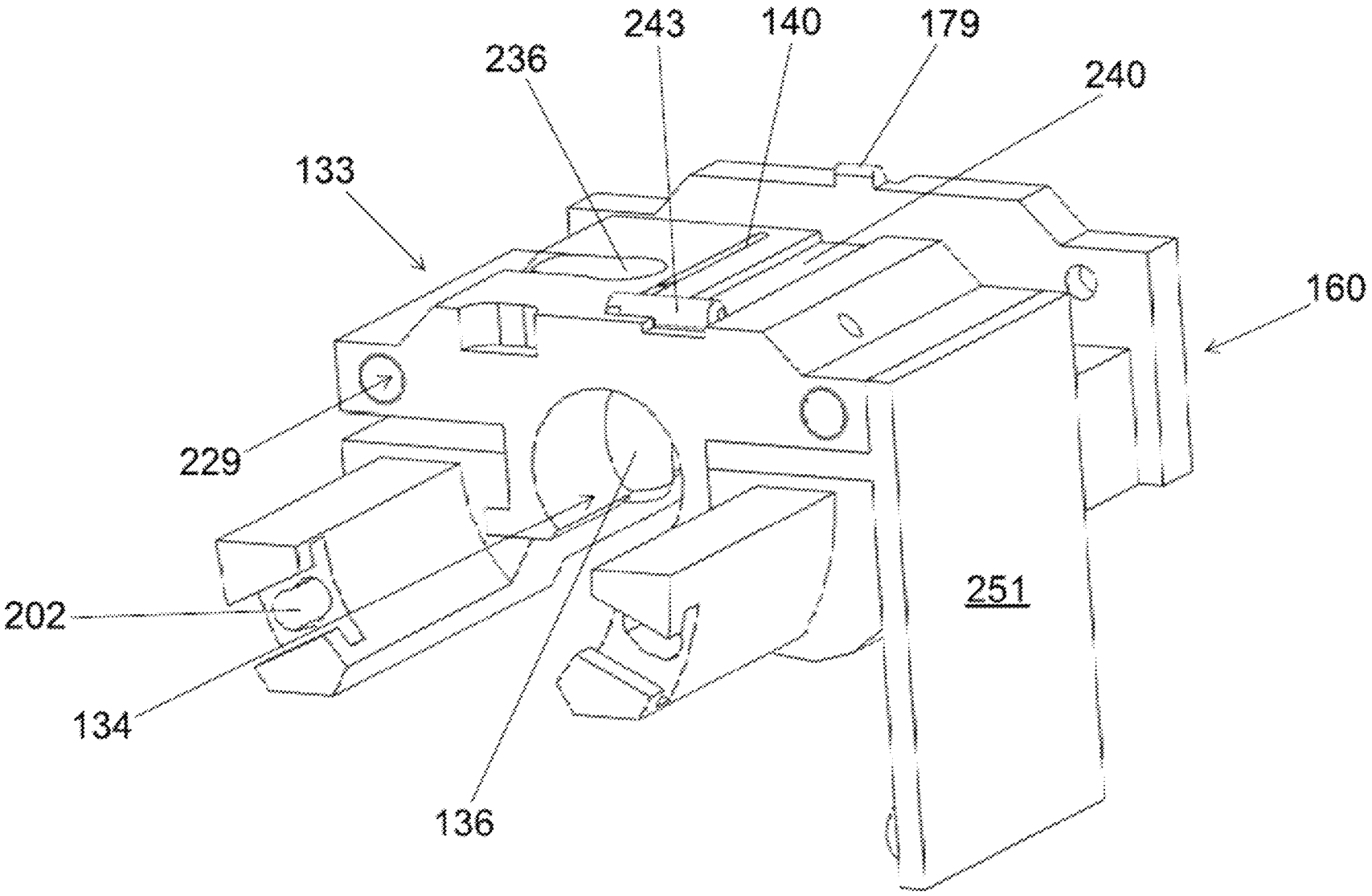
Figure 40:
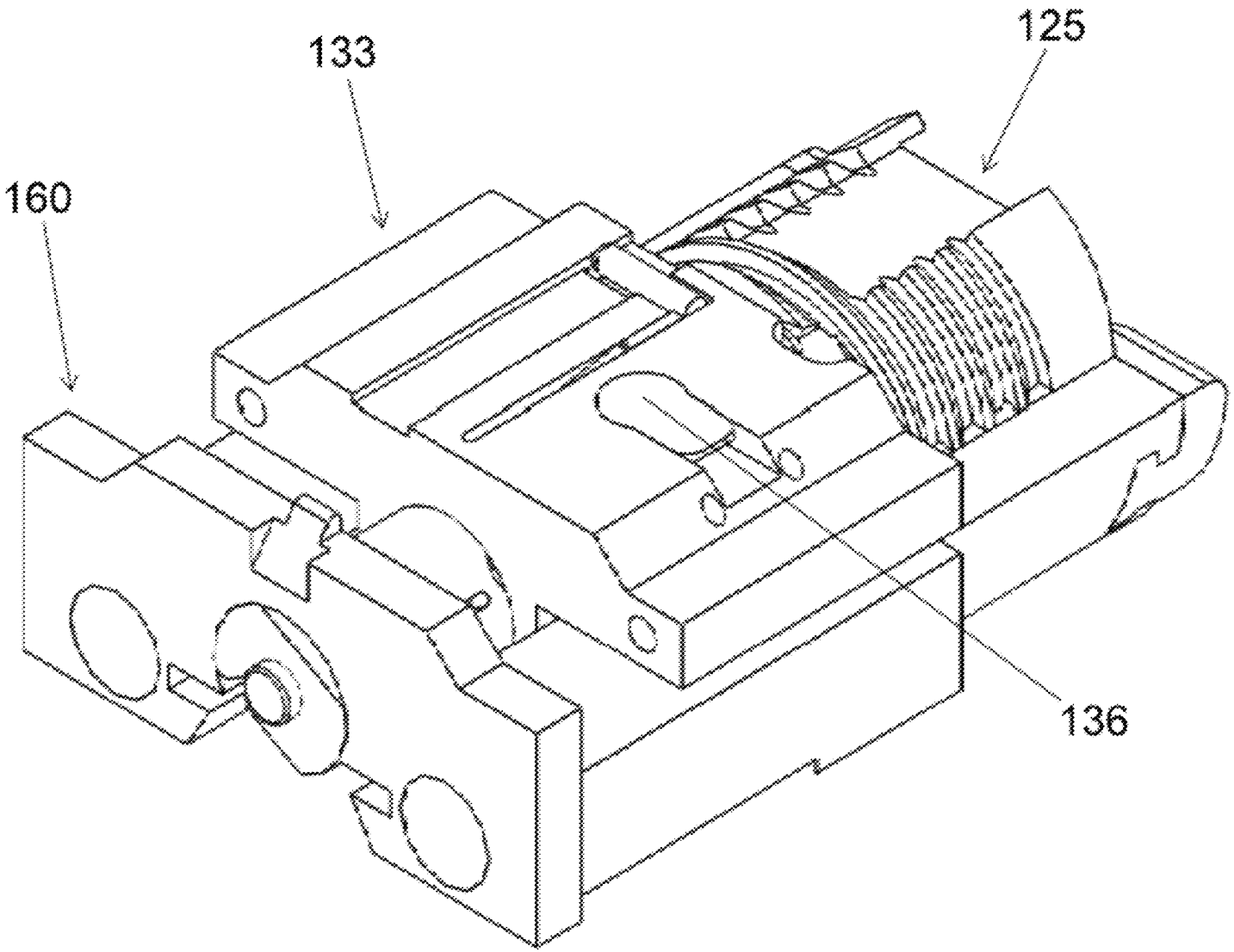
Figure 41:
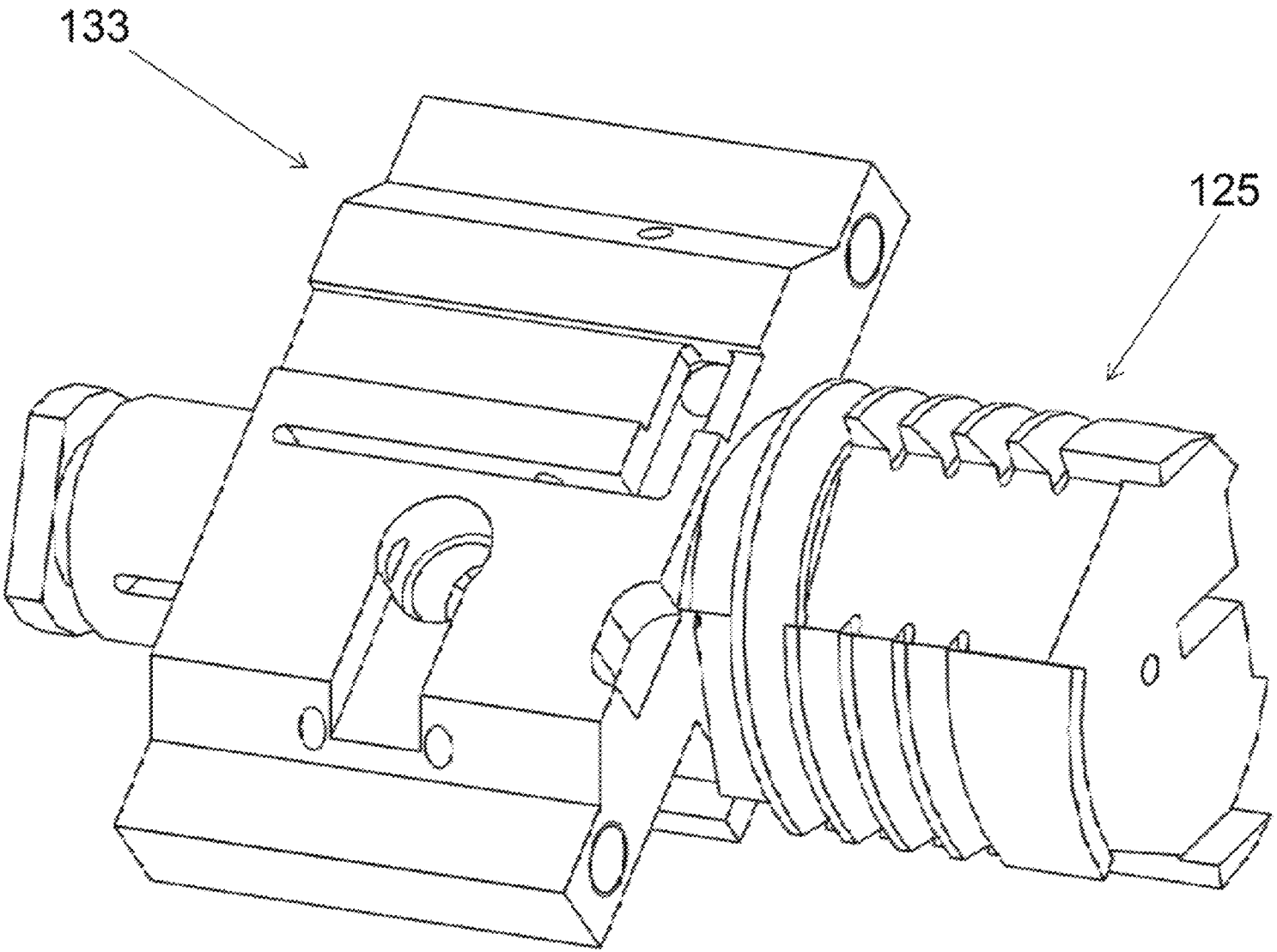
Figure 42:
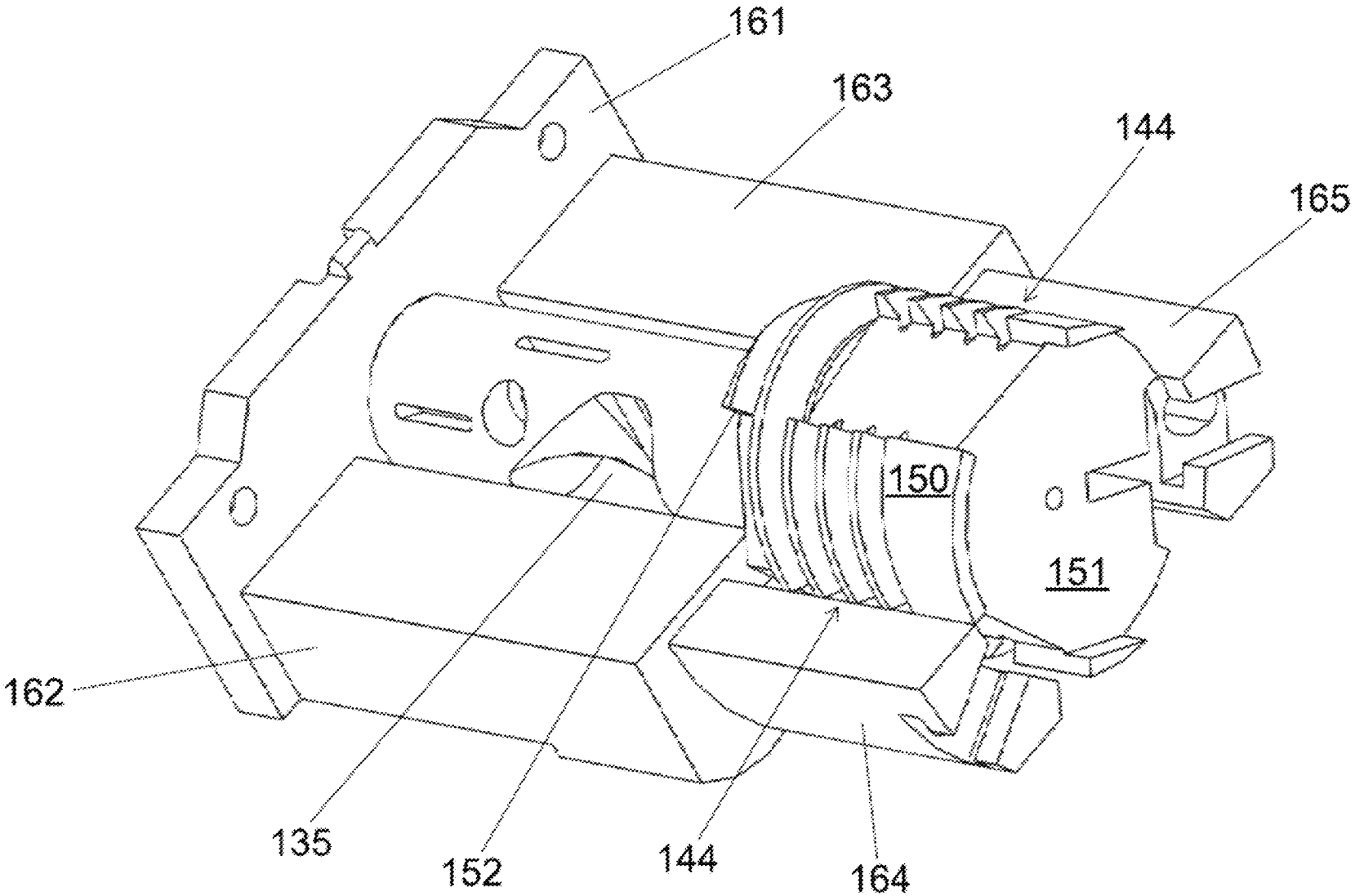
Figure 43:
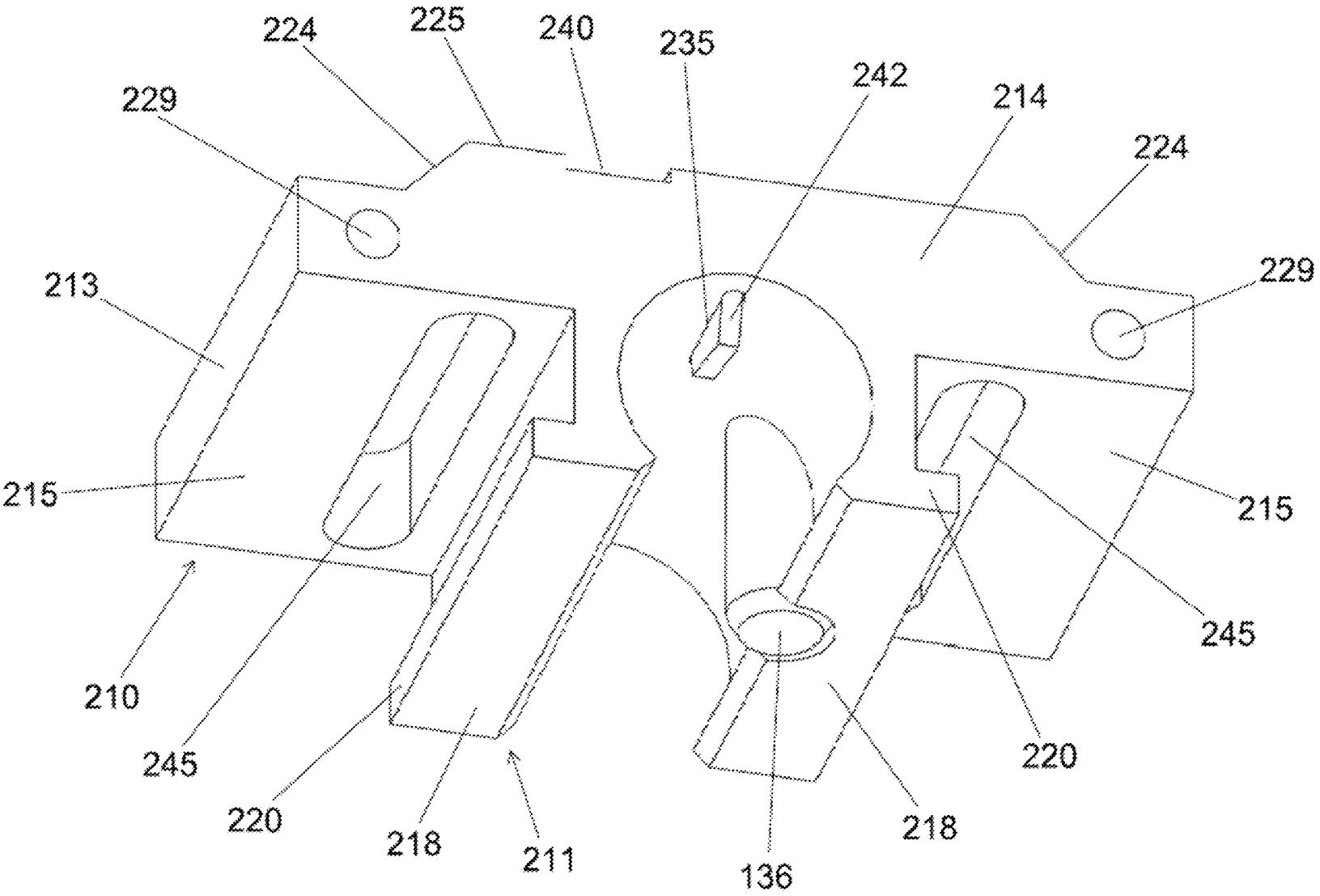
Figure 44:
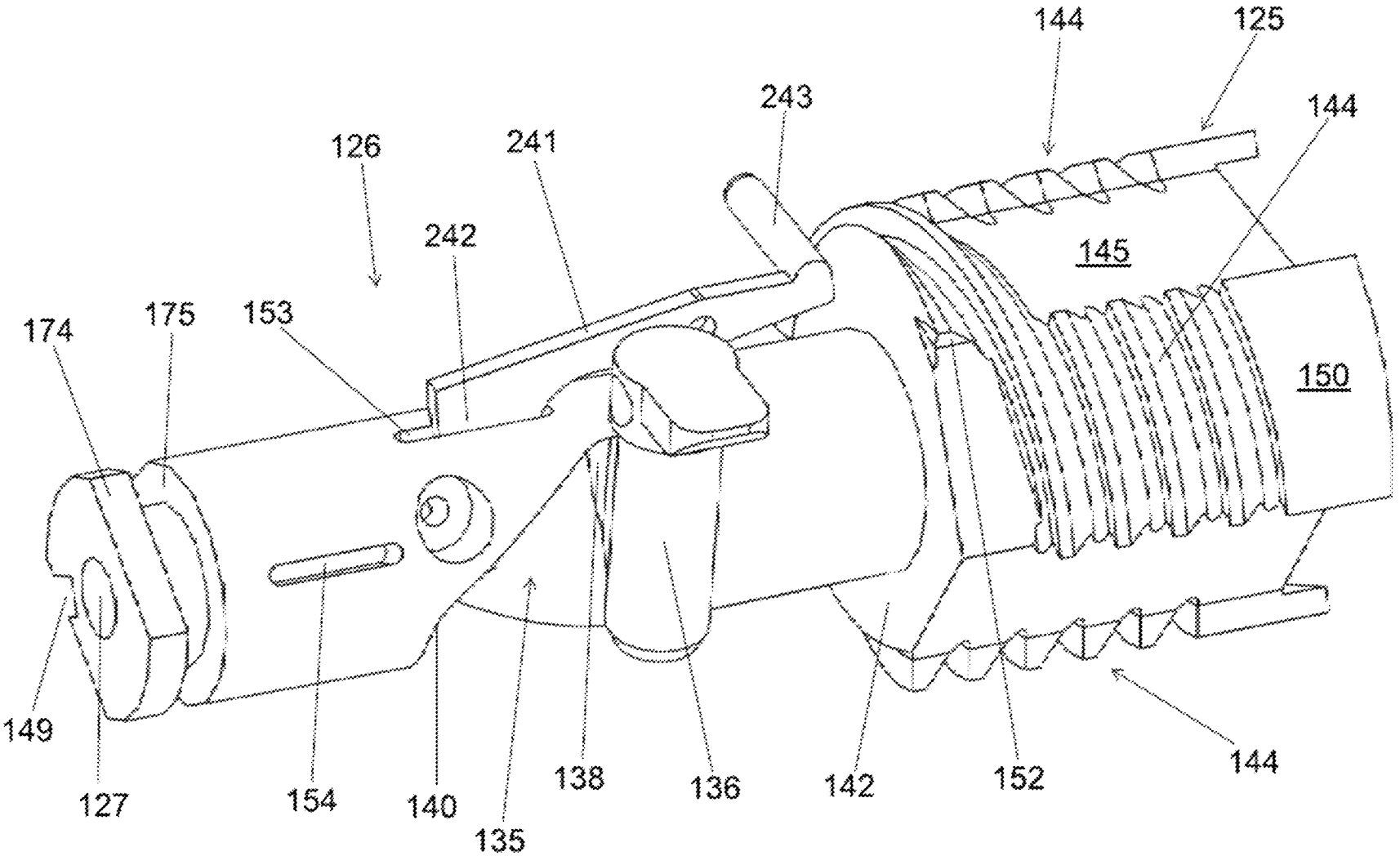
Figure 45:
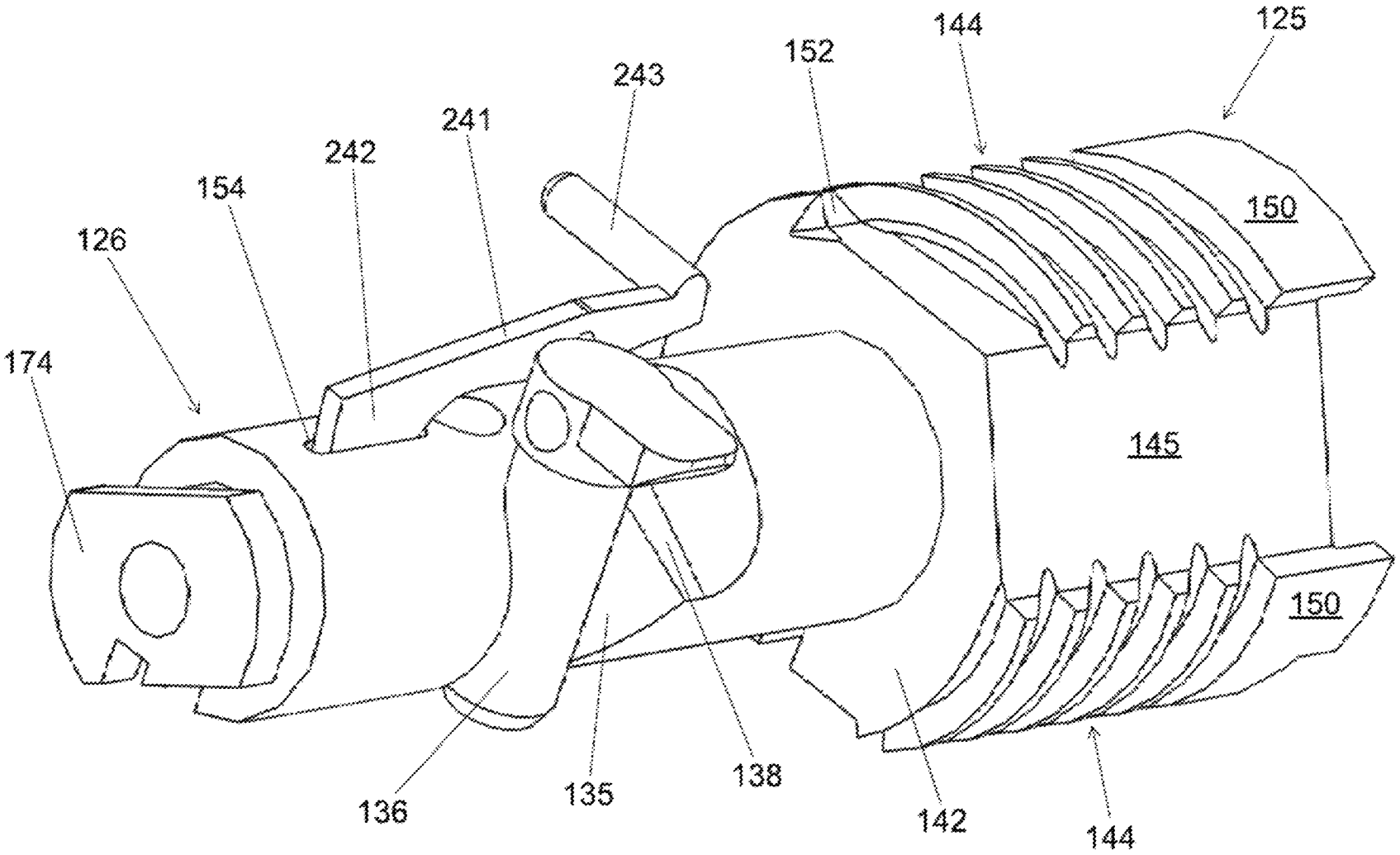

FIG. 24 bolt head and shaft in a perspective view;

FIG. 25: shows another embodiment of a breech according to the invention;

FIG. 26: shows the breech according to FIG. 6 in cooperation with the bolt receiver;

FIG. 27: shows the breech according to the invention and the bolt receiver in a perspective view from below;

FIG. 28: shows a partially sectional, cut-away view of the bolt head and of the bolt head shaft in the bolt receiver;

FIG. 29: shows the arrangement according to FIG. 9 in a perspective view from the opposite side;

FIG. 30: shows the arrangement according to FIG. 9 and FIG. 10 in a different perspective view;

FIG. 31: shows the arrangement according to FIG. 7 in the locked state in a partially sectional view;

FIG. 32: shows a perspective view of a partially cut-away view of the breech according to the invention with the lock of a weapon;

FIG. 33: shows the arrangement according to FIG. 13 in a perspective view of the bolt carrier;

FIG. 34: shows the bolt carrier according to the invention in the second embodiment;

FIG. 35: shows the bolt carrier according to the invention and a bolt body according to the second embodiment;

FIG. 36: shows the arrangement according to FIG. 16 in a view from the front;

FIG. 37: shows the bolt body in a perspective view from below with a guide bar positioned on it;

FIG. 38: shows the bolt body with a guide bar positioned on it and a guide rail positioned thereon;

FIG. 39: shows the arrangement according to FIG. 21 in a perspective side view with the bolt carrier;

FIG. 40: shows the entire breech in a perspective view from above and behind;

FIG. 41: shows the bolt head according to the invention, the bolt head shaft, and the bolt body in a perspective view from the front;

FIG. 42: shows the bolt body and the bolt head shaft and the bolt carrier positioned thereon;

FIG. 43: shows the bolt body according to the invention in a perspective view from below with the control pin and the locking pawl;

FIG. 44: shows the bolt head according to the invention and the bolt head shaft with the locking pawl according to the invention and the control pin in a perspective view from the side in the closed and locked position; and FIG. 45: shows the arrangement according to FIG. 31 in a perspective view from behind in an open, locked position.

In the firing direction from back to front, the firearm 1 according to the invention has a shoulder support device 2, a weapon chassis 3, a weapon system support 4, a weapon system apparatus 5, a bolt system 101, and a lock system 350.

In addition, a hand guard and mounting device 6 are detachably mounted on the weapon system apparatus 5.

There is also a detachably mounted pistol grip assembly 7.

Spaced slightly apart from the shoulder support device 2 is an intrinsically known magazine well 8, but according to the invention, it is has a magazine guiding and holding device 9 at its rear end in the firing direction oriented toward the shoulder support device 2.

The firearm 1 according to the invention is thus modularly designed; the individual components and particularly the shoulder support device 2, the weapon chassis 3, the weapon system support 4, and the pistol grip assembly 7 are supported so that they are able to slide relative to one another in such a way that the weapon can be freely adapted in its overall length to a magazine length (FIGS. 2 to 5). By sliding the components relative to one another and through a corresponding elongation of the weapon, it is possible to lengthen the magazine well 8. This is enabled particularly in that a magazine holding and guiding device 9 is provided only at the rear transverse boundary of the magazine well 8, thus avoiding a complicated mounting of a holding device that would have to be movable.

The weapon chassis 3, the weapon system support 4, and the weapon system apparatus 5 are positioned one after the other from bottom to top; the shoulder support device 2 constitutes the end of the firearm at the rear and at the top rear, above a bolt travel path. The weapon chassis 3, the weapon system support 4, a pistol grip assembly 7, and the shoulder support device 2 each have the engagement contour 10, which permits a length adjustment by means of a spacing patterns (FIGS. 9, 10, 11 and 12).

The engagement contour 10 in this case is embodied so that with a joining of the individual components 3, 4, 5, it is possible to transmit even very powerful forces without permitting the components to shift longitudinally or transversely relative to one another.

To this end, on a middle part—in the present case, this is the weapon chassis 3—the engagement contour 10 is embodied as doubled, one pointing toward the top and one pointing toward the bottom, in the form of wave formations 11 that extend transversely to the longitudinal direction and are offset relative to each other. In this case, both on the bottom and on the top, respective wave crests 12 and wave troughs 13 are arranged in alternation; the wave troughs 13 and wave crests 12 on the top and the wave troughs 13 and wave crests 12 on the bottom are particularly offset from each other by half a wave length so that transversely to the longitudinal axis, a wave crest 12 on the bottom is aligned with a wave trough 13 on the top; and between the wave troughs 13 of the top and bottom, which are offset relative to one another, there is a connecting piece 14.

This contour 10 is preferably solidly embodied of the material of the middle component, in this case of the weapon chassis 3 or alternatively of the weapon system support 4, and protrudes inward or outward by a desired amount. For example (FIG. 12), the contour protrudes by 2 mm; the distance between equivalent flanks of the wave crests is 10 mm.

From an outside 15 of the contour 10, the wave crests 12 and wave troughs 13 are inclined toward the wall 16 for example forming a 75° angle so that the contour widens out in the direction away from the wall, particularly in the region of the wave tips 17, and toward the inside, i.e. in the direction away from the wall 16 at the bottom of the wave troughs 13.

In other words, the inclination of the contour is the same in the region of wave tips and the wave troughs, while the contour is preferably flat in the region between the wave troughs and the wave tips.

This ensures that a correspondingly shaped counterpart contour 10 fits or can be fitted in a form-fitting way and also ensures that with a form-fitting engagement between a counterpart contour and a double-rowed contour (FIG. 12), the form-fitting engagement also reliably inhibits a pulling-apart in the transverse direction.

In order to position the parts so that they can be longitudinally adjusted relative to each other, if the weapon chassis 3 has the double contour, the pistol grip assembly 7 and/or a corresponding bottom plate 50 (for providing the bottom closure between the magazine well and the pistol grip assembly 7) on the one hand and the weapon system support 4 on the other, have a corresponding counterpart contour on their outer surfaces 18, the latter each having only wave crests and wave troughs without a corresponding double contour 10, as on the weapon chassis 3.

If the double contour is embodied on the weapon system support 4, then the weapon chassis 3 and the weapon system apparatus 5 each have a corresponding counterpart contour 10 on their outer surfaces 18, the latter each having only wave crests and wave troughs without a corresponding double contour, as on the component 4.

Correspondingly, the widths of the respective components 3, 4, 5, and 7 are adapted to one another so that they can be inserted into one another in such a way that the corresponding contours 10 can be brought into a form-fitting engagement.

In order to secure an arrangement of contours which are brought into form-fitting engagement with one another, to inhibit them from yielding upward and/or downward, a plurality of through bores 41 are provided in the respective components 3, 4, 5, 7, 50 from bottom to top, i.e. transversely to the longitudinal direction of the firearm 1, which are spaced apart axially by a distance that corresponds to the spacing pattern of the contour 10 or to a multiple thereof so that the respective parts having a contour 10 can be screw-connected to each other by means of bolts extending through the bores 41.

If for example three parts, e.g. the pistol grip assembly 7, the weapon chassis 3, and the weapon system support 4 are connected to one another, then an engagement through the flush bores 41 can occur; in this case, the screw connection reaches freely through the weapon chassis 3 and frictional connection acts on the pistol grip assembly 7 and the weapon system support via the screw/nut pairing or the screw/thread pairing.

In addition, the respective parts 3, 4, 5, 7, 50 can be provided with fit bolts 40, which are likewise positioned at distances corresponding to the spacing pattern of the contour, but preferably a multiple thereof, in order to ensure a defined seating before the screw connection is produced. The fit bolts are positioned on the components in the region of one or more bores 41, replacing them, and can engage in a bore 41 of the respective corresponding component.

The fundamental principle of the length adjustment is thus the fact that on one component, there is a plurality of engagement contour elements, which extend transversely relative to the longitudinal direction and are arranged in a spacing pattern, and on another component, a correspondingly shaped contour is provided, which is arranged in a corresponding spacing pattern. As in the specific exemplary embodiment according to FIGS. 9 and 12, these can be wavy projections or wavy double projections, both on top and on the bottom, which can also be offset from each other by a half a space of the pattern (from top to bottom); these projections, as demonstrated above, can be embodied as wavy, but can also be embodied as tooth-shaped, as in gears or the like.

By means of such an arrangement, it is possible to detachably and adjustably position a shoulder support device 2, a weapon chassis 3, a weapon system support 4, a weapon system apparatus 5, the pistol grip assembly 7 and a base plate 50 relative to one another.

Figure 1:
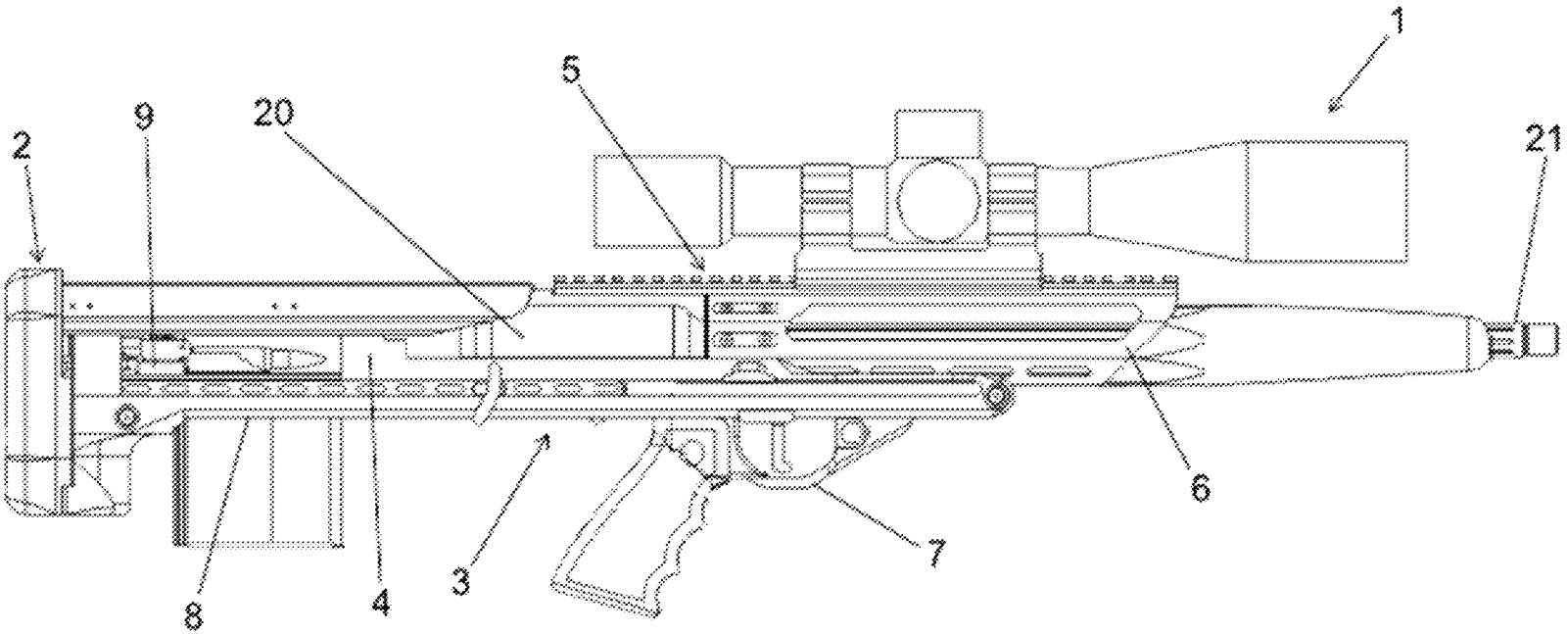
Figure 2:
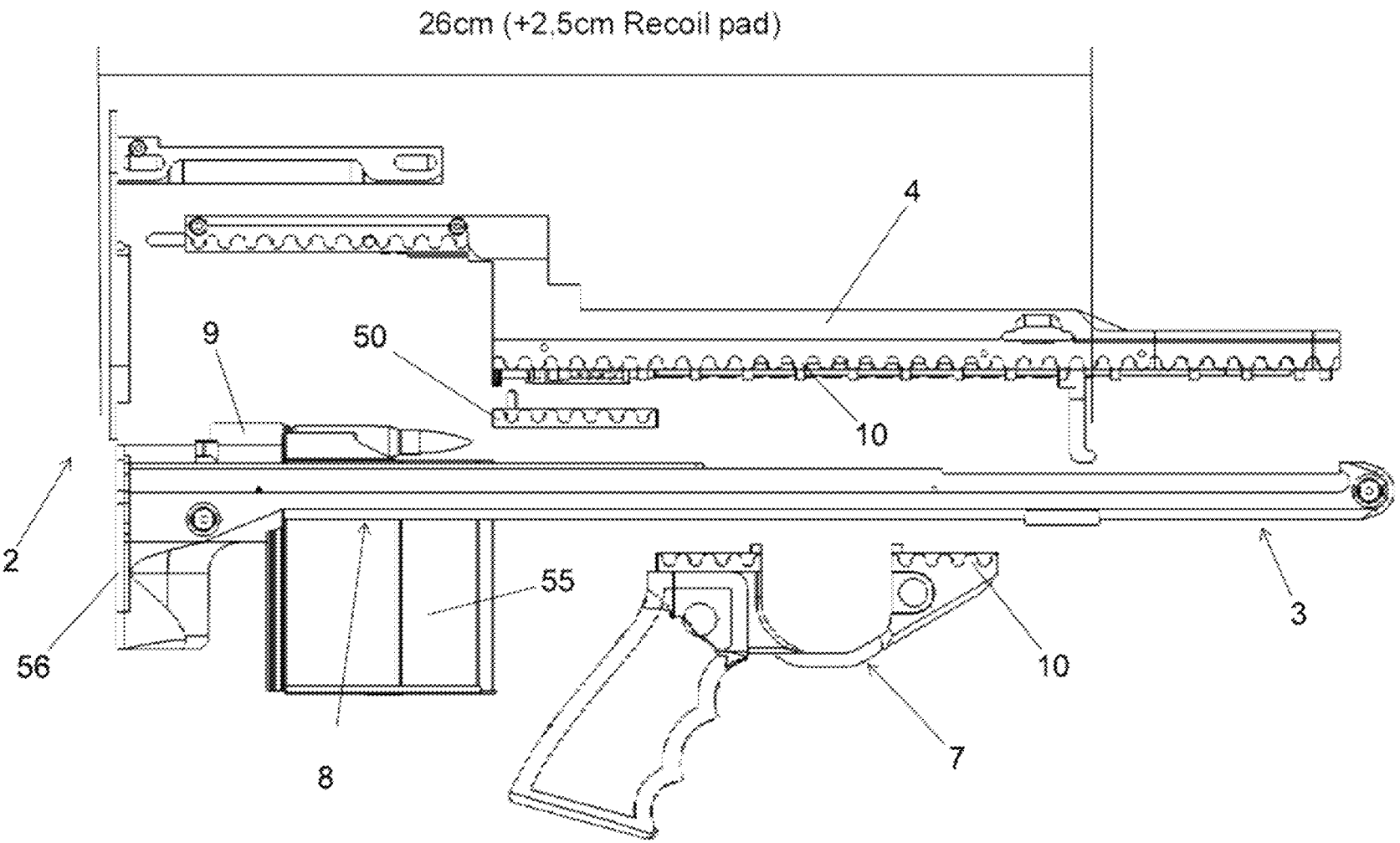
FIG. 2 shows the basic structure of the firearm in an exploded view from the side.
Figure 3:
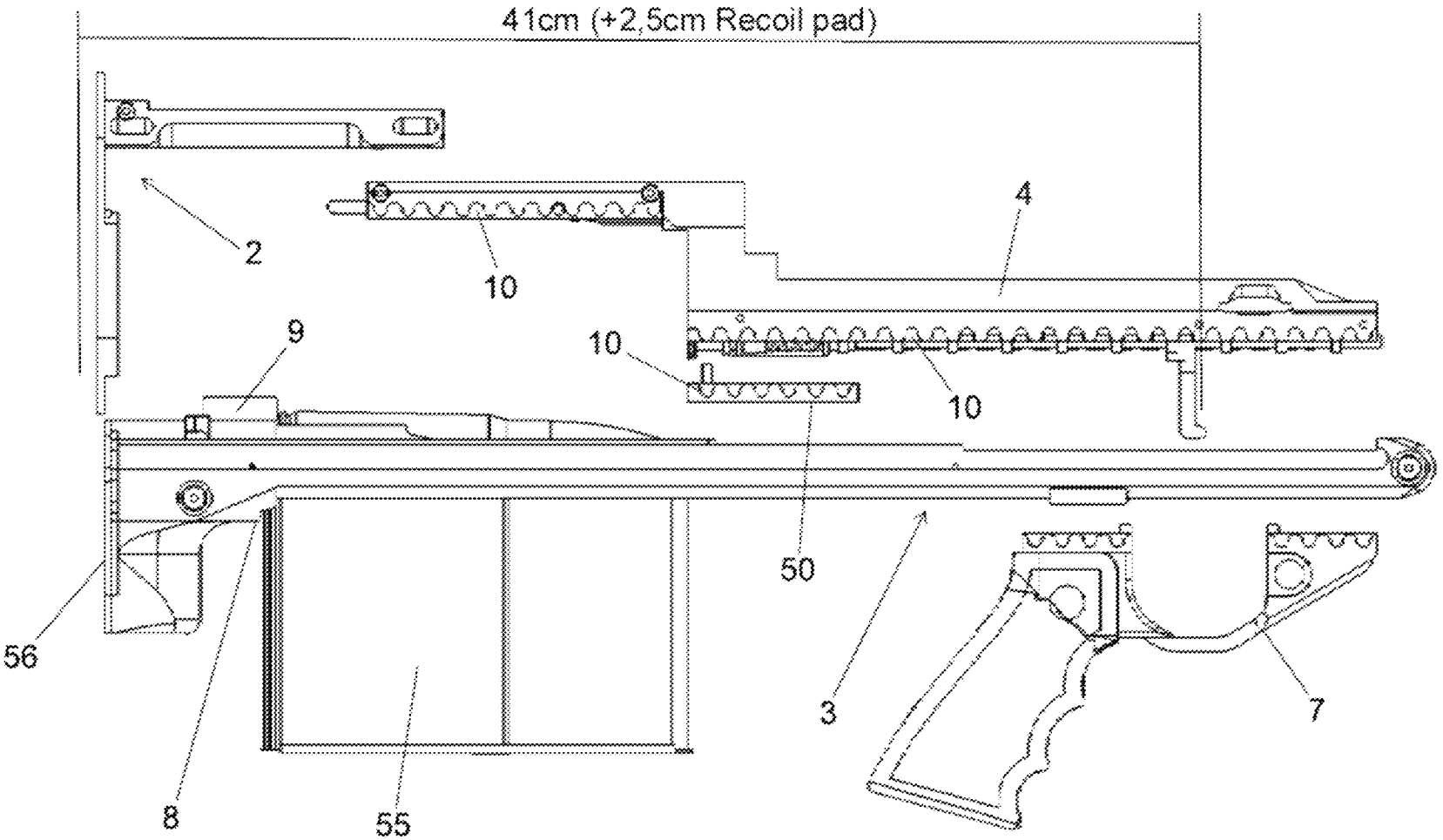
FIG. 3 shows the view according to FIG. 2 with a different length adjustment.
Figure 4:
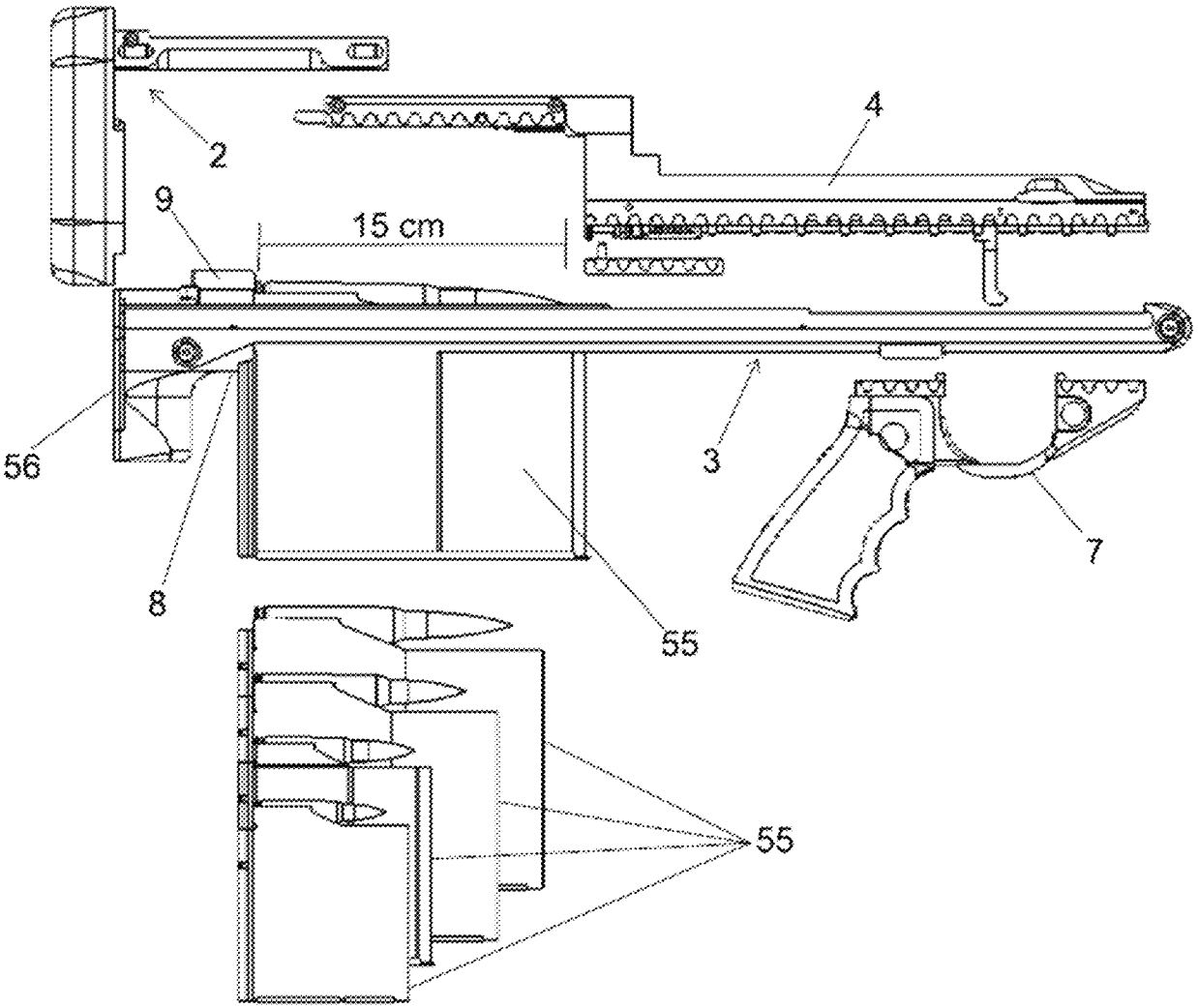
FIG. 4 shows the view according to FIG. 2 adapted for a large caliber.
Figure 5:
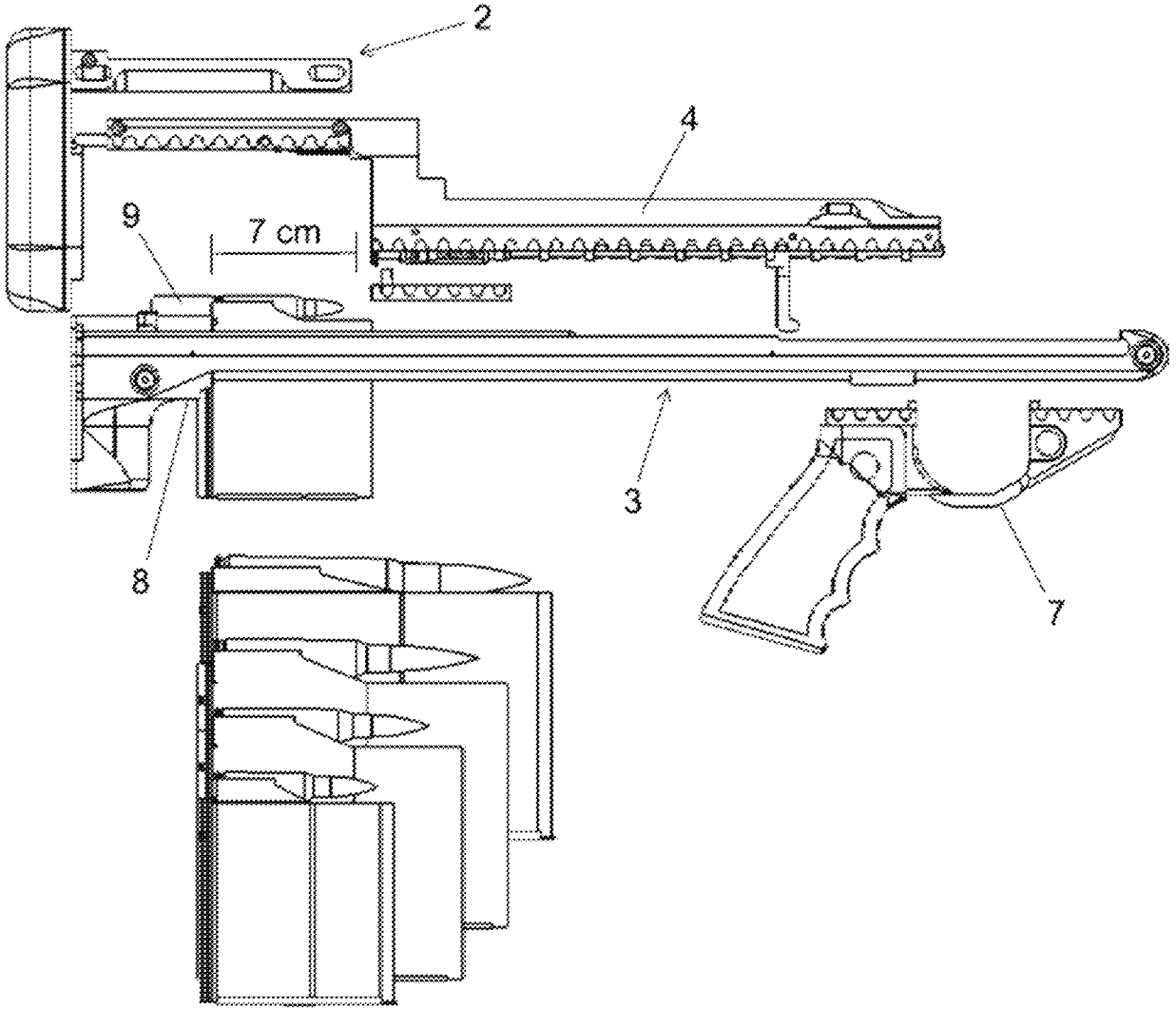
FIG. 5 shows the view according to FIG. 2 adapted for a small caliber.

In particular, for example the pistol grip assembly 7 can thus be freely positioned on the underside of a weapon chassis 3 so that together with a freely movable trigger, it is possible to optimally adjust a triggering length of for example 26 cm (FIG. 2) or 41 cm (FIG. 3). The weapon can therefore be optimally adapted to the size of the shooter.

This also makes it possible to correspondingly set the appropriate magazine length (FIGS. 4 & 5) and thus to adapt the weapon to different calibers.

The firearm 1 according to the invention also has a receiving sleeve 20 for a barrel extension 104, the receiving sleeve 20 being embodied as a clamping sleeve, and for a barrel 21.

The receiving sleeve 20 is in particular embodied as octagonal and in a region positioned in the direction of fire, has corresponding engagement means for accommodating counterpart engagement means of the barrel extension, as will be described further below.

In addition, the receiving sleeve 20 has a receiving region 22 for a hand guard and mounting device 6 that are to be installed.

The receiving region 22 for a hand guard and mounting device 6 likewise has an octagonal cross-section, this octagonal cross-section being smaller in size than the rest of the cross-section of the barrel receptacle so that the barrel receptacle tapers with a step 23 to the receiving region 22. The hand guard likewise embodied as octagonal and in this case, its inner diameter is dimensioned so that it can be slid in a form-fitting way axially over the receiving region 22 until it comes into contact with the step 23. The receiving region 22 and the hand guard and mounting device 6 have an intrinsically known so-called M-LOK system in which each of the eight surfaces of the hand guard and mounting device 6 in axial succession is provided with oblong recesses in a pattern predetermined by M-LOK and in the receiving region 22, there are receiving regions 24 for receiving M-LOK locking pieces 25, which in particular have two screw holes and a slot 26 for receiving an immobilizing projection of the fastening piece 25.

Instead of an intrinsically known M-LOK system, it is suitable to provide any other corresponding system with different hole shapes, such as the Key-MOD system. For the unchangeable seating of the hand guard and mounting device 6, the polygonal—in particular octagonal—cross-section is the decisive factor, not the hole shape. Basically, it is conceivable to provide any shape of cross-section in which the angles are not 90 degrees since a 90-degree angle does not permit a transverse blocking. Consequently, triangular cross-sections and pentagonal and more-sided cross-sections can work.

It has turned out that the positioning of three fastening pieces 25 in radial succession produces a sufficient immobilization of the hand guard and mounting device 6 so that even aiming devices such as rifle scopes, which are positioned on the hand guard and mounting device 6 and are fastened to a Picatinny rail mounted using the M-LOK system, are sufficiently stable so that with installation and removal and even when firing the heaviest caliber, no shifting of the point of impact occurs.

The receiving sleeve 20 and thus also the barrel 21 and the hand guard and mounting device 6 are positioned on the weapon system support 4; for securing purposes, the weapon system support 4 is provided with a transverse notch 27 and a locking hook or immobilizing hook 28 is provided on the receiving sleeve 20 in the direction of fire and beneath the barrel receptacle 104.

In addition, on the underside, the receiving sleeve 20 has a fastening projection 29, which extends a bottom surface of the octagonal contour in the form of a projection and having the immobilizing hook 28 at the back, which fastening projection extends from the immobilizing hook 28 in the direction of fire until just before the step 23 and for example has four transversely extending bores, which extend through into the weapon system support 4, for example, by means of which the bolts (not shown) produce the clamping of the barrel extension 104 and in one embodiment, the fastening and axial immobilization of the receiving sleeve 20 on the weapon system support.

In another advantageous embodiment of the invention (FIGS. 7 & 8), the bores 30 are used for accommodating the screws that produce the clamping (not shown) while the immobilization of the receiving sleeve 20 takes place indirectly via the hand guard and mounting device 6 by means of fastening pieces 31 that can be moved radially outward. In this case, the hand guard can, for example, also be placed in the vicinity of the receiving region 22 with eight fastening pieces 25 so that all of the M-LOK apertures in this region are locked.

The radially movable fastening pieces 31 are correspondingly positioned in front of the receiving region 22 and are supported on the weapon system support 4 in a radially movable fashion and are positioned so that they can engage in the bottom three adjacent apertures 32 according to the M-LOK system on the hand guard and mounting device 6.

The radially movable fastening pieces 31 in this case are supported so that they can be radially moved and guided in the weapon system support 4; from a central, radially movable fastening piece 31, two guide tongues 33 extend transversely outward and upward relative to the longitudinal direction of the weapon in accordance with the angle of the support for the hand guard and mounting device 6. The central, radially movable fastening piece 31 also has guide pins 34 with which it is supported so that it slides diagonally in guide slots 35 of the weapon system support 4.

A clamping bolt 36 is provided, which acts axially on a narrow end of the central, radially movable fastening piece 31, is in particular spring-loaded, and holds the central, radially movable fastening piece 31 in a position in which it is raised out of its slot 32 to a maximum degree.

The adjacent peripheral, radially movable fastening pieces 31 have an opening 37 with which they can slide on the guide tongues 33 in order to provide a longitudinal compensation for an axial movement of the guide tongues 33 through the sliding of the guide pins 34 in the guide slots 35 and to ensure the mobility.

The clamping bolt 36 and at least the central radially movable fastening piece 31 can be moved from the outside in such a way that by pressing against the spring-loaded clamping bolt 36, the central movable fastening piece 31 and it adjacent peripheral radial movable fastening pieces 31 can be lowered into their respective slots in order to ensure that they do not obstruct the hand guard and mounting device 6.

The breech system 101 of the firearm 1 according to the invention has at least one bolt receiver 102 and a bolt head 103.

The bolt receiver 102 can be positioned in the insertion direction of a cartridge before the cartridge chamber in a barrel for a firearm or can be positioned in a barrel extension 104.

The barrel extension 104 according to the invention is a cylindrical sleeve-shaped component, which has an opening 105 toward the front in the direction of fire and a rear opening 6 toward the rear in the direction of fire. Viewed from the front opening 105, the barrel extension 104 has a thread 107 for screwing in a barrel, which corresponds to a conventional external barrel thread and corresponds thereto. The threaded region 107 can be adjoined by a smooth region 8 away from the direction of fire; the smooth region 8 has a diameter that corresponds to the inner diameter of the thread 107 and thus reduces the inner diameter of the barrel extension 104. This region usually serves to receive the smooth end region of a barrel oriented in the direction of fire. In the direction away from the direction of fire, the smooth region 108 ends with a stop 109 against which a barrel then rests on the cartridge chamber side.

Away from the direction of fire, this is then adjoined by the bolt-locking region 110. The bolt-locking region 110 has three cylinder segments 111 extending rearward, i.e. away from the direction of fire, which extend the circumferential wall 112 of the barrel extension 104 or a barrel on the outside.

For example, the cylinder segments 111 are positioned symmetrically to one another and thus e.g. at an angle of 60° relative to one another. Correspondingly, the cylinder segments 111 radial delimit slots 114 between one another, the slots likewise being correspondingly positioned offset from one another by 60°. The cylinder segments end axially at end walls 115, the end walls 115 preferably being situated at the same axial level.

On the inside of the cylinder segments 111, a thread 116 is provided. The thread 116 is therefore embodied as an internal thread and particularly according to the invention as a buttress thread in which the two flanks 118, 119 of a thread comb 117 are embodied with an essentially identically oriented slant such that the respective thread combs 117 appear to be inclined by means of an oblique front flank 118 and an oblique rear flank 119 in terms of in the direction of fire. The respective cylinder segments 111 extend the thread so that without the slots 114, the thread and the thread helix would be continuous. According to FIG. 4, the thread combs 117 in this case are embodied as a cross between a trapezoid and a sharp thread in the form of a sharp thread with flattened tooth crests or thread comb edges.

In the direction of fire in front of the thread 116, the cylinder segments 111 have smooth regions 120 of axially different lengths. The smooth regions 120 in this case are embodied as cylinder segment inner walls and viewed axially, are positioned at the height of the thread base so that the threads protrude inward from it. Since the thread 116 is embodied as a thread on the cylinder segments 111 that is broken only by the slots 114, but is +otherwise continuous, the regions 120 have axial different lengths.

Correspondingly, the thread combs 117 are also embodied as axially different in the individual cylinder segments 111 so that for example on one cylinder segment 111, the thread combs begin directly in the vicinity of the end wall 115, while in other cylinder segments 111, in particular a cylinder segment 111*a*, adjacent to the end wall 115, there is a smooth region 121 that protrudes radially inward by the same amount as the thread combs 117. This smooth region 121, which protrudes radially inward, forms an axial stop surface 122 in its insertion direction of the thread.

The cylinder segments 111 can be embodied the same in terms of their radial width or arc length, but the cylinder segments 111 can also be of different widths so that the slots 114 in this case are not offset from one another uniformly by 60°, but instead for example two slots 114 are offset from each other by a smaller angle. Correspondingly, the thread combs 117 can be of different lengths depending on the cylinder segment 111.

In addition, the cylinder segments 111 can be embodied without separating slots positioned between them so that the circumferential wall 112 of the barrel extension 104 is embodied as continuous; in this case, however, axial slots 114 are provided in the circumferential wall 112 of the barrel extension 104 in such a way that the threads of the breech, which are described in greater detail below, can slide in these regions.

The bolt 103 has a bolt head 125 and a bolt head shaft 126, which can be embodied of one piece with each other, for example. The bolt head 125 and the bolt head shaft 126 have an axial, continuous bore for accommodating a firing pin and a firing pin spring; at the front, the bolt head forms a breech face 127, which has a through bore 229 for a firing pin tip 130 in the center.

In addition, the bolt 103 has a bolt body 133, which surrounds the bolt head shaft 126 and thus has a central bore 134 in which the bolt head shaft is supported in rotary fashion. The bolt body 133 is supported in non-rotating fashion in a sleeve or chassis of the weapon so that a rotation between the bolt head shaft 126 and bolt body 133 can only be executed by the bolt head shaft 126 in the bolt body 133.

In order to ensure a defined rotation, a control cam is provided in an intrinsically known fashion in the bolt head shaft 126 as a control surface of a lateral control recess 135 (FIG. 5, 29-32). A control pin 136 extends through the control recess 135 and is positioned axially on the bolt head shaft 126, resting against the control surface 135 in the bolt body 133, or cooperates with it.

At its axial front end, the control recess 135 has an initially axially extending region 138, which has an axial length that corresponds at least to the diameter of the control pin 136 and then transitions into an oblique region 139, which is inclined relative to the longitudinal axis, until it reaches an axially rear stop region 140.

The inclination of the control recess 135 in the oblique region 139 is embodied so that a sliding of the bolt body 133 axially toward the front results in the fact that the control pin 136 travels out of the axial region 138 of the control recess 135 and is moved through the oblique region, sliding along it, and as a result, a rotation in the direction of fire occurs, toward the right in the instance shown.

The radial path length of the control pin 136 in the control recess 135, i.e. from an axial region 138 to the rear axial stop region 140 in this case, is selected so that it essentially corresponds to the radial depth to which the thread 116 of the cylinder segments 111 is screwed in.

This means that the radial length and movement of the control pin 136 corresponds to 60° when there are three symmetrical cylinder segments 111, corresponds to 90° when there are two cylinder segments 111, and would correspond to 45° if there were four cylinder segments 111. The axial length of the control recess 135 is selected so that only a reasonable amount of effort is required for the rotation on the one hand and on the other, the bolt repeating path is only prolonged to a minimal degree. In this case, in the open state of the breech system, a front edge 141 of the bolt body 133 is spaced apart from a rear edge 142 of the bolt head 125 by approximately the axial length of the control recess 135 and after the control pin has traveled out of the axial region 138 via the control recess 135 and its oblique region into the axially rear stop region, is preferably still spaced slightly apart from the bolt head 125.

The control recess 135 and control pin 136 can also be positioned on the components of the bolt head shaft 126 and bolt body 133 in the opposite way so that the control recess 135 is provided in the bolt head shaft 126 and the control pin 136 is provided in the bolt body 133. The essential thing is that by means of a control pin 136 and a control recess 135, a defined rotation of the bolt head or more precisely, of the bolt head shaft 126 in the bolt body 133 is assured.

In order to produce a twist-lock connection between the bolt head 125 and the bolt receiver 102, the bolt head 125 has thread segments 144 that correspond to the threads 116 or thread combs 117 of the cylinder segments 111. The thread segments 144 are thus embodied as external threads; between the thread segments 144 in a manner corresponding to the threads 116, flutes 145 are provided, whose flute bottoms reach to the thread bases between the thread combs 146 or extend even deeper than them. The individual thread combs 146 each have a front flank 147 and rear flank 148. The front flank and rear flank can be inclined according to the invention and in their inclination, can correspond to the inclination of the front flank 119 and rear flank 118 of the threads 117 cylinder segments 111.

This means that when the bolt head 125 is being pulled out of the barrel receptacle 102, the individual thread combs 117, 146 are pulled into one another because of the oblique planes.

In the region of a flute 145, the bolt head 125 and the bolt head shaft 126 have a continuous axial groove 149 for a cartridge ejector (not shown), which, when a cartridge is pulled out of the cartridge chamber with the aid of the bolt head 125 as the bolt 103 is drawn back, plunges into the groove 149, reaching to the breech face, and in it, presses against the cartridge bottom in a known way and thus conveys the cartridge out of the ejection window of a weapon.

Alternatively, the cartridge case can be ejected by a springy ejector that is built directly into the breech face 151 of the bolt head 125.

The thread combs 146 of the thread segments 144 of the bolt head 125 correspond to a thread helix that is continuous, but is interrupted by the flutes 145; on a thread segment 144 of the bolt head 125, one or two threads adjacent to a rear edge 142 of the bolt head 125 protrude into a flute 145 ahead of it in the rotation direction and form a stop surface 152 in order, in cooperation with a stop surface 122 of the bolt receiver 102, to form a radial screw-in stop.

In particular, several threads are superposed both on the bolt head 125 and on the bolt receiver 102 so that a multiple-start thread helix is formed. For example, three threads are superposed so that a triple-start thread helix is formed.

Since the thread segments 144 and the thread 116 of the bolt receiver 102 are part of a single-start or multiple-start thread helix, they are embodied differently on the individual thread segments so that adjacent to a breech face 151 smooth regions 50 are formed, which on the one hand, protrude beyond the breech face 151 and thus guide the cartridge radially and on the other hand, correspond in their respective axial and radial size to the smooth regions 121 and rest against them in the closed state of the breech.

The flute bottoms 145 of the flutes 145 can be embodied as flat or can be embodied as curved in accordance with the cylindrical curvature of the bolt head.

To begin with, the general cooperation of the bolt head 125 and the bolt-locking region 110 according to the embodiment in FIGS. 1 to 4 will be explained below. The bolt 103 is slid with the bolt body 133, the bolt head shaft 126 therein, and the bolt head 125 in the direction of the locking region 110. As a result of this, the flutes 145 of the bolt head 125 travel into the region of the cylinder segments 111 and the thread segments 144 of the bolt head 125 travel into the region of the slots 114 between the cylinder segments 111.

The slots 114 on the one hand and the flutes 145 on the other are dimensioned so that starting from this time, the bolt head 125 is guided axially and an axial pushing movement between the bolt-locking region 110 and the bolt head 125 is enabled. The axial insertion is possible until the from flank 147 of the thread comb or of the front thread comb, which protrudes into a flute 145, rests against an end wall 115. This blocks a purely axial motion of the bolt head 125 in the bolt-locking region 110. Through this blocking action, the control pin 136 in or on the control recess 135 is slid axially forward, as a result of which the control pin 136 rotates the bolt head shaft 126 corresponding to its sliding action along the control recess 135. Due to this rotation, the thread combs 146 of the thread segments 125 then travel between the thread combs 117 of the thread 116 so that a screwing-in thread engagement of all of the thread combs 116, 117 takes place simultaneously.

After a corresponding rotation by 60° (when there are three cylinder segments 111 and three thread segments 144), a radially front edge 152 of the thread comb 151 or of several thread combs protruding into the flute 145 comes into contact with the stop surface 122 so that the radial movement is stopped. In this state, the bolt head 125 is screwed-in in the bolt-locking region 110 in a locking fashion and an exclusively axial movement of the control pin 135 into the axial region 138 of the control recess 135 is preferably then still possible. This additional axial movement of the control pin 136 into the axial region 138 of the control recess 135 produces a kind of radial immobilization of the bolt head because due to the fact that the bolt body 133 is supported in a rotationally fixed manner in a sleeve or on a chassis of the firearm, the engagement of the control pin 136 in the axial region 138 then causes the bolt head to also be immobilized in a rotationally fixed manner in a first way so that without an active pulling-back of the bolt body 133, it is not possible for the bolt head 125 to rotate out of the bolt-locking region 110.

Usually, the bolt body 133 is also acted on by at least one compression spring, which is supported between the bolt body 133 and a bolt carrier 160 so that the control pin is pushed by a spring force into the axial region 138. This will be explained in greater detail at a later point.

This spring force preferably acts only in the region of the axial movement of the bolt head 125 inside the bolt receiver 102, i.e. as long as the threads 116, 144 are positioned in the slots 114 and flutes 145. As a result, the spring helps the threads 116, 144 "find" each other and screw into each other. In the axial movement range of the bolt head, in which it is rotated all the way into its unlocked rotation position outside of the bolt receiver, the rotary motion of the bolt head shaft 226 is blocked by an active, controlled locking pawl 241, which can engage in locking slits 153, 154 in the bolt head shaft 126 and thus neutralizes the spring force.

This arrangement ensures that the bolt head, as soon as it is able to rotate into the barrel extension, automatically rotates in the direction of the full locking. On the other hand, as soon as the bolt head has been brought fully into the unlocked rotation position by the repeating process, this spring force no longer acts on the rotary motion of the bolt head and the further repeating path. Also, with a recoil triggered by firing, this acts in the opposite direction from the withdrawal direction of the control pin from the axial region 138 so that it counteracts an unwanted partial rotation of the bolt head 125 out from the bolt-locking region 110 and the breech is fully locked automatically.

The locking pawl 241, which neutralizes the spring force acting on the rotary motion, can also preferably be controlled from the outside in the fully locked rotation position of the bolt head, blocking an unwanted opening of the breech by engaging in the locking slit 153, for example when transporting the weapon.

For this purpose, the locking pawl 241 can preferably be triggered by the shooter by means of the mechanical safety of the weapon or it is separately embodied. Since this breech locking acts directly on the bolt head, the locked engagement means such as a bolt thread directly inhibits any axial movement of the bolt away from the direction of fire.

For the flat contact and the axial guidance—even if it is possible according to the invention to enable a direct locking of the bolt head in a correspondingly shaped bolt-locking region 110 of a barrel end in front of the cartridge chamber—it is preferable for the breech system to be embodied to produce a locking between a bolt head 125 of a bolt 103 and a bolt receiver 102; the bolt receiver 102 is embodied as a barrel extension or barrel receptacle for the barrel of a firearm.

For this purpose, the bolt receiver 102, as already explained above, is embodied with a barrel thread on the inside. The barrel receptacle 102 according to the invention also has at least one or more ring segment-like protrusions 155 on an outer circumference surface 112, in particular three ring segment-like protrusions 155, which are positioned one after another axially.

These protrusions 155 serve to engage in correspondingly embodied grooves (not shown) of a corresponding receiving sleeve of a firearm. The circumferential wall 112 of the barrel extension 104 or bolt receiver 104 on the one hand and the protrusions 155 on the other ensure a long cylindrical guidance in a corresponding hollow, cylindrical receptacle (not shown) and the protrusions 155 ensure a correspondingly precise and durable axial immobilization. The receptacle for the barrel extension 104 in this case is preferably a clamping sleeve. The ring segments 155 serve as breech lugs of a sort and preferably have an arc length of somewhat less than 180°. In this case, both the bolt receiver 102 and the barrel extension 104 with a barrel screwed into it in the direction of fire are slid into a corresponding receiving sleeve, which is in particular embodied as a clamping sleeve, of a firearm in the direction of fire and are then rotated by 180° until the ring segments are positioned entirely in corresponding grooves. Then a corresponding clamping can be produced so that an immobilization in every spatial direction is achieved.

Through the installation direction of the barrel/barrel extension from the rear in the direction of fire, it is possible to embody any attachments for the weapon—such as the hand guard or forestock—so that they follow the shape of the barrel contour, by contrast with the prior art of systems with an installation direction from the front into the weapon opposite from the direction of fire, which use the largest cross-sectional area of the barrel as the minimum clearance around it.

Particularly with the prior art up to this point, this results from accessory installations in which the mounting parts, for example screws, protrude radially inward toward the barrel and so must either be removed from the system before removal of the barrel or whose attachment points [hand guard] require a corresponding additional cross-sectional enlargement with the accompanying enlargement of the weapon.

According to the invention, it has turned out that in systems with axially clamped barrels/barrel extensions, the axial tensile force is not sufficient to cause an unwanted axial movement opposite from the direction of fire due to the recoil force and on the other hand, the friction force that predominates toward the end of the passage of the bullet through the barrel is not sufficient to cause a movement of the barrel/barrel extension in the direction of fire, which results in unwanted position changes and affects the function and precision.

The invention has the advantage that an extremely substantial breech for a firearm is produced since the locking according to the invention between the threads 116 and thread segments 144 results in a very large breech surface, which, due to the inclination of the thread combs 117 and 146 also leads to an intensified interlocking when under load. It is also advantageous that the positioning of the thread combs 117, 146 together with the defined rotation of the bolt head results in an extremely precise, exact, suction-assist engaged locking. In order to further improve this, the thread combs 146—in the regions in which they face the thread combs corresponding to them—can have slight beveling at the end so that the thread combs 144, 117 can slide into one another with even greater ease.

The apparatus of a rotating bolt head action with a bolt head 125, a bolt head shaft 126, and a bolt body 133 also enables a large amount of variability in the firearm because the actuation of this bolt 103 can take place by means of a bolt handle of the same kind as a straight-pull bolt-action rifle but also with a gas-powered unlocking and a bolt repeating motion by means of recoil and/or gas pressure on the one hand and forward motion by means of a bolt-closing spring so that this concept can be used to produce manual, semiautomatic, and automatic weapons.

The entire breech design will be described in greater detail below.

As has already been stated, the structural unit composed of the bolt head 125 and the bolt head shaft 126 is held in an axial bore of a bolt body 133; the bolt body 133 can slide axially on the bolt head shaft 126 (and vice versa). In addition, the bolt body 133 supports the control pin 136, which, during the sliding motion along the control surface 135 or a correspondingly shaped control notch 135, produces a rotation of the bolt head shaft and thus of the bolt head.

In an advantageous embodiment, the bolt head shaft 126 on the one hand and the bolt body 133 on the other are supported on a bolt carrier 160. In this embodiment, the bolt head shaft 126 is supported on the bolt carrier 160 in a rotatable, but axially fixed way, while the bolt body 133 is supported on the bolt carrier 160 in an axially sliding, but rotationally fixed way.

The bolt carrier 160 has a bolt carrier plate 161 and protruding from it in the same direction, has two bolt carrier/longitudinal carrier arms 162, 163 and, protruding from them, respective ejector arms 364164, 165.

The bolt carrier plate 161 is a flat, plate-like component, which, in relation to the longitudinal span of the bolt head shaft 126 and the direction of fire, is embodied standing upright and has an essentially rectangular cross-section.

As a result, the bolt carrier plate 161 has a front wall 166, a back wall 167, two narrow side edges 168, a lower edge 169, and an upper edge 170.

Approximately in the middle between the narrow side edges 168, leading from a lower edge 169, there is a support opening 171 for a bolt head shaft. In this case, the support opening 171 has a circular segment-shaped region 173, which reaches from the back wall 167 to approximately half of the transverse center of the thickness of the bolt carrier plate 161. From the front wall 166, the opening 171 is embodied with straight engaging wall sections 173 on both sides, which, at the top, transition into an approximate arc 174 or are joined thereto.

The opening and in particular the round opening region 172 and straight wall sections 173 as well as the distance between them are dimensioned so that in the round opening region 172, an end region 174 of the bolt head shaft 126 is supported, while the straight wall sections 173 can engage as tongues 173 for a circumferential groove 75, which is positioned adjacent to the region 174 in the bolt head shaft 126.

This makes it possible to position the bolt head shaft 126 in the support opening 171 so that it is axially fixed, but able to rotate between the wall sections 173.

The upper edge 170 of the bolt carrier plate 161 has two steps 176, which extend obliquely upward and thus, spaced apart from the narrow side walls 168, increase the height of the bolt carrier plate 161 in an upward direction and at the top, lead into a top surface 177 extending parallel to the upper edge 170. A control surface 178 is embodied so that it slopes downward from the top surface 177 in the middle toward the back wall 167; the control surface 178 extends from the back wall 167 to approximately the longitudinal center of the top surface 177 and from there, is extended with a control projection 179, which has an upper rounded end. The purpose of the control surface 178 and control projection 179 is to tension the hammer of a lock (not shown) as the bolt returns.

Adjacent to the support opening 171, on both sides of the support opening 171, long grooves 180 that are rectangular in cross-section are let into the bolt carrier plate 161, which each extend parallel to the lower edge 169 and upper edge 170, a short distance toward the narrow side walls 168. From the lower edge 169, narrow, oblique wall sections 181 extend to the support opening 171 or more precisely, to a lower edge of the groove 180.

At the bottom, ending with the lower edge 169 of the bolt carrier plate 161, two bolt carrier/longitudinal carrier arms 162 extend forward perpendicular to the plane of the front wall 166 of the bolt carrier plate 161 on both sides of the support opening 171 and symmetrically relative to the transverse center. The bolt carrier/longitudinal carrier arms 162 are embodied as essentially block-shaped, with a flat outer wall 184, an upper wall 186 extending transversely thereto, a flat lower wall 187 initially extending parallel thereto, and an inward-facing wall region 185.

The outer walls 184 are spaced apart from the narrow side walls 168 so that a step is formed between the narrow side walls 168 and the outer walls 184.

The upper wall 186 and lower wall 187 are embodied extending parallel to the upper edge 170 and top surface 177, but spaced apart from the upper edge 170.

The lower walls 187 are embodied with an initially flat region so that they end at a lower edge 169 of the bolt carrier plate 161 and extend the latter toward the front.

The inner walls 185 are embodied so that they extend the oblique surfaces 181 adjacent to the grooves 180; in the inner walls 185, there are corresponding grooves 188 that extend the grooves 180. Upper wall sections of the inner walls 185 between the grooves 188 and the upper wall 186 are embodied as recessed relative to the straight wall sections 173.

The bolt carrier/longitudinal carrier arms 162 also have flat front surfaces 189, which are positioned extending parallel to the plane of the front wall 166 and back wall 167 of the bolt carrier plate 161.

From the front or end surfaces 189 of the bolt carrier/longitudinal carrier arms 162 to approximately one third the longitudinal span of the bolt carrier/longitudinal carrier arms 162 from the bolt carrier plate 161 to the end surfaces 189, the lower wall 187 is embodied as rounded, with a rounded region 190, which extends in a rounded, arc-shaped way from the outer walls 184 to the oblique surfaces 181.

The respective ejector arm 364164, 165 is placed onto the end surfaces 189 and likewise positioned extending toward the front. The ejector arms 364164, 165 are ring segment-shaped in cross-section, with a flat upper wall 192, a respective ring segment-shaped outer wall 193, and a ring segment-shaped inner wall 194.

The ejector arms 364 164 also each have a flat lower wall 196 and front end surfaces 195. The end walls 195 in this case extend parallel to the end walls 189, the upper wall 192 and the lower wall 196 respectively extend parallel to each other and parallel to the walls 186 and the flat regions of the walls 187.

The width of the ejector arms 364164, 165 between the ring segment-like outer walls 193 and inner walls 194 is for example approximately half the width of the bolt carrier/longitudinal carrier arms 162 in the region of their upper wall 186. The walls 193, 194 are thus recessed from the walls 185, 184; in the region of the oblique surfaces, the lower wall 196 ends along with them by means of a likewise oblique surface.

The shape of the ejector arms 364164, 165 is matched to the shape of the slots 114 between the cylinder segments 111 of the bolt-locking region 110 of the barrel extension 104 and bolt receiver 102 so that the ejector arms 364164, 165 engage in the grooves in a way that is as form-fitting as possible and thus are also shaped to fit the cylinder segments 111 so that in the closed state of the breech, of the barrel extension, and of the bolt receiver, this closes the arc of the cylinder segments 110.

Adjacent to the end surfaces 195, spaced approximately equidistantly between the walls 192, 196, a T-groove 197 is provided in such a way that the end walls 195 form corresponding undercuts 198 behind which the groove correspondingly widens into the shape of a T crossbar. In each of the grooves 197, a respective ejector claw is supported, which forms a flat back wall 200 for being supported against the flat end surface 195 or flat end wall 195 of the ejector arms 364164, 165 and toward the front, extending from a top to a bottom, is embodied with a curvature 201; the curvature 201 is embodied as rounded and if need be arc-shaped in such a way that it corresponds to a curvature at the end of the slots 114. The ejector claws 199 are therefore embodied so that they are able to move radially inward and outward in the T-grooves 197 by means of corresponding T-shaped formations 202, which extend away from the back wall 200.

From the groove bottom 203 oval or flat heart-shaped bores 204 extend longitudinally through the ejector arms 364164, 165, which also extend with an enlarged rounded cross-section through the bolt carrier/longitudinal carrier arms 162, 163 and also extend longitudinally through the bolt carrier plate 161.

As the bore 204 extends through the bolt carrier/longitudinal carrier arms and the ejector arms 364164, 165, a step (not shown) is provided, for example, as a counter support for an adjusting screw (not shown). By turning the adjusting screw (not shown), which is correspondingly screwed axially into the ejector claws 199 or acts on them by means of a cam, the ejector claws 199 can be moved outward or inward in the grooves 197 by means of the T-formation 202 so that either one ejector claw 199 or both ejector claws 199 can engage in an intrinsically known way in the ejector notch of a cartridge.

Preferably, only one ejector claw engages, which results in the fact that by means of a cartridge ejector (not shown) on the one hand and the ejector claw, which is present and engages on only one side, the ejection direction of the cartridge can be set toward one side or the other.

The ejector claw 199 has a respective outer wall 205; the outer wall 205 is shaped to correspond to the outer wall 193 so that in an outer position, in which it cannot engage in a cartridge ejector notch, the ejector claw ends flush with the wall 193, or in the outer position, in which it does not engage, it protrudes beyond the outer wall 193.

If the ejector claw is activated, its outer surface 205 is recessed relative to the outer wall 193 of the ejector arm 364164, 165 by the amount by which it protrudes inward or it ends flush with it corresponding to the second alternative described above.

The ejector claws 199 are positioned relative to the bolt head 125 in such a way that the bolt head is affixed to the bolt carrier plate 161 by means of the bolt head shaft 126 and its end or flute is also spatially positioned in relation to the breech face of the bolt head in such a way that an inward-extending engagement edge is positioned at the corresponding height of the cartridge ejector notch of a cartridge.

The bolt body 133 is a component with an essentially T-shaped cross-section, with one component region 210 extending transversely and one component region 211 extending essentially upright. The proportions in this case are approximately such that the width of the transversely extending component region 210 is approximately three times the width of the upright extending component region and the thickness of the transversely extending component region from bottom to top is approximately the length of the longitudinally and upright extending component region 211.

The transversely extending component region 210 here is embodied as plate-like, with a rear end wall 212, two longitudinal side walls 213, and a front end wall 214. Between the front and rear end walls 212, 214 and the longitudinal side walls 213, there is a lower wall 215.

Between the upper edges of the longitudinal side walls 213, there is an upper wall 216.

The upright extending component region 211 extends centrally downward from the middle of the lower wall 215, i.e. away from the lower walls 215, with side walls 217, which extend parallel to the side walls 213 of the transversely extending component region 210 and orthogonal to the lower wall 215. The side walls 217 here are spaced symmetrically apart from the side walls 213. The component regions 210, 211 have shared rear and front end walls 212, 214.

Between the end walls 217, there is a bottom wall 218 of the component region 211 and in its longitudinal middle, the bottom wall 218 has an aperture 219, which is embodied in the cylindrical bore 134 extending coaxially around the longitudinal axis of the bolt body 133 and a bolt head shaft 126.

The bottom wall 218 widens outward beyond the respective side wall 217 with a tongue section 220, which is respectively embodied as elongated and block-shaped and is positioned on the outer wall 217 and thus widens the outer wall 217 with a step 221. The distance between the step 221 and bottom wall 218 extending parallel thereto corresponds to the height of the groove 180 in the bolt carrier plate 161 and the bolt carrier/longitudinal carrier arms 162; the projection of the tongue elements 220 beyond the side wall 217 corresponds to the depth of the grooves 180. The elements 220 are thus correspondingly embodied to be received in the groove 180.

The height of the side walls 217 between the elements 220 and the lower wall 215 of the component region 210 is greater than the distance of the grooves 180 from the upper surface 186 of the bolt carrier/longitudinal carrier arms 162, 163 in the region of their inner walls 185 so that in the inserted state of the bolt body 133, a gap remains between the upper walls 186 of the bolt carrier/longitudinal carrier arms 162, 163 on the one hand and the lower wall 215 of the transversely extending component region 210 of the bolt body 133 on the other.

Consequently, the tongue projections 220 on the one hand and the grooves 180 on the other form a tongue-and-groove system with which the bolt body 133 can be positioned in the bolt carrier 160 in a longitudinally sliding fashion.

The upper wall 216 of the component region 210 thickens by means of two steps extending obliquely upward 224 to an upper top surface 225.

The steps 224 are each spaced slightly apart from the side walls 213 and in terms of their height and their shape, corresponding to steps 176; in terms of its lateral span, the surface 225 corresponds to the upper edge 177 of the bolt carrier plate 161 so that the correspondingly embodied edges end at the same time as each other. From one side, a for example rectangular transverse notch 226 is milled into a step 224 and feeds into a through bore 227, which is let into the bolt body 133, passing through it orthogonal to the upper top surface 225 and reaching to the bottom wall 218 of the component region 211 and thus passing all the way through the bolt body 133, for example vertically.

The bore 227 in this case has a diameter, which is matched to the outer diameter of a control pin 134; the bore is embodied so that in the region of the longitudinal bore 134, it extends laterally only partway in the wall 217 that delimits the bore 134 so that the control pin 136 reaches laterally into the bore 134.

Adjacent to the longitudinal side walls 213 there are spring receiving bores 229 extending all the way from the end surface 214 to the end surface 212. These bores 229 are embodied as wider in the region of the end wall 214 and are embodied as narrower in the region of the end wall 212. The bores 229 thus narrow in the course of their path from the end wall 214 to the end wall 212 with a step 232. In the narrower region of each bore 229, a respective pressure pin 230 is preferably provided, which is supported with a shaft 233 in the narrower region of the bore 229 and is positioned with a wider region 234, particularly in the form of a nail head, in the wider-diameter region of the bore 229. In this case, the pressure pin 230 is dimensioned so that on the one hand, in the narrower-diameter region of the bore 229, it has the diameter of the bore and is able to slide longitudinally in it, but is delimited by the step 232. When the wider region rests against the step, the pin preferably protrudes a desired amount beyond the end wall 212. In order to act on the pressure pin 230 with spring pressure, the wider region of the bore 229 contains a compression spring (not shown), in particular a spiral compression spring, which preferably has a diameter that corresponds to the inner diameter of the wider region of the bore 229. This compression spring is secured in the bore 229 under pressure by means of corresponding screws (not shown), which are screwed into a corresponding internal thread of the bore 229 in the vicinity of the mouth of the wider region of the bore 229 in the vicinity of the end surface 214.

If need be, the thread can reach deep enough into the bore 229 and the screw can be embodied as a set screw so that the spring pressure can be adjusted by screwing the set screw (not shown) to different depths.

In a home position, the screws, in particular set screws (not shown), preferably end at the end wall 214 and do not protrude beyond it.

Figure 15:
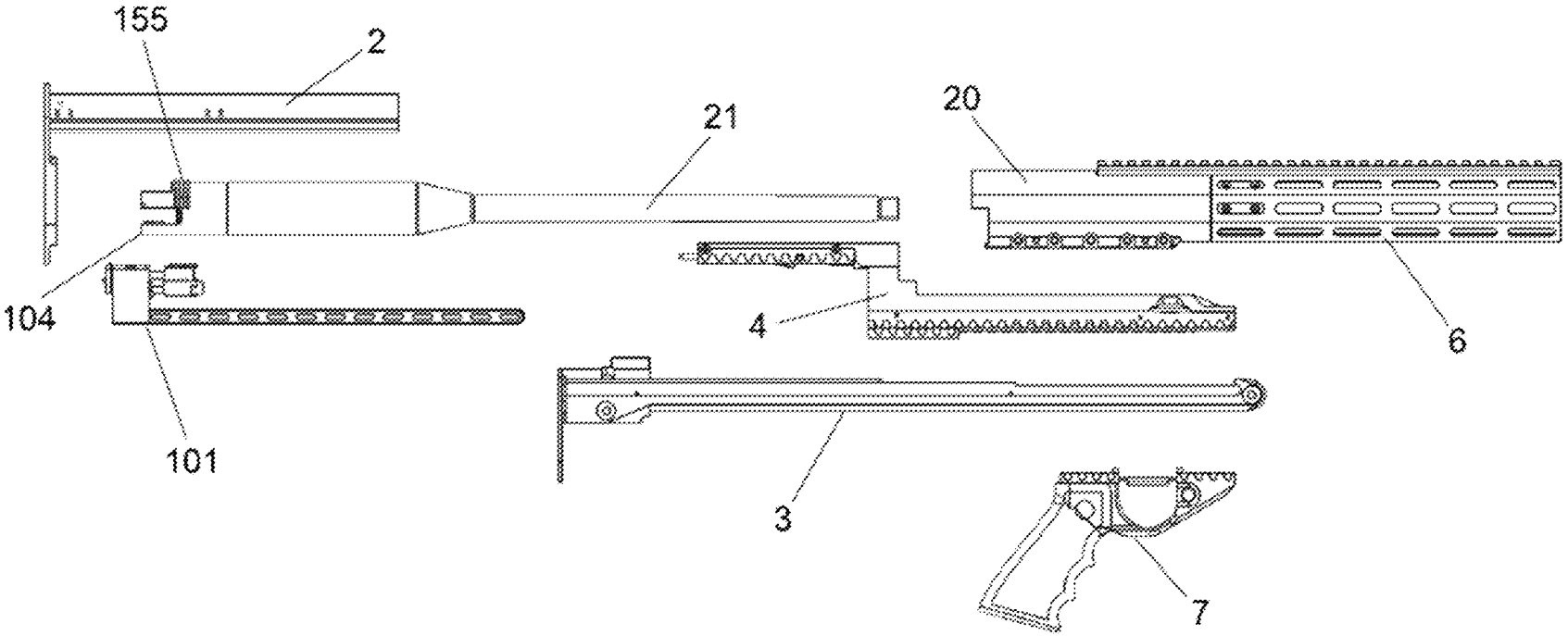
FIG. 15 shows another exploded view of parts of the firearm.

To support the pressure pins 230 flush with the bore 229, blind bores 131 are provided in the front wall 166 of the bolt carrier plate 160 (FIG. 15, 16), which engage with the free ends of the pins 230.

Adjacent to the bore 227, the upper top surface 225 is provided with a longitudinally extending slit 234, which extends axially into the bolt body 133 spaced apart from the end walls 212, 214. Adjacent to the end wall 212, the slit 234 pierces the component region 210 into the bore 134; the length of the piercing part of the slit makes up a quarter to a third or more of the total length of the slit 234. The mouth 235 of the slit 234 in the bore 134 is located, for example, in the longitudinal middle of the bore 134. A lateral channel 137 extends from an end 236 of the slit 234 situated closer to the end wall 214. In the channel bottom 238 of the channel 237, a vertical bore 239 is provided for receiving a spring and/or a spring-loaded pin. In addition, parallel to the slit 234, there is a flat rectangular channel 240 extending from the end wall 212 to the end wall 214; the rectangular channel 240 does not have the depth of the channel 237, toward a wall 213 and away from the slit 234, but ends at it and sweeps across it.

A locking lever 241 is supported in the slit 234 and the channel 237.

The locking lever 241 is a flat, oblong component, which is received in an upright position in the longitudinal slit 234 and is positioned so that it is able to tilt in the slit 234 around a rotation axis (not shown) in such a way that a catch projection 242, which is embodied at one end of the locking lever, extends downward through the mouth into the region of the bore 134 and can be pivoted into and out of this region of the bore 134.

For this purpose, at its opposite end, the locking lever 241 has an actuating lever 243, which can be supported in the channel 237 and in particular, is loaded by the spring supported in the bore 239 or by the spring pressure pin supported in the bore 239 and pivoted around its rotation axis so that the catch projection 242 is pivoted through the mouth 234 into the bore 134 by means of spring pressure.

The channel 240 serves to receive and guide an actuating element and a control surface with which the actuating lever 243 can be pressed into the channel 237 in opposition to the pressure of the spring supported in the bore 239 so that in the pressed-in state of the actuating lever, the catch 242 is pivoted through the mouth 235 out of the region of the bore 134; for the functionality of the breech, it is sufficient if an actuating element 246 is present.

On the lower wall 215 of the component region 210, in particular symmetrically between the longitudinal path of the bores 229 and the walls 217 of the component region 211 longitudinally or axially extending receiving slots 145 are provided, but these do not extend through to the walls 212, 214, their slot ends instead being spaced apart from them.

These slots 145 are each used to receive and affix a respective actuating element 246. The actuating element 246 has a connecting plate 247, which has a width that corresponds to the distance between the side wall 217 and the side wall 213. The connecting plate 247 also has a length that corresponds to the length between the end walls 212, 214 so that the plate completely covers the respective underside sections of the underside between the longitudinal walls 213 and the end walls 212, 214 on the one hand the side wall 217 on the other. On top, the connecting plates 247 each have a tongue element for engaging in the slots 245 so that the connecting plate 247 is affixed to the bolt body 133 in both the longitudinal and the transverse direction.

Transverse to the connecting plate 147, extending from an upper surface 216 of the component region 210 and ending flush with it, there is an outer plate 248, which has the same dimension in the longitudinal direction as the connecting plate 247 and is embodied of one piece with it. With a short region 249, the plate 248 completely covers the outer wall 213 and extends downward beyond the connecting plate 247 and bottom walls 218 to a lower edge 250, on which, protruding beyond an inner wall 251 of the plate 248, a connecting tongue 242 or connecting projection 252 is positioned, with which the actuating element 246 and thus the bolt body 133 can be attached to an actuating rail 253. The actuating rail 253 in this case has a corresponding recess 254 or a corresponding slit 254 in the region of the projection 252. The actuating rail 253 extends in the direction of the weapon toward the muzzle, i.e. toward the front, and at its front end, is used for attaching a bolt handle (not shown) so that the bolt can be started and moved from a region equipped with a bolt handle and situated very far forward on the weapon.

As has already been explained, a respective actuating element 246 and actuating rail 253 can be positioned on each bolt body side, but it is sufficient if the corresponding element is present on the side on which the shooter would have to carry out the repeating action.

Through the symmetrical embodiment, both of the actuating element 246 and of the actuating rail 253, a weapon can be adapted to the needs of the shooter by positioning these elements on the respective side of the bolt body.

If for reasons of symmetry, two actuating elements 246 and two actuating rails 246, 253 are present, then it is sufficient, for example, to relocate the bolt handle from the one side to the other.

If only one actuating element 246 and thus also only one actuating rail 253 is positioned on the bolt body, then only one connecting plate is present on the other side in order to be able to close the slit between the underside 215 or lower wall 215 of the component region 210 on the one hand and the upper wall 186 of the bolt carrier/longitudinal carrier arms 162, 163 on the other and to produce a form-fitting engagement.

In the assembled state, the actuating element 246 with the actuating plate 248 rests against the respective outer wall 184 of the bolt carrier/longitudinal carrier arms 162, 163 and extends beyond their lower walls 187.

The function of the breech should be explained once again below.

According to the second embodiment, first and second locking slits 153, 154 are positioned in the bolt head shaft 126 (FIG. 31).

The first and second locking slit 153, 154 are axial slits in the surface of the bolt head shaft 126, which are embodied so that they can correspond to the catch 242 of the locking lever 241. In FIGS. 29, 30, 31, and 32, the control pin 136 and the locking pawl 241 are each shown only with regard to their function, but not their complete spatial positioning in the bolt body 133 in order to be able to better explain the function.

The first and second locking slit 153, 154 are embodied axially offset from each other and also radially offset from each other; the second slit 154 is farther away from the bolt head 125 than the first slit 153, but is positioned before the first slit 153 in the rotation direction of the bolt. In this case, the axial spacing of the slits 153, 154 corresponds to the depth to which the bolt threads are screwed into each other, while the radial spacing corresponds to the arc length that the bolt travels in the screwing-in direction until the end of the screwing-in motion. This means that with an opening or closing angle of 60° of the bolt head in the bolt receiver, the arc spacing between the two slits 153 and 154 is likewise 60°.

Figure 20:
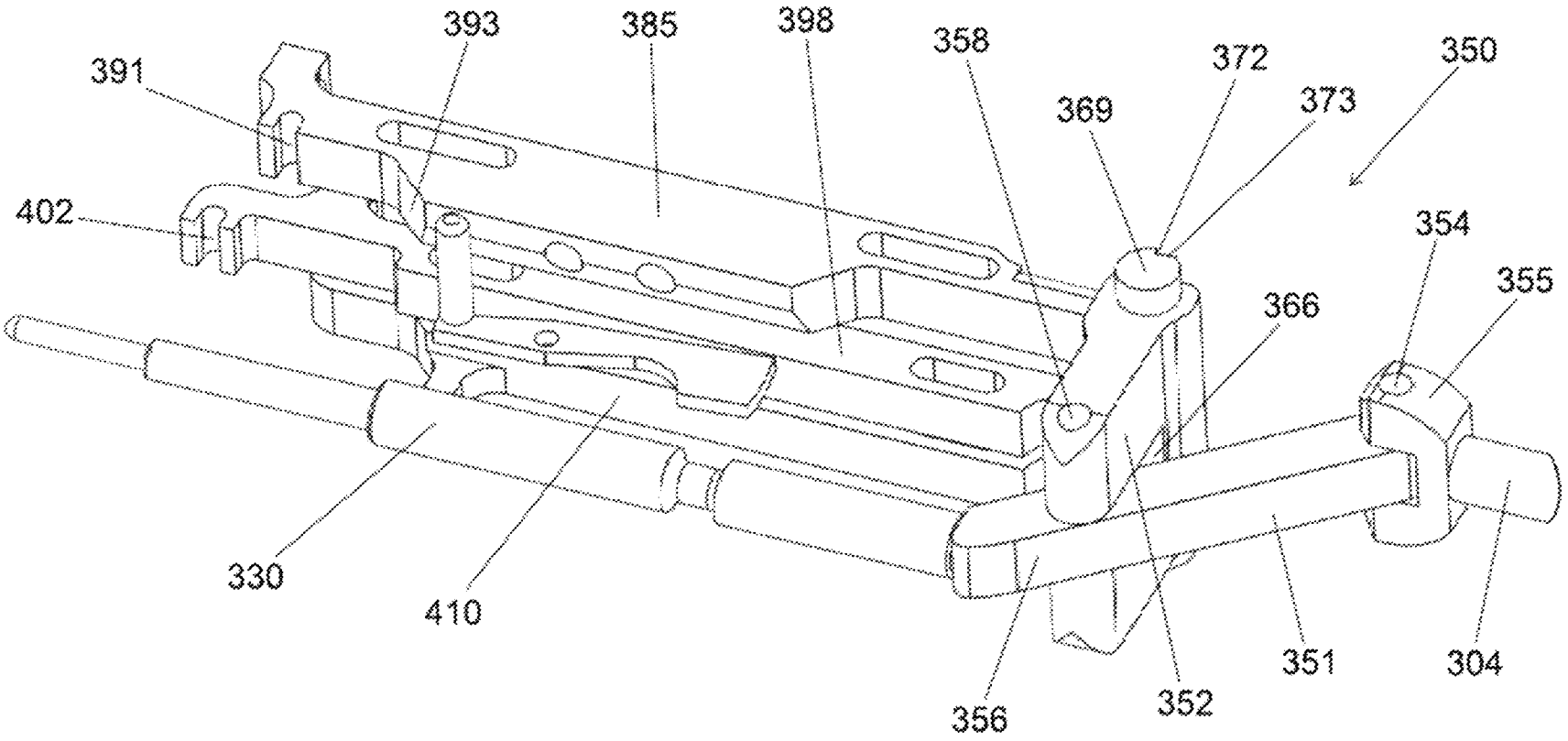
FIG. 20 shows the embodiment according to FIG. 11 in a view from beneath.

As already explained, the rotation of the bolt head 125 is produced by means of an advancing motion of the bolt body 133 (not shown in FIGS. 29 to 32). In this case, the bolt body slides on the bolt head shaft 126; the control pin 136, which rests (FIG. 21) in its control pin bore 227 (FIG. 20), slides along the control surface 135 and forces the bolt head 125 into a rotary motion toward the right (in FIGS. 29 to 32). The initial position is shown in FIG. 30.

In this case, the control pin 136 rests against the axial formation 140 of the control surface 135. With the forward motion, the rotation of the bolt head 125 according to FIGS. 29 and 30 takes place. The inclined surface 139 of the control surface 135 in this case is shaped exactly so that the angular offset between the axial regions of the control surface 135, namely the regions 140 and 138, corresponds to the angular offset (60° in in this case), that is traveled by the bolt head 125 when it is screwed in all the way.

Both the open position (FIGS. 30 and 32) and the closed position (FIGS. 29 and 31) are preferably lockable.

In the open position, it is possible for the bolt to be slid all the way to the stop with its flutes 145 in the region of the thread 116 of the bolt receiver and for its threads 144 to be slid all the way into the slots 114. In order to then cause the threads 116, 144 to travel all the way into each other, the corresponding rotation of the bolt head is required. This position is then the closed position corresponding to FIGS. 29 and 31.

In the open position (FIGS. 30 and 32), the locking lever 241 is able to lock this position with the catch projection 243 then the latter engages in the slit 154. This is caused by the fact that the actuating lever 243, which is embodied at the opposite end of the locking lever 241, is spring-loaded and thus can allow the catch projection 242 to protrude into the slit 154 by means of spring pressure. In this position, a movement of the bolt body 133 against the bolt head shaft 126 is not possible since bot a radial motion and an axial motion are inhibited by the locking lever 241.

If the locking lever 241 is lifted out of the slit 154 due to pressure on the actuating lever 243 from above, then the locked and closed position of the breech shown in FIGS. 31 and 29 can be produced in which the spring-loaded actuating lever 243 once again pivots the locking lever 241 so that this time, the catch projection 242 protrudes into the slit 153 positioned axially more toward the front.

As already explained above, however, the rotary motion of the bolt head is particularly aided or produced by compression springs acting between the bolt carrier 160 and the bolt body 133.

The locking lever 241 can particularly be actuated by means of the lock of the firearm and in this case, particularly also the safety slider or lever so that when the safety is activated, the closed position and/or the open position are locked. The locking of the open position is particularly useful if a spring pressure acts between the carrier and the bolt body as provided according to the invention since otherwise, this spring pressure may possibly cause a rotary motion into the closed position.

Preferably, the locking lever 243 is pivoted so that the moment the bolt head protrudes into the bolt receiver, the bolt head is released. A rotation of the bolt head would then be possible, but is inhibited until the position is reached in which the threaded sections can slide into one another.

With the invention, it is advantageous that by means of the modular design of the bolt composed of a bolt head 125 with a bolt head shaft 126 on the one hand and with a bolt carrier to which the bolt head shaft is axially fixed as well as a bolt body, which is able to slide axially to a limited degree on the bolt carrier and on the bolt head shaft 126, an extremely reliable system is achieved, which has a very high operational safety and ease of maintenance and by means of the clever arrangement of the mechanical elements—particularly also of the externally actuatable locking lever—enables an error-free function and error-free, simple operability.

The lock system according to the invention of the firearm according to the invention is described in the following.

The lock system 350 comprises the toggle lever arrangement by means of a hammer lever arm 351 and a guide lever arm 352. The hammer lever arm 351 is an elongated component, which at one end 353 is connected to the hammer bar 304. At the end 353, the hammer lever arm 351 can be pivoted around a rotation axle 354 that passes through two cheeks 355, which are positioned at one end of the hammer bar 304 and embrace the end 353 between themselves, and passes through the end 353. Consequently, the hammer lever arm 351 can be pivoted around the axle 354 or shaft 354.

At a diametrically opposing end 356 of the hammer lever arm 351, there is an angled hammer surface 357. Spaced apart from the end 356 and from the hammer surface 357 toward the end 353, but spaced significantly less far from the end 356, there is a guiding rotation shaft 358, which passes through the hammer lever arm 351. The free end 356 of the hammer lever arm, which protrudes beyond the shaft 358 and has the hammer surface, thus constitutes the actual hammer.

With the guiding rotation shaft 358, the hammer lever arm 351 is mounted on the guide lever arm 352 in pivotable fashion.

The guide lever arm 352 is a flat, plate-like element with two side surfaces 360, 361, a top 362, a bottom 363, a front end region 364, and a rear end region 365. An accommodating slot 366 for accommodating the hammer lever arm 351 extends from the rear end region 365 to the front end region 364 over a partial length of the guide lever arm 352 approximately in the middle between the two side surfaces 360, 361. In the region of the rear end region 365, a transverse bore 367 is provided, which extends through from the surface 360 to the surface 361 and serves to accommodate the guiding rotation shaft 358.

The front end region 364 of the guide lever arm 352 is embodied as rounded and thickened between the surfaces 360 and 361 so that the surfaces 362, 363 as well as the top 362 and bottom 363 in the region of the end 364 thicken to form a more cylindrical region 368.

Extending laterally beyond each of the side surfaces 360, 361 361 and positioned quasi-concentric to the cylindrical region 368, the thickened cylindrical region 368 of the front end region 364 has respective cylindrical shaft stubs 369, 370 that define a guide lever arm rotation axis 352. By means of the axle stubs 369, 370, the guide lever arm 352 is mounted in rotatable fashion on a chassis of a firearm (not shown).

Approximately at the same height and along the span of the rotation axis 371, the cylindrical region 368 is provided with a latch step 372, which extends along the rotation axis 371 and partway into the region 368 and thus also extends into the shaft stubs 369, 370. The latch step 372 also forms a wall 373 that is orthogonal thereto, which extends upward from the latch step 372.

The latch step 372 here preferably extends inclined slightly downward toward the outside relative to the top 362 of the guide lever arm 352 and the bottom 363 thereof.

In relation to the plane that is defined between the rotation axis 371 on the one hand and the rotation axle of the receiving bore 367 and the axis of the shaft 358 on the other, the latch step 372 is inclined downward toward the outside at an angle of 3 to 25°.

Extending obliquely downward from the wall 373 to the surface 363 and approximately in the transverse middle of the guide lever arm 352 between the ends 364 and 365, a threaded bore 374 is provided, which serves to accommodate a grub screw that can be screwed in to adjust the latch length and thus the trigger travel to a sear bar that will be described in greater detail below.

The bore 374 in this case is positioned closer to a surface 361, i.e. between the surface 361 and the slot 366, adjacent to the slot 366.

Between the surface 360 and the slot 366, a recess from the front 364 is provided in the underside 363 and extends, for example, across approximately half of the span of the guide lever arm 352 from the front 364 toward the back 365. The recess is embodied so that in this region, a relief is provided in the underside 363 including the cylindrical region 368. From the underside of the cylindrical region, the recess 375 extends into the guide lever arm 352, the recess 375 having a recess roof 376 toward the top 362. The recess roof 376 has a front region 377, a rear region 378, and a transition 379 between them. The front region 377 extends in semicircular fashion from the wall 373 into the cylindrical region 368 of the guide lever arm 352, with the front region 377 in this case extending obliquely to a top of the cylindrical region 368. Approximately at the height of the shaft stubs 369, 370, the front recess roof region 377 reaches the transition region 379 in which the spatial orientation of the recess roof 376 changes so that the transition region 379 extends to a recess end 380 of the rear recess roof region 378 in the direction toward an underside 363, likewise with a semicircular cross-section oriented toward the recess 380 so that the front recess roof region 377 and the rear recess roof region 378 are inclined relative to each other at an angle, in particular at an angle of 25° to 50°.

It goes without saying that for practicability reasons and particularly for production reasons, the recess roof 376 is embodied as semicircular or in the form of a segment of a circle, but these regions can easily also be embodied as flat.

In the assembled state (FIG. 5), the hammer lever arm 351 and the guide lever arm 352 comprise the toggle lever arrangement. In this case, the guide lever arm 352 can be pivoted up and down around the shaft stubs 369, 370, the hammer lever arm 351 can be pivoted up and down around the shaft 354, and the two are connected to each other via the shaft 358.

The toggle lever arrangement composed of the hammer lever arm 351 and the guide lever arm 352 in this case is acted on with spring force by means of the hammer bar 304 and a mainspring (not shown) positioned around it.

In this case, the guide lever arm 352 is mounted on the chassis of a firearm by means of the shaft stubs 369, 370 while the hammer lever arm 351 and the hammer bar 304 are able to move to a limited degree in the direction of fire and away from the direction of fire by pivoting the toggle lever arrangement.

Figure 11:
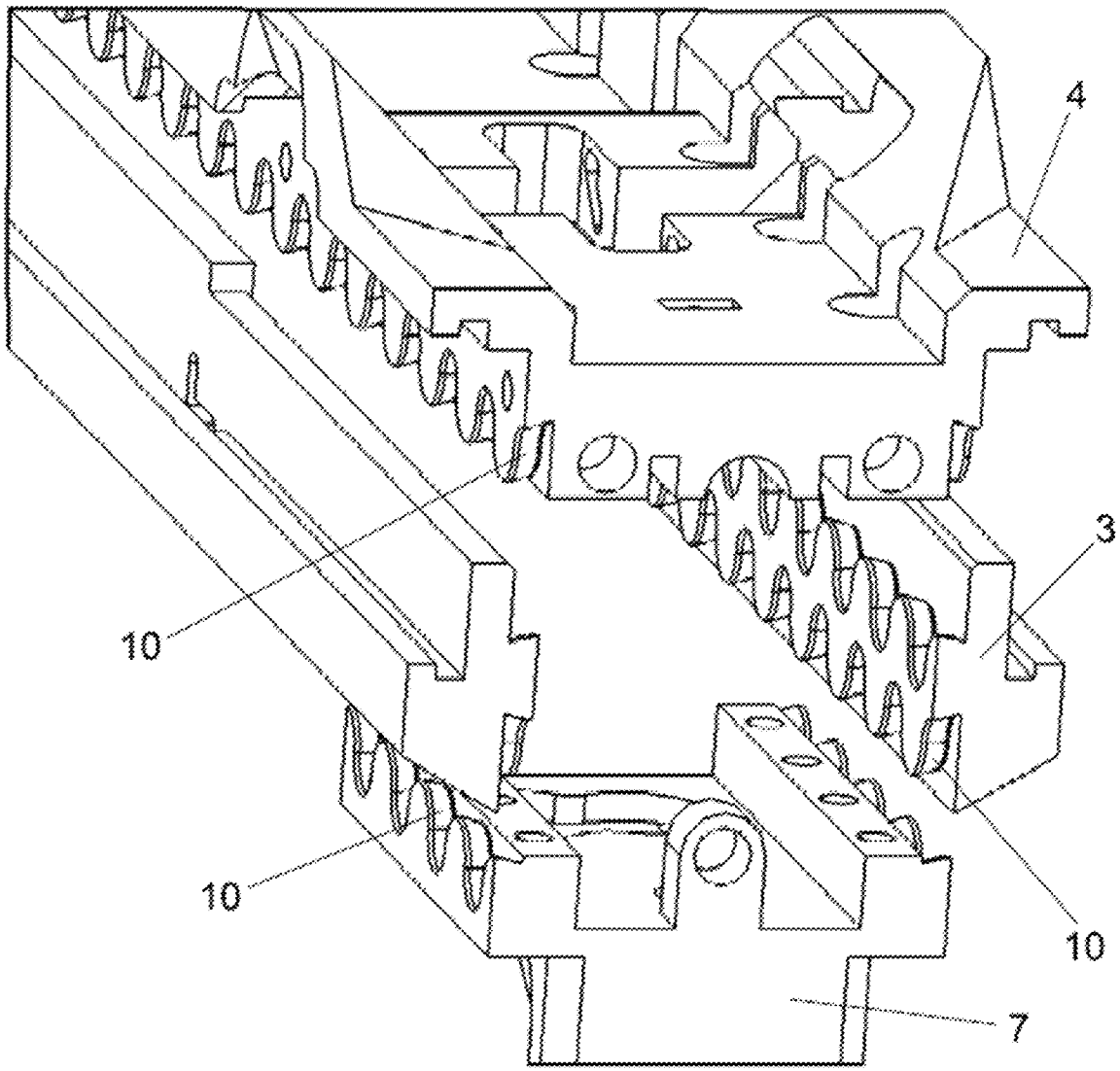
FIG. 11 shows a partially sectional perspective view of the length adjustment.
Figure 12:
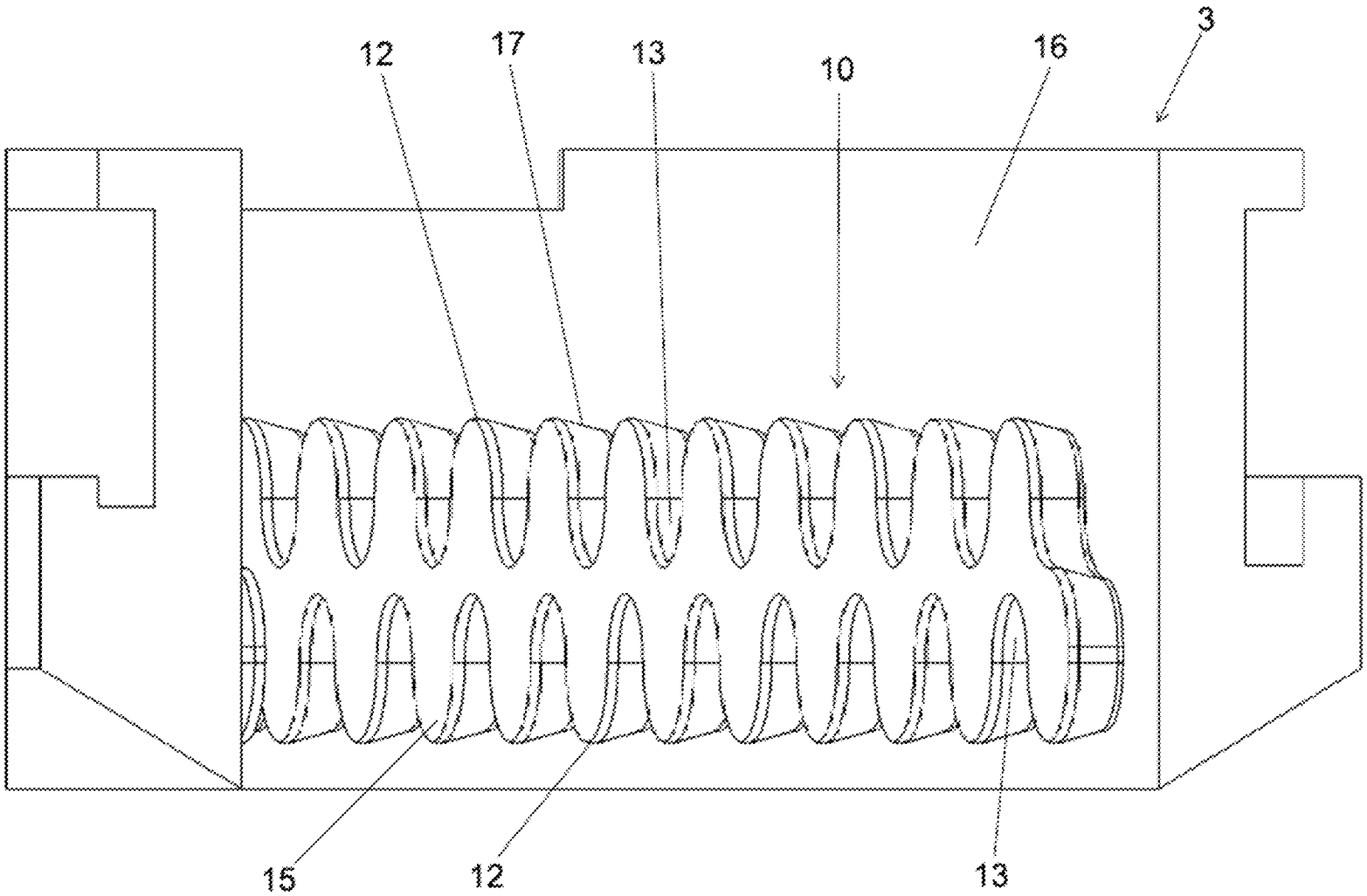
FIG. 12 shows a perspective view of the central element of the length adjustment.

Analogous to the toggle lever arrangement described at the beginning, the toggle lever arrangement composed of the hammer lever arm 351 and guide lever arm 352 is in an activated-safety position when the shaft 358 is positioned above the shaft stubs 369, 370 (FIGS. 5, 6, 7), is in a deactivated-safety, ready-to-fire position when the shaft 358 or its rotation axis is positioned below the shaft stubs 369, 370 or their rotation axis (FIGS. 8, 9, 10), and is in a fired position (FIGS. 11, 12, 13) when the rotation shaft or guiding rotation shaft 358 is positioned partially below or entirely below the shaft stubs 369, 370 as a result of which, the hammer bar 304 is positioned the farthest forward in the direction of fire and the hammer surface 357 of the end 356 of the hammer lever arm 351 serving as a hammer is positioned so that it is resting against a firing pin 330 (FIGS. 11, 12, 13).

In order to pivot the guide lever arm 352 and thus bring about the activated-safety and deactivated-safety position, a safety rod 385 is provided. For example, the safety rod 385 is embodied as elongated and has a square and/or rectangular cross-section with a top 386 and a bottom 387. Parallel to the top 386 and bottom 387, the side walls 388 are provided with continuous guide slots 389, which have corresponding bolts, shafts, or the like (not shown) passing through them and hold the safety rod 385 so that it is able to move axially, but is otherwise stationary relative to a firearm chassis.

The safety rod 385 has an end 390 oriented toward the front of the firearm; in the region of the front end 390 at the bottom 387, a recess 391 is provided for the lever 242 (not shown) that has already been described in connection with the first embodiment.

The safety rod 385 also has a back end 392.

Between the front end 390 and the back end 392, adjacent to the recess 391 toward the back end 392 and approximately at the height of a slot 389, the bottom is embodied with a control surface 393, which widens out the safety rod with a kind of ramp at its height between the bottom 387 and top 386 starting from the region of the recess 391.

In the region of the end 392, the safety rod 385 is embodied with a rounding 394 on its top 386; for example, the rounding 394 is embodied as semicircular and/or has at least two oblique surfaces 394, the free end 392 of the top being embodied with a control bead 395, which protrudes in a rounded shape at the top.

The bead 395 is embodied so that it can cooperate with the recess 375 and especially with the recess roof 376 and in particular, has a corresponding shape such that it can cooperate as it rests against the recess roof 376 in the most form-fitting, full-contact way possible.

The width of the safety rod 385 is dimensioned so that it corresponds to the width of the recess 375 or is slightly smaller; the bead 395 is curved in such a way that it can cooperate in sliding fashion with the front recess roof region 377 and the rear recess roof region 378; and with a flat embodiment of the roof regions, the bead is optionally only arched in the longitudinal direction, but is flat in the transverse direction.

Figure 8:
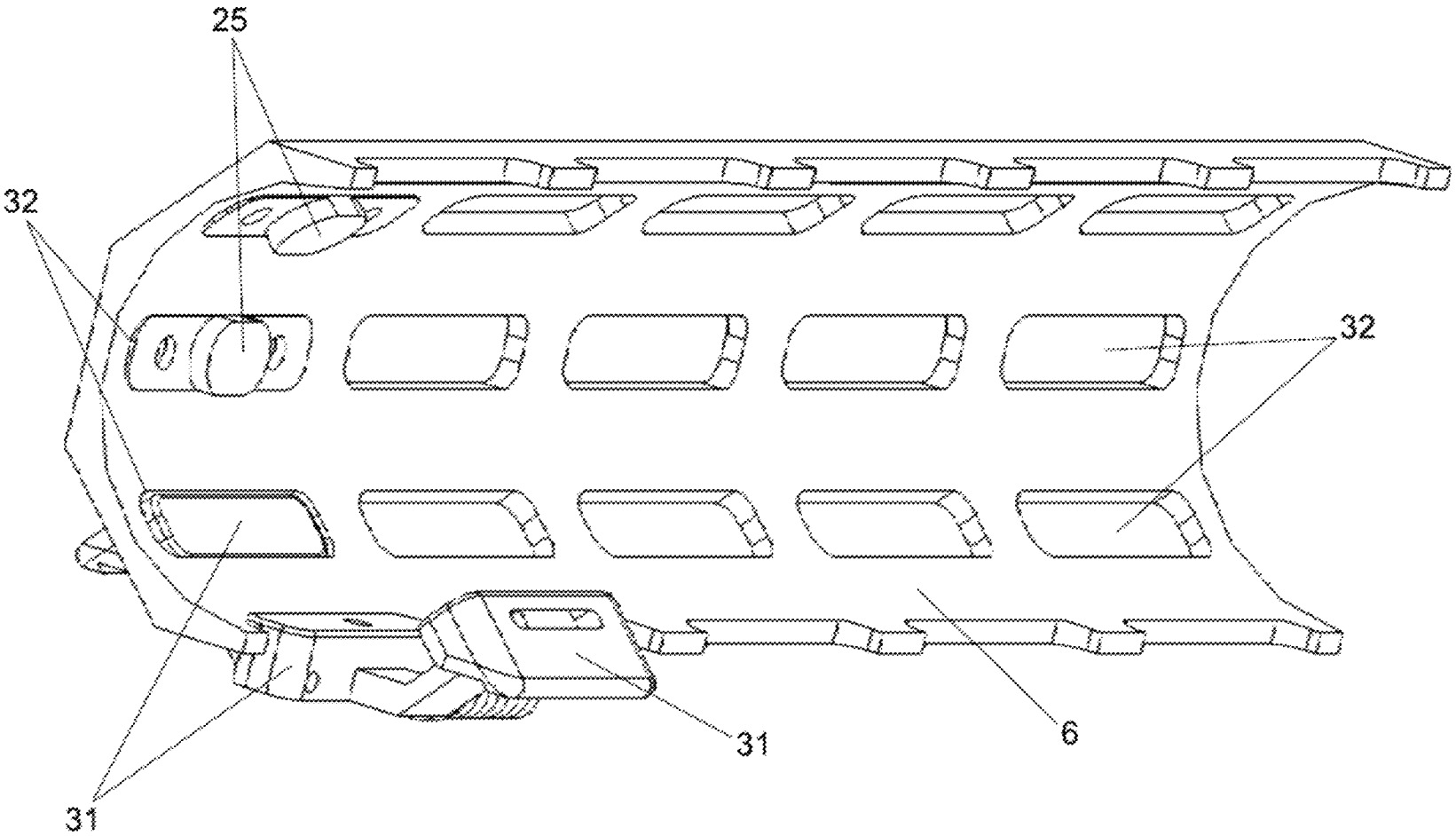
FIG. 8 shows a perspective view of the fastening devices of a hand guard and mounting device according to the invention.

The safety rod 385 in this case functions as follows. A starting position is the deactivated-safety, cocked position of the lock, in which—for example after the loading or a firing and the repeating motion—the lock is in a ready-to-fire state (FIGS. 8, 9, 10).

In this position, the control bead 395 is positioned at the entry to the recess 375 in the region of the wall 373. The guiding rotation shaft 358 is positioned below the rotation axis 371 of the guide lever arm 352. If the lock is to be secured, the safety rod 385 is then slid away from the direction of fire into the recess 375. As a result of this, the bead 395 first slides on the top along the front recess roof region 377 before it travels into the transition region 379 and then comes into contact with the rear recess roof region. Since the safety rod 385 cannot move up or down out of the way, with a further forward movement, the guide lever arm 352 is pivoted around the rotation axle since the bead 395 slides along the obliquely extending rear recess roof region 378 and as a result, it lifts the guide lever arm 352. Through this movement, the toggle lever arrangement com-posed of the hammer lever arm 351 and guide lever arm 352 is slid toward the hammer bar 304 in opposition to the pressure of the mainspring (not shown) and in is brought into the region of the dead point in which the toggle lever arrangement has its greatest length. As the bead 395 is slid further into the recess 375, the guide lever arm and the hammer lever arm are pivoted upward beyond the dead point (assisted by the mainspring) so that the activated-safety position (FIGS. 5, 6, 7) is achieved in which in particular, the front recess roof region 377 is supported on a top 386 of the safety rod 385 so that a further pivoting is not possible. The toggle lever arrangement composed of the hammer lever arm 351 and guide lever arm 352 is secured in this position by the pressure of the mainspring (not shown). Also in this position, the bead 395 rests against the rear recess roof region from underneath in the region of the end 380 of the recess and also inhibits a pivoting as a result. This state is thus secured in two ways.

In order to switch from this activated-safety position (FIGS. 5-7) back into the ready-to-fire position, the safety rod 385 is moved in the direction of fire, which causes a front side 396 of the bead 395 to first travel into the region 379 and then into the region of the front recess roof region. The front recess roof region is then deflected by the front side 396 of the bead 395 in opposition to the force of the mainspring (not shown) and as a result, the toggle lever arrangement composed of the hammer lever arm 351 and guide lever arm 352 is initially deflected to the dead point in which the mainspring experiences the most powerful compression and the toggle lever arrangement has its greatest elongation relative to the longitudinal axis of the weapon.

After the front side 396 of the control bead 395 has fully pivoted the front recess roof region 377, the shaft 358 is once again positioned below the rotation axis 371. In this state, the toggle lever arrangement composed of the hammer lever arm 351 and guide lever arm 352 is not held by the safety rod 385, but rather by a sear bar 398.

The sear bar 398 is parallel to the safety rod 385, but is positioned approximately in the transverse middle of the guide lever arm 352. The sear bar 398 is likewise a rod with a square and/or rectangular cross-section, with a front end 399 and a rear end 400. Flush with the transversely extending recesses 389 of the safety rod 385, the sear bar has recesses 401, which have the same pins passing through them as the recesses 389 in order to enable an axial movement, but inhibit a movement up or down.

In the region of the front end 399, the sear bar 398 has a recess 402 for a lever 306, with which it is possible to actuate the sear bar from the underside of the weapon.

At its free end 400, the sear bar has a region with a flat bottom surface (not shown), which is embodied in the same way as the first embodiment of a sear bar so as to cooperate with the latch step 372 of the guide lever arm 352 to inhibit a rotation of the guide lever arm 352.

In this case, a front end surface 403 of the sear bar 398, which is usually orthogonal to the bottom surface, can rest against the wall 373 in the region of the bore 374. By means of a screw positioned in the bore 374, it is possible to adjust the position of the sear bar 398 and in particular the degree of overlap between the latch step 372 and the lower surface in the region of the free end 400 of the sear bar 398.

In the region of their front ends 399, the sear bar 398 and the safety rod 385 can each have an abutment 404 on top, each of which has a receiving bore 405, in particular for a compression spring (not shown) that exerts pressure on the safety rod in the direction toward an activated-safety position and on the sear bar in a locked position. For the sear bar, these compression springs are optional, not mandatory.

In an advantageous embodiment, the lock 350 also has a locking rod 410.

The locking rod 410 extends parallel to the sear bar 398 and is embodied and functions in the same way as a sear bar 398; an abutment 404 and a receiving bore 405 for a compression spring (not shown) are also provided. In addition, the locking rod likewise has a bottom surface (not shown) and an end surface 403 with which the locking rod can be brought into engagement with the latch step 372 in the same way as the sear bar. On the underside, the locking rod 410 has a control projection 411 with which the locking rod can be brought into and out of the latched engagement and thus the locked position.

The purpose of the locking rod is to inhibit the lock from being released when the bolt is not in a forward position, but is instead positioned behind the lock in the direction of fire relative to the longitudinal axis of the weapon. If the weapon were fired in this state and the bolt were subsequently moved toward the front, then the bolt would travel from the rear and come into contact with the fired hammer lever arm 351 and might possibly damage the lock.

This embodiment has the advantage that because the toggle lever is composed only of the hammer lever arm 351 and the guide lever arm 352, this ensures a relatively simple embodiment of the toggle lever arrangement.

It is also advantageous that the bore in the guide lever arm permits a very reliable, but also force-reducing activation and deactivation of the lock.

It goes without saying that the above-described geometrical embodiment of the hammer lever arm 351 and guide lever arm 352 can also be modified for the sake of the practicability of the invention and in particular, can be simplified significantly.

The invention claimed is:

1. A firearm, in particular for shooting cartridge ammunition, the firearm comprising a weapon chassis (3), a magazine well (8) on the weapon chassis (3), and a weapon system support (4), each respectively comprising a corresponding engagement contour (10) having a spacing pattern by means of which the weapon chassis (3) and the weapon system support (4) can be axially positioned differently relative to each other to change a length of the magazine well in order to adapt to different cartridge lengths.

2. The firearm according to claim 1, characterized in that a plurality of bores (41) are provided in the respective weapon chassis (3) and weapon system support (4) such that the corresponding engagement contours (10) are securable relative to each other by one or more bolts extending through at least one of the plurality of bores (41).

3. The firearm according to claim 1, comprising:

a bolt having a bolt travel path between a forward position in which the bolt seals a cartridge chamber and a rearward position in which the bolt allows insertion of a cartridge from a magazine;

a hammer configured to fire the firearm;

a safety mechanism configured to inhibit motion of the hammer;

characterized in that the hammer and the safety mechanism are positioned above the bolt travel path.

4. The firearm according to claim 1, characterized in that the weapon chassis (3) and/or the weapon system support (4) are embodied as longitudinally divided and screw-connectable.

5. The firearm according to claim 1, characterized in that the magazine well (8) on the weapon chassis (3) is embodied in such a way that at a rear transverse edge of the magazine well (8), a magazine mount (9) for detachably mounting a magazine (55) is provided and at the front, the magazine well (8) is delimited by a base plate (50), which is positioned on the weapon chassis (3) by means of a spacing pattern using corresponding engagement means comprising corresponding contours (10); to change the length of the magazine well (8) in order to adapt to different cartridge lengths, a shoulder support device (2), which is vertically movable and detachable, is axially affixed to a receptacle (56) on the weapon chassis (3) at one end and, by means of corresponding contours (10), are movable axially relative to the weapon system support (4).

6. The firearm according to claim 1, characterized in that the weapon chassis (3) and the weapon system support (4) are positioned one after the other from bottom to top, the firearm comprising:

a bolt having a bolt travel path between a forward position in which the bolt seals a cartridge chamber and a rearward position in which the bolt allows insertion of a cartridge from a magazine;

a pistol grip assembly (7); and a shoulder support device (2) that constitutes an end of the firearm at its rear;

wherein at a location above the bolt travel path, each of the weapon chassis (3), the weapon system support (4), the pistol grip assembly (7), and the shoulder support device (2) has a respective corresponding engagement contour (10), which permits a length adjustment by means of a spacing pattern.

7. The firearm according to claim 1, characterized in that a plurality of engagement contour elements are provided on at least a first one of: a shoulder support device (2), the weapon chassis (3), the weapon system support (4), a weapon system apparatus (5), a pistol grip assembly (7), and a base plate (50); the plurality of engagement contour elements extending transversely relative to a longitudinal axis of the firearm and arranged in a spacing pattern; and a correspondingly shaped engagement contour (10) is provided on at least a second one of: the shoulder support device (2), the weapon chassis (3), the weapon system support (4), the weapon system apparatus (5), the pistol grip assembly (7), and the base plate (50); wherein the engagement contour (10) is arranged in a corresponding spacing pattern relative to the plurality of engagement contour elements.

8. The firearm according to claim 1, characterized in that each engagement contour (10) has a top and a bottom and comprises double projections, both on the top and on the bottom, each arranged in a respective spacing pattern wherein the respective spacing patterns correspond to one another and are offset from each other by a half a space of the spacing pattern such that crests (12) of the projections on the top align with troughs (13) of the projections on the bottom.

9. The firearm according to claim 1, characterized in that on the weapon chassis (3), the engagement contour (10) has a top and a bottom and is embodied as doubled, with one engagement contour pointing toward the top and one engagement contour pointing toward the bottom, in the form of wave formations (11) that extend transversely to a longitudinal axis of the firearm and are offset relative to each other; both on the bottom and on the top, respective wave crests (12) and wave troughs (13) are arranged in alternation so that transversely to the longitudinal axis, a wave crest (12) on the bottom is aligned with a wave trough (13) on the top; and between the wave troughs (13) of the top and bottom, which are offset relative to one another, there is a connecting piece (14).

10. The firearm according to claim 1, characterized in that the corresponding engagement contour (10) comprises wave crests (12), wave troughs (13), wave tips (17), and flanks and is integrally embodied of the material of the weapon chassis (3) or the weapon system support (4), respectively, or is embodied as being placed on rails and protrudes inward or outward by 2 mm; the distance between equivalent flanks of the wave crests being 10 mm.

11. The firearm according to claim 10, characterized in that from an outside (15) of at least one corresponding engagement contour (10), the wave crests (12) and wave troughs (13) are inclined toward a wall (16) of the weapon chassis (3) or the weapon system support (4), respectively, so that an angle is formed such that the inclination of each corresponding engagement contour (10), respectively, is the same in a region of around the wave tips (17) and in a region around the wave troughs (13), while in a region between the wave troughs and the wave tips, the contour is flat, thus ensuring that a correspondingly shaped corresponding engagement contour (10) will fit in a form-fitting way.

12. The firearm according to claim 1, characterized in that the widths of the weapon chassis (3) and the weapon system support (4), respectively, are adapted to one another so that they can be inserted into one another in such a way that the corresponding engagement contours (10) can be brought into a form-fitting engagement.

13. The firearm according to claim 1, characterized in that in order to secure an arrangement of corresponding engagement contours (10), which are brought into form-fitting engagement with one another, to inhibit them from yielding upward and/or downward, a plurality of through bores (41) are provided in the weapon chassis (3) and the weapon system support (4), respectively, from bottom to top, transversely to a longitudinal axis of the firearm (1), which are spaced apart axially by a distance that corresponds to the spacing pattern of the engagement contour (10) or to a multiple thereof so that the weapon chassis (3) and the weapon system support (4), respectively, having a corresponding engagement contour (10) are screw-connectable to each other by means of bolts extending through the bores (41).

14. The firearm according to claim 1, characterized in that the weapon chassis (3) and the weapon system support (4), respectively, are provided with one or more fit bolts (40) aligned with one or more bores (41), which are likewise positioned at distances corresponding to the spacing pattern of the corresponding engagement contour (10) or a multiple thereof in order to ensure a defined seating before a screw connection is produced.

15. The firearm according to claim 1, comprising a barrel receptacle having a receiving sleeve (20) with a receiving region (22) for a hand guard and mounting device (6); wherein the receiving region (22) has an octagonal cross-section having a small first dimension that a corresponding second dimension of a remaining cross-section of the receiving sleeve (20) so that the receiving sleeve (20) tapers with a step (23) to the receiving region (22) and the hand guard and mounting device (6) is a correspondingly embodied octagonal tube, having eight surfaces dimensioned so that the hand guard and mounting device (6) is slidable axially over the receiving region (22) in a form-fitting way until it comes into contact with the step (23); the receiving region (22) and the hand guard and mounting device (6) having recesses that are provided in axial succession in a predetermined spacing pattern in each of the eight surfaces of the hand guard and mounting device (6) and in the receiving region (22), locking-piece-receiving regions (24) for receiving locking pieces (25) are present and have screw holes and a groove (26) for receiving an immobilizing projection of a fastening piece (31); wherein a plurality radially moveable fastening pieces (31) are positioned in radial succession.

16. The firearm according to claim 15, characterized in that immobilization of the receiving sleeve (20) takes place indirectly via the hand guard and mounting device (6) by means of the radially moveable fastening pieces (31); each of the plurality of radially movable fastening pieces (31) being positioned in front of the receiving region (22) and movable radially on the weapon system support (4) and able to engage in lower adjacent apertures (32) in the hand guard and mounting device (6); the radially movable fastening pieces (31) configured to move radially in a guided fashion; wherein two guide tongues (33) extend from a central one of the radially movable fastening pieces (31) transversely outward and upward relative to a longitudinal axis of the firearm in accordance with an angle of a support for the hand guard and mounting device (6); and the central one of the radially movable fastening pieces (31) also has guide pins (34) configured to slide diagonally in guide slots (35) of the weapon system support (4), and a clamping bolt (36) is provided, which acts axially on a narrow end of the central one of the radially movable fastening pieces (31) is spring-loaded, and holds the central one of the radially movable fastening pieces (31) in a position in which it is raised out of its adjacent aperture (32) to a maximum degree.

17. The firearm according to claim 1, characterized in that the firearm has a direction of fire and a breech system, having a bolt receiver (102) and a bolt (103); the bolt receiver (102) being in the form of a hollow cylinder with at least one first thread (116) protruding radially inward and at least one slot (114); the slot (114) being positioned axially adjacent to the first thread (116) and to a bolt head (125), the bolt head having at least one protruding second thread (144) and an adjacent axial flute (145); wherein the first thread (116) of the bolt receiver (102) and the second thread (144) of the bolt head (125) are configured for mutual engagement;

characterized in that the corresponding first and second threads (116, 144) are embodied as receiving and bolt thread segments, respectively (116, 144), with or without a pitch; the respective threads (116, 144) each having at least one thread comb (117, 146); and a rear flank (119) of the at least one thread comb (146) of the bolt head (125) is inclined away from the direction of fire and a corresponding rear flank (148) of the at least one thread comb (117) of the bolt receiver (102) is inclined in the direction of fire.

18. The firearm according to claim 17, characterized in that the thread combs (117, 146) are embodied as sharp thread combs or trapezoidal thread combs with inclined front flanks (118, 147) and inclined rear flanks (119, 148).

19. The firearm according to claim 18, characterized in that a first inclination of the inclined front flanks (118, 147) is different from a second inclination of the inclined rear flanks (119, 148).

20. The firearm according to claim 17, characterized in that a first pitch of the first thread segment (116) is the same as a second pitch of the second thread segment (144).

21. The firearm according to claim 17, characterized in that the bolt head (125) is supported in rotary fashion on a bolt carrier (160) and there is also a bolt body (133), which is able to slide on a bolt head shaft (126) of the bolt head (125), and between the bolt body (133) and the bolt carrier (160), there is at least one compression spring, configured to urge the bolt body (133) in the direction toward the bolt head (125); and the bolt head (125) having a head shaft (126) and the bolt body (133), having rotational means (135, 136) that produce a rotation of the bolt head (125) when the bolt body (133) is slid on the bolt head shaft (126).

22. The firearm according to claim 17, characterized in that the bolt receiver (102) has a plurality of cylinder segments (111), each with a respective thread segment (116) having at least one thread comb (117); and between at least two cylinder segments (111) of the plurality of cylinder segments (111), there are one or more slots (114) positioned in a circumferential wall (112) of the bolt receiver (102); and wherein at least one of the one or more slots (114) extend from a radial inside extent to a radial outside extent and either extend into the circumferential wall (112) to a first radial extent at least equal to a second radial extent of a bottom surface of at least one thread comb (117) or extend all the way through the circumferential wall (112).

23. The firearm according to claim 17, characterized in that a plurality of the second threads (144), each engaging with a respective thread comb (146) having a thread helix, are embodied on the bolt head (125); and adjacent to the plurality of second threads (144), a plurality of flutes (145) extent at least to a flute depth equal to a comb depth defined by a bottom surface at least one of the respective thread combs (146) so that the flutes (145) interrupt a thread helix of the thread combs.

24. The firearm according to claim 1, comprising a lock system having at least two lever arms (352, 351) connected to an axle or shaft (358) in articulating fashion and configured to pivot to either side of a dead point in which at least one lever arm (351) of the at least two level arms is maximally extended; and one of the at least two level arms (352, 351) is embodied as a hammer for a firing pin (330).

25. The firearm according to claim 24, characterized in that a pivot of at least one level arm to a first position on a first side of the dead point, the first side being closer to the firing pin (330), defines a released position and a pivot of the at least one level arm to a second position on a second side of the dead point, the second side being farther from the firing pin (330), defines a safety position.

26. The firearm according to claim 25, characterized in that in the released position, a lever (352), having a latch (373), interfaces in a detachable way with a latch counterpart or surface of a sear bar (398).

27. The firearm according to claim 24, characterized in that the at least one lever arm (351) acts on the rotation axle (358) under a pressure of a spring so that the dead point must be overcome in opposition to the pressure of the spring.

28. The firearm according claim 24, having a bolt travel path and characterized in that the lock system is positioned above the bolt travel path.

29. The firearm according to claim 28, characterized in that a trigger slide is positioned at the underside of the firearm and below the bolt travel path, and a trigger transmission level (306) is configured to transmit a movement of the trigger slide to a sear bar (398) positioned above the bolt travel path.

30. The firearm according to claim 29, wherein a first portion of the trigger transmission lever (306) is positioned and supported in articulating fashion at a first free end (399) diametrically opposite from a second free end (400) of the sear bar (398), the first free end (399) being located toward the underside of the firearm with respect to the sear bar (398); the trigger transmission lever (306) being also positioned and supported in articulating fashion in the trigger slide; the trigger transmission lever (306) being configured so that a first movement of the trigger slide in one axial direction is converted into a second movement of the sear bar (398) in the opposite axial direction or into an increased or decreased movement of the sear bar (398) in the same direction.

31. The firearm according to claim 29, characterized in that in a cocked, unreleased position of the lock system, the second free end (400) of sear bar (398), engages in a latch step (372) or latch recess in a cylindrical region (368) of a guide lever arm (352); the underside of the second free end (400) of the sear bar (398) serves as a latch counterpart element for a flat latch surface formed by the latch recess, which extends relative to a hammer rotation axle, so that the lock system holds a first lever arm in opposition to a pressure of a spring against a hammer bar (304), which is connected in articulating fashion to a second lever arm (351) and is held by the sear bar (398) when a surface of the sear bar is resting against or on the flat latch surface.

32. The firearm according to claim 31, characterized in that the sear bar (398) is positioned so that it can move axially into and out of a position of latched engagement between two or more surfaces; and wherein the sear bar (398) is spring-loaded in the direction toward the position of latched engagement so that a release of the latched connection is opposed by a pressure of a spring.

33. The firearm according to claim 29, characterized in that a safety is provided; the safety comprises a safety rod (385); and the safety rod has safety means (350; 395, 396) which are embodied to cooperate with counterpart safety means (377, 378) of a guide lever arm (352) in such a way that to activate the safety, the safety means (350; 395, 396;

377, 378) pivots a toggle lever out of a released position through the dead point into a safety position; and to deactivate the safety, the safety means (350; 395, 396; 377, 378) pivots the toggle lever out of the safety position through the dead point into the released position.

34. The firearm according to claim 33, characterized in that the safety means of the safety rod (385) has two oblique surfaces, each oblique surface having and inclination oriented in the same direction, and the counterpart safety means comprise a laterally protruding pin so that by means of the pin sliding along at least one of the two oblique surfaces a hammer arrangement moves through the dead point into the safety position and when the safety rod (385) is moved into the firing position, at least one of the two oblique surfaces moves the pin and the hammer arrangement out of the safety position, through the dead point, and into the released position.

35. The firearm according to claim 34, characterized in that in the safety position the laterally protruding pin rests against a flute bottom of a flute in the safety rod, which blocks the movement of the pin and the hammer arrangement into the released position.

36. The firearm according to claim 33, characterized in that the firearm comprises a breech having a locking pin and the safety rod has a catch, lug, or pocket, which, when the safety is activated, is placed around the locking pin or rests against the locking pin, preventing rotation of the breech.

37. The firearm according claim 33, characterized in that on the safety rod, there is a safety transmission lever configured to transmit the movement of a safety slider positioned at the underside of the firearm, to the safety rod positioned at the top of the firearm; the safety transmission lever being positioned at a free end of the safety rod and at the underside of the firearm and supported in articulating fashion on the safety slider; and the safety transmission lever being routed around the breech and/or a cartridge chamber and/or other components or around the bolt travel path and supported in articulating fashion on the safety slider.

38. The firearm according to claim 37, characterized in that the trigger transmission lever (306) and the safety transmission lever are embodied as C-shaped, ring-shaped, bracket-shaped, or question mark-shaped.

39. The firearm according to claim 33, characterized in that the toggle lever is embodied as a hammer lever arm (351) and a guide lever arm (352); the hammer lever arm (351) is an elongated component, first end (353) of the hammer lever arm (351) is connected to a hammer bar (304), and at the first end (353), the hammer lever arm (351) is able to swivel around a rotation axle (354); the rotation axle (354) cooperates with two cheeks (355), which are positioned at one end of the hammer bar (304) and engage the first end (353) between the two cheeks (355), and passes through the first end (353) so that the hammer lever arm (351) is able to rotate around the axle (354).

40. The firearm according to claim 24, characterized in that the lock system has a hammer arrangement that has a hammer and at least one hammer actuating lever arm; the hammer being pivotable around a hammer rotation axle toward and away from a firing pin (330) and the at least one hammer actuating lever arm being linked to the hammer by means of a lever rotation axle; the lever rotation axle being positioned remote from the hammer rotation axle on the hammer; and the hammer and hammer actuating lever arm forming a toggle lever, which can be pivoted around the lever rotation axle to both sides of the dead point.

* * * * *